US011224555B2

(12) United States Patent
Chudek et al.

(10) Patent No.: US 11,224,555 B2
(45) Date of Patent: Jan. 18, 2022

(54) ACCESS AND VAPOR CONTAINMENT SYSTEM FOR A DRUG VIAL AND METHOD OF MAKING AND USING SAME

(71) Applicant: Hospira, Inc., New York, NY (US)

(72) Inventors: Christopher William Chudek, Holly Springs, NC (US); Jesse Carl Fulghum, III, Rocky Mount, NC (US); Amichai Treves, Deerfield, IL (US); Benjamin L. Rush, Glenview, IL (US); Jay Colton Zignego, Bahama, NC (US); Robert William Henson, Fuquay-Varina, NC (US); Edward Paul Browka, Sherrill, NY (US); David Lee Foshee, Apex, NC (US); Theodore J. Mosler, Raleigh, NC (US)

(73) Assignee: Hospira, Inc., Lake Forest, IL (US)

( * ) Notice: Subject to any disclaimer, the term of this patent is extended or adjusted under 35 U.S.C. 154(b) by 462 days.

(21) Appl. No.: 16/390,477

(22) Filed: Apr. 22, 2019

(65) Prior Publication Data

US 2019/0321262 A1 Oct. 24, 2019

Related U.S. Application Data

(60) Provisional application No. 62/661,309, filed on Apr. 23, 2018.

(51) Int. Cl.
*A61J 1/20* (2006.01)
*A61J 1/14* (2006.01)
(Continued)

(52) U.S. Cl.
CPC ..... *A61J 1/2048* (2015.05); *A61J 1/1406* (2013.01); *A61J 1/1412* (2013.01); *A61J 1/16* (2013.01);
(Continued)

(58) Field of Classification Search
CPC A61J 1/2048; A61J 1/16; A61J 1/1412; A61J 1/2082; A61J 1/2072; A61J 1/2037;
(Continued)

(56) References Cited

U.S. PATENT DOCUMENTS 3,902,516 A 9/1975 Rudolph
3,993,063 A 11/1976 Larrabee
(Continued)

FOREIGN PATENT DOCUMENTS

CA 2 924 477 C 5/2019
DE 10 2005 006 771 A1 8/2006
(Continued)

OTHER PUBLICATIONS

PCT International Search Report and Written Opinion for International Application No. PCT/IB2019/053346 dated Oct. 10, 2019.

*Primary Examiner* — Nicolas A Arnett

(57) ABSTRACT

A safety vial system has a vial adapter subsystem irreversibly mountable to the top of a vial containing a hazardous medicament and a vial base subsystem sealingly engaging a lower portion of the vial adapter subsystem and telescopically movable therein from a first position providing a path for gas sterilization around the vial to a second position wherein the path is closed to form a sterilized expandable, neutral pressure bellows chamber around and below the vial. The device has a removable top cap, a pierceable barrier film, a normally closed needleless valve in fluid communication with a dual lumen spike initially disposed above the film and a frangible product integrity ring holding the activation housing in place for sealed telescopic movement on a main body that surrounds the vial. The user pulls the product integrity ring and removes it, and then pushes the activation housing axially downward until it clicks to lock the device in the activated position wherein both lumens of the spike are in communication with the inside of the vial.
(Continued)

The user removes the top cap on the activation housing assembly, and then uses a needleless syringe with an adapter thereon to add diluent and mixes if needed and withdraw drug from the vial via the valve.

33 Claims, 67 Drawing Sheets

(51) Int. Cl.
*A61J 1/16* (2006.01)
*A61J 1/06* (2006.01)
*G21F 5/018* (2006.01)
*G21F 5/06* (2006.01)

(52) U.S. Cl.
CPC ..... *A61J 1/2006* (2015.05); *A61J 1/2037* (2015.05); *A61J 1/2072* (2015.05); *A61J 1/2082* (2015.05); *A61J 1/2096* (2013.01); *A61J 1/065* (2013.01); *A61J 1/1418* (2015.05); *A61J 1/1425* (2015.05); *A61J 1/201* (2015.05); *A61J 1/2051* (2015.05); *A61J 1/2065* (2015.05); *G21F 5/018* (2013.01); *G21F 5/06* (2013.01)

(58) Field of Classification Search
CPC ..... A61J 1/2096; A61J 1/2006; A61J 1/1406; A61J 1/2051; A61J 1/2065; A61J 1/201; A61J 1/1418; A61J 1/1425; A61J 1/065; G21F 5/018; G21F 5/06
See application file for complete search history.

(56) References Cited

U.S. PATENT DOCUMENTS 4,092,546 A 5/1978 Larrabee
4,564,054 A 1/1986 Gustavsson
4,588,403 A 5/1986 Weiss et al.
4,600,040 A 7/1986 Näslund
4,607,671 A 8/1986 Aalto et al.
4,614,267 A 9/1986 Larkin
4,645,073 A 2/1987 Homan
4,768,568 A 9/1988 Fournier et al.
4,834,149 A 5/1989 Fournier et al.
4,895,275 A 1/1990 Quinn et al.
4,982,769 A 1/1991 Fournier et al.
5,102,406 A 4/1992 Arnold
5,117,875 A 6/1992 Marrucchi
5,139,489 A 8/1992 Hollister
5,334,163 A 8/1994 Sinnett
5,423,791 A 6/1995 Bartlett
5,423,793 A * 6/1995 Isono ..... A61J 1/2089 604/403
5,439,643 A 8/1995 Liebert
5,575,279 A 11/1996 Beplate
5,766,147 A 6/1998 Sancoff et al.
5,925,029 A 7/1999 Jansen et al.
6,070,623 A 6/2000 Aneas
6,090,093 A 7/2000 Thibault et al.
6,113,583 A 9/2000 Fowles et al.
6,209,738 B1 4/2001 Jansen et al.
6,213,994 B1 4/2001 Jansen et al.
6,253,804 B1 7/2001 Safabash
6,258,078 B1 7/2001 Thilly
6,280,430 B1 8/2001 Neftel et al.
6,409,708 B1 6/2002 Wessman
6,464,105 B1 10/2002 Rolle et al.
6,478,788 B1 11/2002 Aneas
6,544,246 B1 4/2003 Niedospial
6,551,299 B2 4/2003 Miyoshi et al.
6,558,365 B2 5/2003 Zinger et al.
6,666,852 B2 12/2003 Niedospial
6,681,946 B1 * 1/2004 Jansen ..... A61J 1/1406 141/329
6,685,692 B2 2/2004 Fathallah
6,715,520 B2 4/2004 Andréasson et al.
7,306,584 B2 12/2007 Wessman et al.
7,354,427 B2 4/2008 Fangrow
7,559,530 B2 7/2009 Korogi et al.
7,615,041 B2 11/2009 Sullivan et al.
7,628,779 B2 12/2009 Aneas
7,743,799 B2 6/2010 Mosler et al.
8,048,038 B2 11/2011 Guala
8,122,923 B2 2/2012 Kraus et al.
8,133,209 B2 3/2012 Guala
8,167,863 B2 5/2012 Yow
8,172,794 B2 5/2012 Lum et al.
8,172,795 B2 5/2012 Lum et al.
8,197,459 B2 6/2012 Jansen et al.
8,287,513 B2 10/2012 Ellstrom et al.
8,356,644 B2 1/2013 Chong et al.
8,356,645 B2 1/2013 Chong et al.
8,403,905 B2 3/2013 Yow
8,475,404 B2 7/2013 Foshee et al.
8,511,352 B2 8/2013 Kraus et al.
8,562,582 B2 10/2013 Tuckwell et al.
8,684,992 B2 4/2014 Sullivan et al.
8,752,598 B2 * 6/2014 Denenburg ..... A61J 1/2089 141/329
8,870,832 B2 10/2014 Raday et al.
8,926,583 B2 1/2015 Ellstrom et al.
9,089,474 B2 7/2015 Cederschiold
9,174,007 B2 11/2015 Lum et al.
9,205,198 B2 12/2015 Py
9,211,231 B2 12/2015 Mansour et al.
9,226,875 B2 1/2016 Foshee et al.
9,237,986 B2 1/2016 Mansour et al.
9,345,640 B2 5/2016 Mosier et al.
9,345,641 B2 5/2016 Kraus et al.
9,468,588 B2 10/2016 Shemesh
9,510,997 B2 12/2016 Kriheli et al.
9,522,098 B2 12/2016 Tuckwell et al.
9,532,927 B2 1/2017 Kraus et al.
9,549,875 B2 1/2017 Kraus et al.
9,585,812 B2 3/2017 Browka et al.
9,610,222 B2 4/2017 Kriheli et al.
9,636,277 B2 5/2017 Foshee et al.
9,636,278 B2 5/2017 Sanders et al.
9,642,775 B2 5/2017 Sanders et al.
9,662,271 B2 5/2017 Holt et al.
9,750,662 B2 9/2017 Mansour et al.
9,801,786 B2 10/2017 Lev et al.
9,822,891 B2 11/2017 Cederschiold
9,839,580 B2 12/2017 Lev et al.
9,943,463 B2 4/2018 Marks et al.
9,980,878 B2 5/2018 Marici et al.
10,173,011 B2 1/2019 Lum et al.
10,201,476 B2 2/2019 Fangrow
10,219,982 B2 3/2019 Weir et al.
10,265,480 B2 4/2019 Py
10,286,201 B2 5/2019 McKinnon et al.
10,299,990 B2 5/2019 Lev et al.
2002/0193777 A1 12/2002 Aneas
2007/0108205 A1 5/2007 Porras
2008/0188799 A1 8/2008 Mueller-Beckhaus et al.
2012/0059346 A1 3/2012 Sheppard et al.
2013/0079744 A1 3/2013 Okiyama et al.
2014/0318995 A1 10/2014 Eilertsen
2014/0360623 A1 12/2014 Nielsen et al.
2015/0078961 A1 3/2015 Opie
2015/0290079 A1 10/2015 Nishioka et al.
2015/0305981 A1 10/2015 Cederschiold
2016/0206512 A1 7/2016 Chhikara et al.
2016/0287475 A1 10/2016 Yevmenenko et al.
2017/0021156 A1 1/2017 Kraus et al.
2017/0065486 A1 3/2017 Mosier et al.
2017/0143586 A1 5/2017 Holt et al.
2017/0189271 A1 7/2017 Sanders et al.
2017/0203091 A1 7/2017 Sanders et al.
2018/0058594 A1 3/2018 Cederschiold
2018/0243167 A1 8/2018 Marici et al.
2018/0318572 A1 11/2018 Kraus et al.
2019/0060171 A1 * 2/2019 Lee ..... A61J 1/2037

(56) References Cited

U.S. PATENT DOCUMENTS

| | | | | |
|---|---|---|---|---|
| 2019/0117515 | A1 | 4/2019 | Fangrow | |
| 2019/0142695 | A1* | 5/2019 | Eli | A61J 1/2096 604/415 |
| 2019/0151203 | A1 | 5/2019 | Weir et al. | |

FOREIGN PATENT DOCUMENTS

| | | | |
|---|---|---|---|
| JP | 2003-305129 | | 10/2003 |
| WO | 03/000170 | A1 | 1/2003 |
| WO | 2007/016171 | A2 | 2/2007 |
| WO | 2007/068823 | A1 | 6/2007 |
| WO | 2007/068825 | A1 | 6/2007 |
| WO | 2007/101772 | A1 | 9/2007 |
| WO | 2008/153460 | A1 | 12/2008 |
| WO | 2013/099610 | A1 | 7/2013 |
| WO | 2013/108521 | A1 | 7/2013 |
| WO | 2014/105971 | A1 | 7/2014 |
| WO | 2017/109776 | A1 | 6/2017 |
| WO | 2018/213524 | A1 | 11/2018 |

* cited by examiner

ACCESS AND VAPOR CONTAINMENT SYSTEM FOR A DRUG VIAL AND METHOD OF MAKING AND USING SAME

FIELD OF THE INVENTION

The present invention relates to drug vial access and containment systems and methods for enclosing and handling potentially hazardous, vapor producing, toxic, noxious, cytotoxic, or expensive drugs. More particularly, the invention relates to a pre-assembled, ready-to-use safety vial system for neutral pressure containment of vapors and medication within a sealed enclosure surrounding a drug vial while securely enabling access for mixing/reconstituting and/or withdrawl of the medication contained in the drug vial. Although an empty or pre-filled drug vial could be supplied separately, the system typically is manufactured so that it contains a pre-filled drug vial such that it is considered a single-entity combination (device and drug) product.

BACKGROUND OF THE INVENTION

During the course of preparing and administering hazardous drugs, patients, medical and pharmacy personnel may risk being exposed to such drugs and their dusts, aerosols, or vapors, which may escape to the surroundings. As referred to herein, a "hazardous drug" is any injectable material that the contact with in any form (solid, liquid or vapor) may constititute a health hazard. Illustrative, non-limiting examples of such drugs include antibiotics, antiviral drugs, chemotherapy drugs, cytotoxins, and radiopharmaceuticals, or a combination thereof, in liquid, solid or gaseous state.

Conventionally, hazardous drugs for intravenous delivery were, and in many cases still are, prepared in a separate room by a pharmacist wearing protective clothing, googles, gloves, and a mouth mask, sitting or standing under a laminar flow safety hood. Currently available on-market "closed system transfer devices" (CSTD) tend to approach the problem of occupational exposure to hazardous drugs by providing to pharmacy personnel a device that clips on to the top of the sealed glass drug vials that come filled with the drug in liquid or powder form. However, such clip on devices are difficult to attach to the vial and often leak hazardous drug in liquid, dust, aerosol or vapor form during the attachment process. Furthermore, during the process of mixing or reconstituting liquid the clip on devices can become dislodged. Many conventional CSTDs include multiple separate components that must be connected and disconnected in order to assemble the device, access the drug in the vial, perform any mixing, and transfer the drug for delivery to the patient. Leaks sometimes develop when components are connected or disconnected.

Especially as it relates to oncology drug vials, there is a need for an improved vial access system that would add a layer of protection to pharmacists, nurses, and patients by preventing inadvertent exposure to hazard drugs, including but not limited to cytotoxic oncology medications.

There is a need for a more comprehensive safety solution in which a vial access system would include a drug-filled vial housed within a device assembly, resulting in a pre-filled, pre-assembled, ready-to-use combination product intended to improve the safety and convenience of product storage, transportation, handling, preparation and delivery.

Therefore, an objective of the present invention is to provide a vial access and vapor containment system for enclosing drug vials containing hazardous drugs or materials.

Another objective of the present invention is to provide neutral pressure access to the contents a hazardous drug vial so that mixing and transfer can be accomplish without generating pressure that can lead to ergonomic resistance, inaccurate dosing, wasted drug during dispensing, leaks, or other difficulties.

Another objective of the present invention is to provide a system that protects the enclosed vial and its integrated bellows from breakage, tearing or other damage.

Another objective of the present invention is to provide an integrated system that is pre-assembled and thus eliminates for the user the extra steps of attaching and/or removing a separate closed transfer device system to a drug vial.

Another objective of the present invention is to provide a safety vial system that is axially constructed and easily adaptable to multiple different vial sizes with minimal change in components and radial footprint.

Another objective of the present invention is to provide a vial access and vapor containment system that presents an axially (longitudinally) and radially compact system with a lower center of gravity than conventional systems such that assembly, handling, packaging and storage are not made substantially more difficult, but are instead enhanced.

Another objective of the present invention is to provide a safety vial system that affords an extra layer of containment and protection for hazardous drugs packaged in liquid or powdered form in vials.

Another objective of the present invention is to provide for access to drug vial contents by a needleless connector, without the use of a sharp needle, thus preventing needle sticks.

Another objective of the present invention is prevention of inadvertent contact with the hazardous drug during removal and transfer of the vial contents.

Another objective of the present invention is containment of potentially hazardous vapors, dust, liquid droplets, or aerosols, which might otherwise be released to the immediate environment during reconstitution or withdrawal of the vial contents.

Another objective of the present invention is to provide a safety vial system, as well as a mixing and transfer method, which improves user safety during the handling of hazardous drugs.

Another objective of the present invention is the reduction of risk of unintentional exposure to chemotherapeutic agents during their preparation, administration and disposal.

Another objective of the present invention is to provide a sealed system that prevents ingress of environmental contaminates during drug transfer.

Another objective of the present invention is to provide a safety vial system that cannot be misused, manipulated, or have its critical components disassembled by a user without visual evidence of tampering or use, and can be disposed of as a closed unit after use.

Another objective of the present invention is to provide a safety vial system that can be used safely and effectively with single-use or multi-use vials within the shelf life time constraints related to the drug contained therein.

Another objective of the present invention is to provide a safety vial system that can be dual sterilized, or in other words, have some of its components radiation sterilized and later have the entire completed system gas sterilized as part of the assembly process and then moved from a first, unsealed condition or position to a second, sealed condition or position.

Another objective of the present invention is to provide a closed pathway for contained transfer of the medication from the vial into a syringe for subsequent administration.

Another objective of the present invention is to provide a safety vial system that provides the user with audio, visual or tactile feedback when it reaches the fully activated position with the vial access member in fluid communication with the interior of the vial.

Another objective of the present invention is to provide a safety vial system with a bellows base having at least a portion located below the drug vial to protect the bellows film mounted to the underside of the bellows base and provide supplementary containment for any residual amounts of drug product post activation.

Another objective of the present invention is to provide a safety vial system that includes product integrity and locking features, which prevent the user from being able to access the drug vial directly to pilfer or modify the drug once the complete combination product is assembled during manufacture, without leaving evidence of tampering or use.

Another objective of the present invention is to provide safety vials for multi-dose, single dose, liquid, and lyophilized drug presentations, whether at room temperature or refrigerated, which are easier and safer to transport, store and use.

These and other objectives will be apparent to one skilled in the art in view of the drawings and description included herein.

SUMMARY OF THE INVENTION

Disclosed herein is a containment and safe access device for a drug vial holding a hazardous medicament, including a vial adapter subsystem that has an activation housing assembly that mounts over the vial and mates in a telescoping yet sealed manner with a main body assembly surrounding and locking onto the vial, and a vial base subsystem having a bellows base that slidably inserts into the bottom of the main body and is movable from a first position defining a pathway for gas sterilization around the vial to a second position wherein the pathway is closed to form a sterilized expandable, neutral pressure bellows chamber. The device has a removable top cap, a pierceable barrier film, a normally closed needleless valve in fluid communication with a dual lumen spike initially disposed above the barrier film and a frangible product integrity ring (PIR) releasably holding the activation housing assembly coupled to the main body assembly that surrounds the vial. The user releases the PIR, pushes the activation housing assembly axially downward until it clicks to pierce the vial stopper and lock the device in the activated position, and then removes the top cap on the activation housing assembly. Then the user uses a syringe, or optionally a syringe assembly including a Luer-lock syringe and a needleless syringe adapter thereon, to fluidly couple with the needleless valve in the vial adapter subsystem (and add diluent and mix, if necessary), and then withdraw drug from the vial via the valve.

Also disclosed are methods of making and using the neutral pressure containment and access device for packaging and handling hazardous drugs.

DETAILED DESCRIPTION OF THE INVENTION

Figure 1:
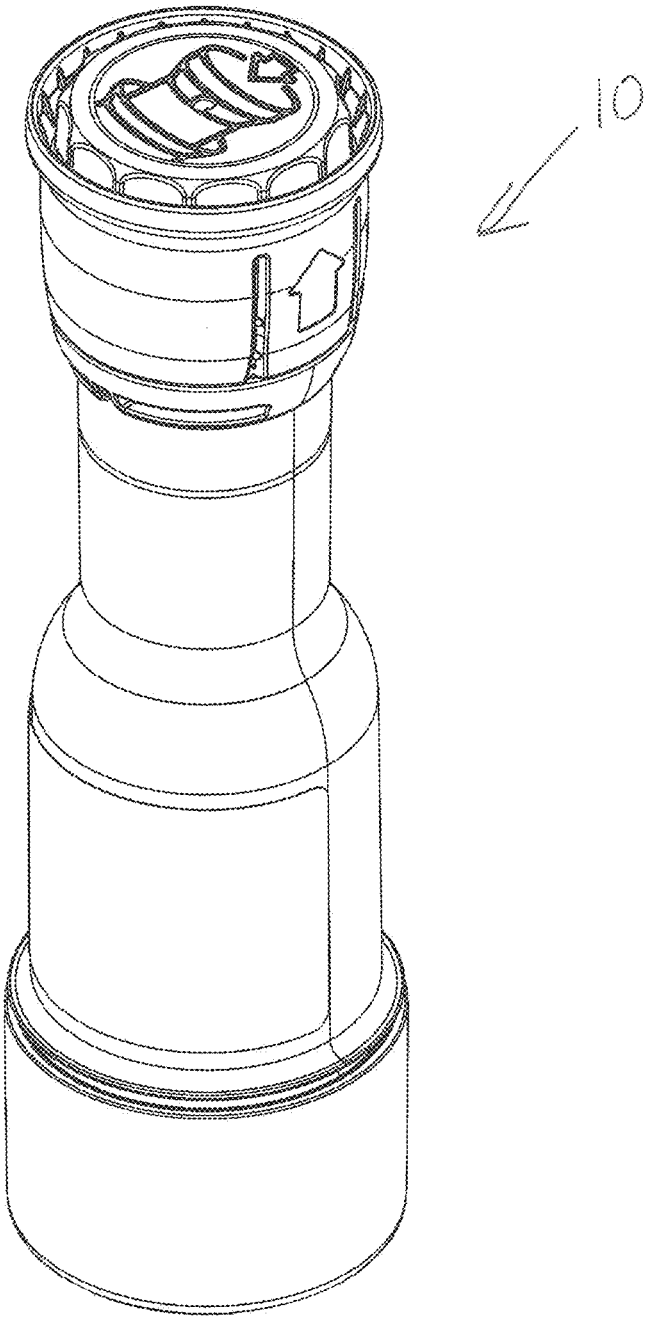
FIG. 1 is a perspective, assembled view of a safety vial system with vapor containment according one embodiment of the present invention.

In order that this invention may be better understood, the following description and examples are set forth. The description and examples are for purposes of illustration only and are not to be construed as limiting the scope of the invention in any manner.

The following brief description of terms should apply to the description. The term "comprising" means including but not limited to. The phrase "in one embodiment", "according to one embodiment", and similar phrases shall mean that various aspects of the invention or portions thereof can be utilized separately or in combination with other portions, aspects or features from other embodiments. The term "distal" means in a direction away from the top of the device or toward the bottom of the device and "proximal" means in a direction toward the top of the device as it would normally rest on a table, countertop, conveyor belt or other supporting surface. For example, the vial base subsystem is normally located at the distal end of the overall system or device and the top cap of the vial access subsystem is at the proximal end of the overall system or device when the assembled device rests on a table, countertop, conveyor belt or other supporting surface. The terms "drug" and "medicament" are used interchangeably herein.

As best seen in FIGS. 1, 2, 3 and 4 a safety vial system 10 with a neutral pressure type vapor containment system is disclosed. The safety vial system 10 includes a vial base subsystem or subassembly 12, and a vial adapter subsystem or subassembly 14 that are connected in a hermetically sealed manner to enclose, house, protect and provide access to a vial 16 containing a drug product 18 (see FIG. 5). The drug product 18 may start as a liquid or solid. In the case of a solid drug product 18, the drug can be a freeze-dried solid or crystalline form commonly referred to in the art as a lyophilized drug product. Often the lyophilized drug product 18 is reconstituted into a liquid form by adding a liquid diluent to the vial 16 and shaking, swirling or mixing. The drug product 18 may be cytotoxic, extremely expensive, or hazardous to humans, animals or the environment upon exposure to it or its vapors. Drug products especially well-suited for use in the vial 16 within this invention are Carboplatin, Docetaxel, Paclitaxel, Irinotecan, Gemcitabine, Oxaliplatin, Methotrexate, Bortezomib, Cyclophosphamide, and Pemetrexed (including but not limited to Pemetrexed as Ditromethamine), but other drugs would be suitable as well. Certain types of drug products or agents lend themselves well to packaging, storage, and dispensing in the present invention, including but not limited to chemotherapeutic (a.k.a.—cytotoxic) agents, biotherapeutic agents, and anti-neoplastic agents. By way of example and not limitation, a list of chemotherapeutic agents follows:

1. Alkylating agents
2. Anthracyclines
3. Cytoskeletal disruptors (Taxanes)
4. Epothilones
5. Histone Deacetylase Inhibitors
6. Inhibitors of Topoisomerase I
7. Inhibitors of Topoisomerase II
8. Kinase inhibitors
9. Nucleotide analogs and precursor analogs
10. Peptide antibiotics
11. Platinum-based agents
12. Retinoids
13. *Vinca* alkaloids and derivatives Thus, it will be understood that the drug container or vial 16 can be filled with a hazardous drug selected from a group consisting of chemotherapeutic agents, biotherapeutic agents, and antineoplastic agents. The safety vial system 10 is also useful where the drug 18 is a gene therapy agent or stem cells or drugs for stem cell therapy.

Figure 4:
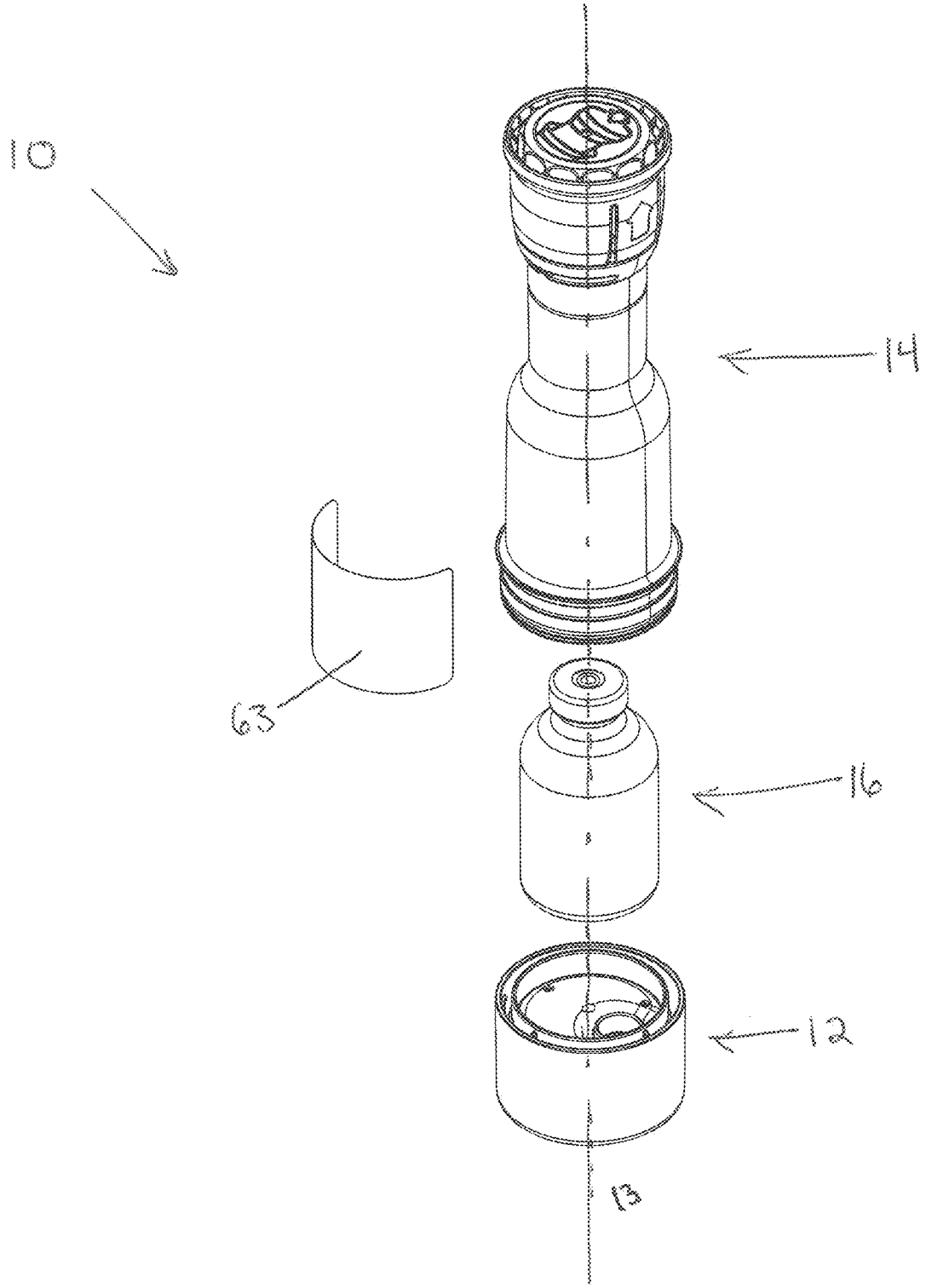
FIG. 4 is an exploded view of a safety vial system according to one embodiment of the invention, which is adapted to fit a given size vial and has a check valve in the bellows base.
Figure 4A:
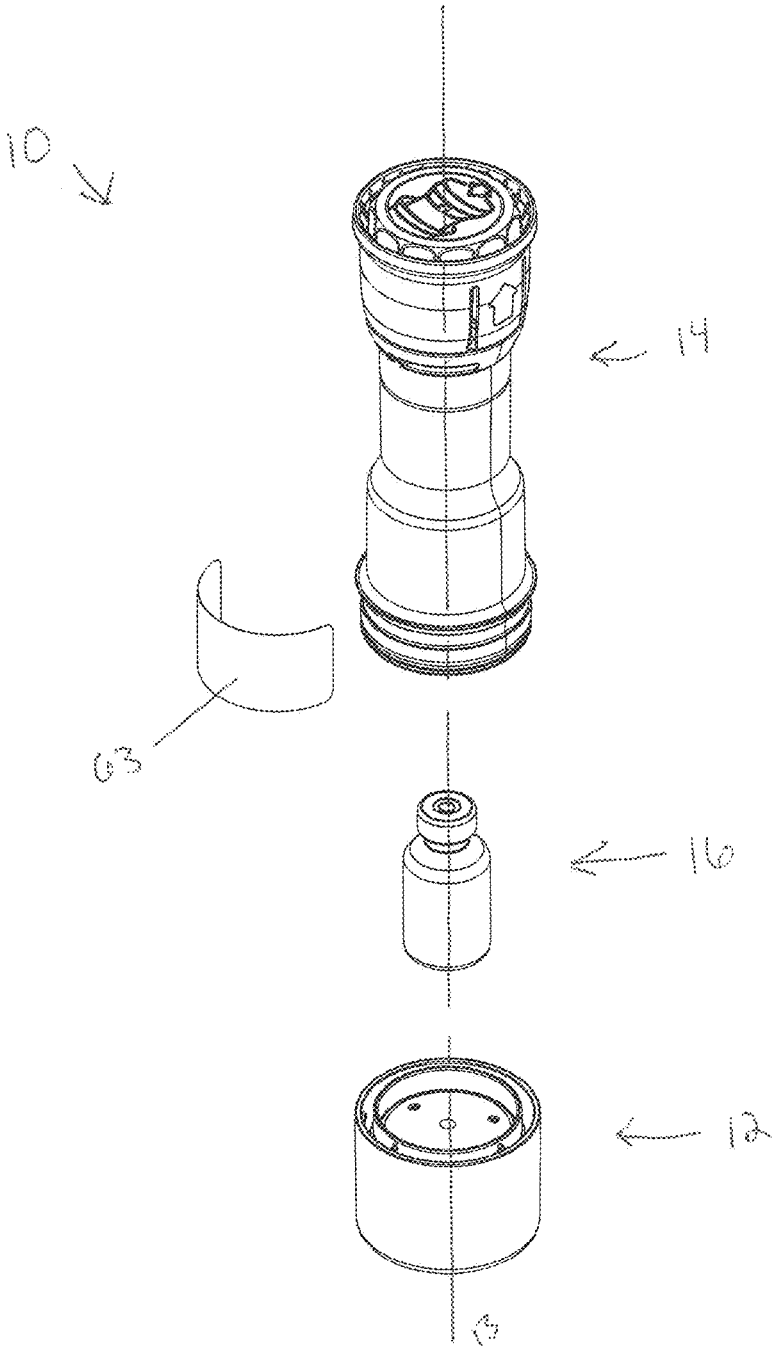
FIG. 4A is an exploded view of the safety vial system according another embodiment of the invention, which is adapted to fit a different size of vial than in FIG. 4 and has no check valve in the bellows base.
Figure 4B:
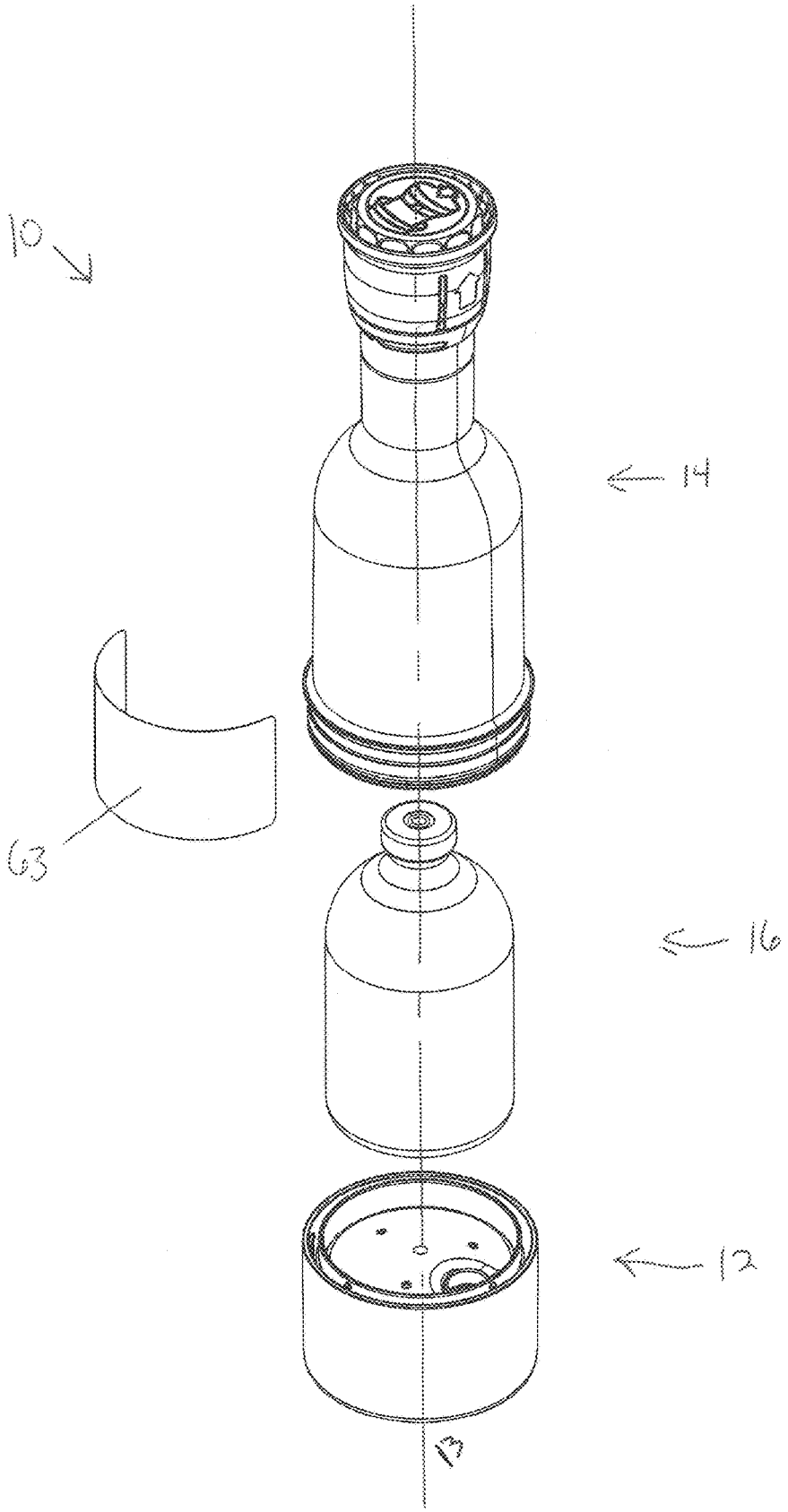
FIG. 4B is an exploded view of the safety vial system according another embodiment of the invention, which is adapted to fit yet another different size vial than in FIG. 4.
Figure 5:
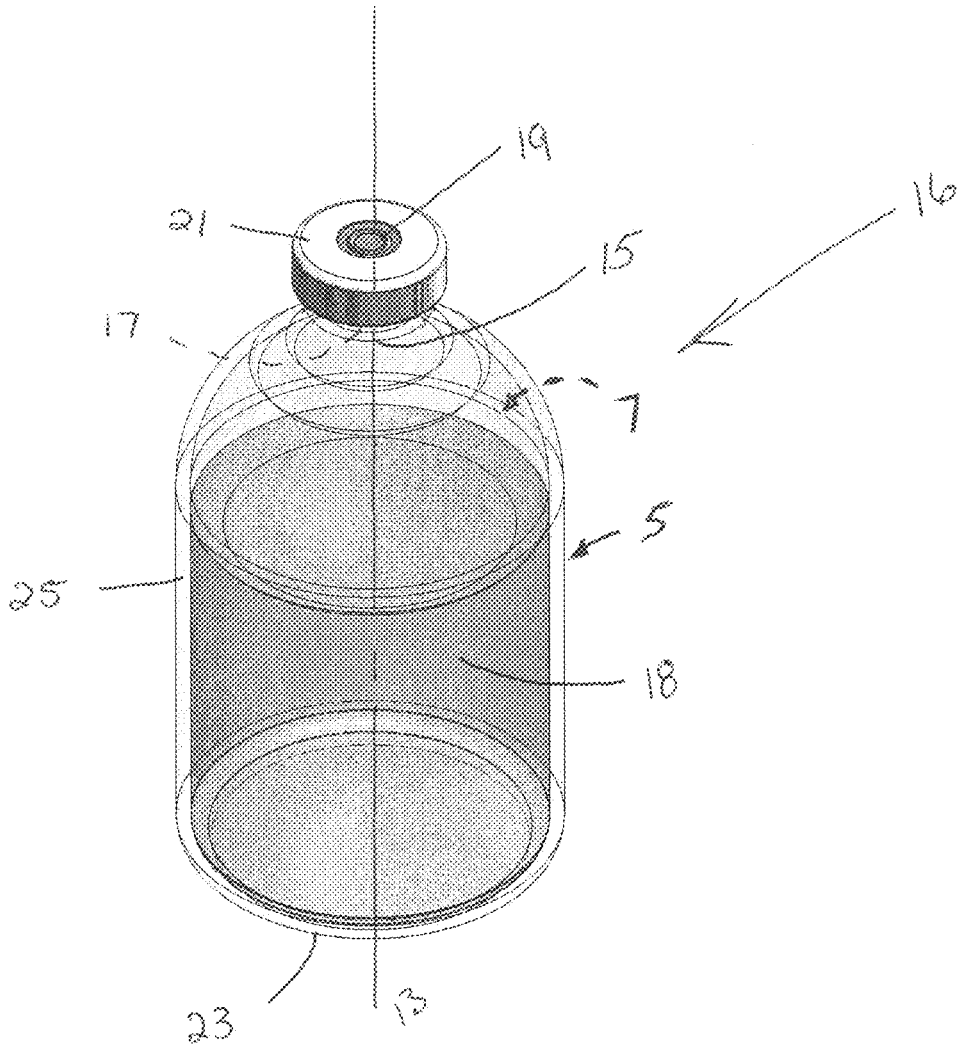
FIG. 5 is an enlarged perspective view of a vial suitable for use with some embodiments of the invention.

As best seen in FIG. 5, the vial 16 has a generally cylindrical shape with a substantially flat and horizontal or slightly concave bottom wall 23, a side wall 25, a reduced diameter neck 15 and a top opening 17 sealed by an elastomeric stopper 19 sized and shaped to frictionally seal the opening 17. The frictional engagement between the elastomeric stopper 19 and the wall 25 is generally sufficient to seal the stopper 19 within the top opening 17, but the stopper 19 also can be retained by a hold down ring 21 of plastic, metal such as aluminum, or other suitable material. Metal hold down rings are conventionally crimped on to hold the stopper 19 sealed to the vial 16. An optional flip-off sterility plastic cap or foil (not shown due to earlier removal or omission) can cover the stopper 19 by attaching to it or the hold down ring 21. The vial 16 can be made of glass, plastic or other suitable material. The vial 16 is also referred to as a primary drug container and the stopper 19, hold down ring 21 and cap are sometimes referred to as primary drug container closure commodities. The vial 16 can be obtained from any of several known commercial suppliers in the medical or pharmaceutical field, such as by way of example and not limitation Corning Incorporated, Schott AG, Gerresheimer, Nuova Ompi, Pacific Vial, Piramal, Saint Gobain Desjonqueres, Stoelzle, and West Pharma. The vial 16 is produced in many different sizes, including but not limited to 2 mL, 5 mL, 6 mL, 10 mL, 20 mL, 30 mL, 50 mL and 100 mL. The safety vial system 10 can be sized and shaped to accommodate a group or set of vial sizes up to and including the 6 mL liquid volume capacity in a "small" configuration (FIG. 4A); up to and including the 30 mL for a "medium" configuration (FIG. 4); and up to and including the 100 mL for a "large" configuration (FIG. 4B). Alternatively, the safety vial system 10 can be customized in size and shape to accommodate a single, specific individual vial size or shape rather than a group or set of sizes and shapes.

Thus, the vial 16 can also be viewed in FIG. 5 as an elongated sealed container having a central longitudinal axis 13, an upper portion 5, a bottom wall 23 and a side wall 25 together defining an interior space 7 containing a drug 18 to be transferred.

General Overall System Structure

Figure 6:
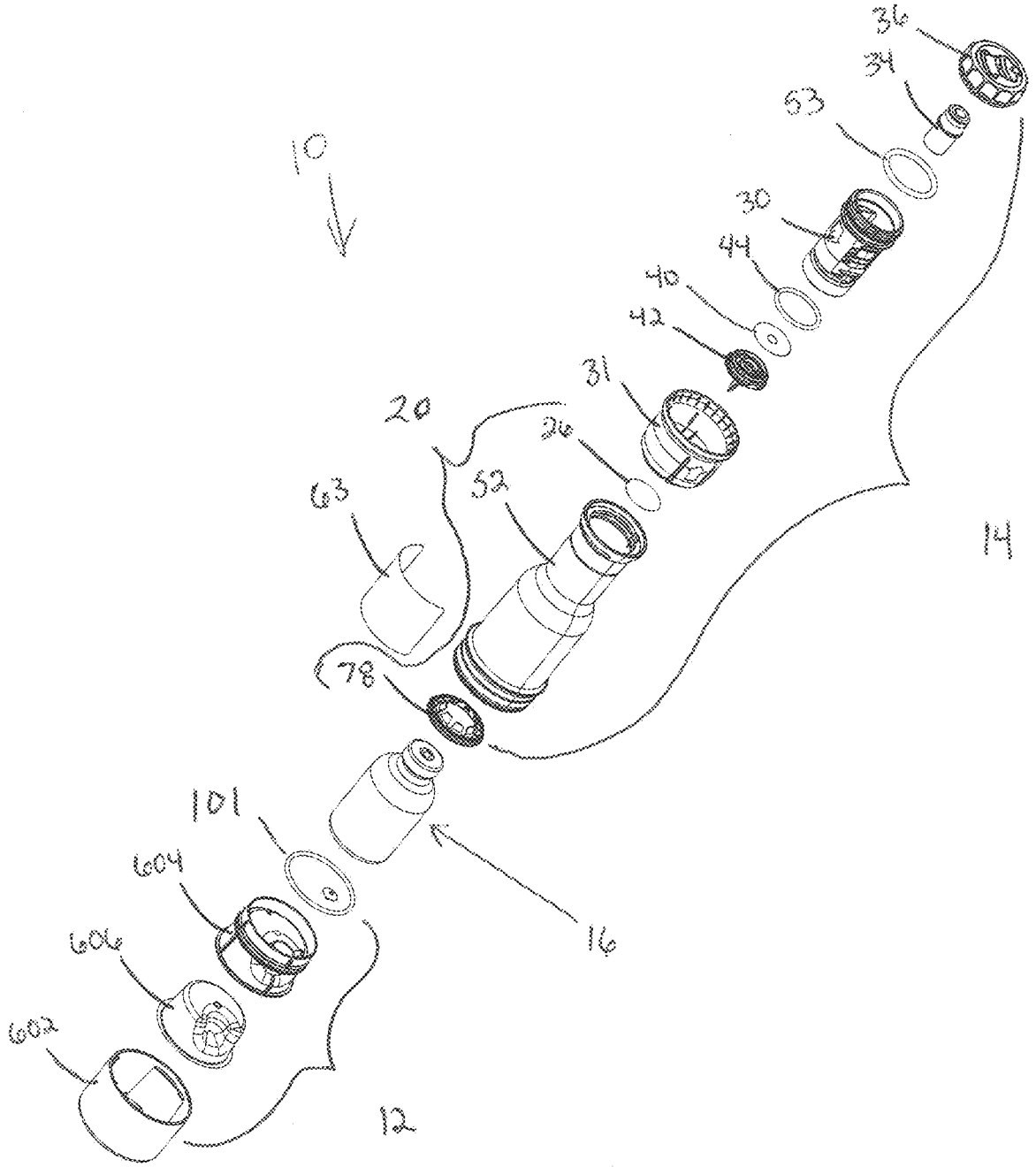
FIG. 6 is an exploded view of a safety vial system according to one embodiment of the invention.

As best seen in FIG. 6, the vial adapter subassembly or subsystem 14 includes a main body assembly 20 that receives the vial 16. In one embodiment, the main body assembly 20 irreversibly attaches or couples with the vial 16 such that the vial 16 is suspended upright in the main body assembly 20 with the stopper 19 facing up and, after attachment, cannot be withdrawn or removed manually by the user. The vial base subsystem 12 and the vial adapter subsystem 14 are aligned axially along a common longitudinal axis 13, which is also parallel to and more preferably coincident with the central longitudinal axis of the vial 16. Thus, all the major components of the vial base subsystem 12 and vial adapter subsystem 14 are more preferably aligned along the same common axis 13. See FIGS. 4-4B for example. The vial base subsystem 12 and the vial adapter subsystem 14 are connected loosely early in the manufacturing process such that they can move axially toward each other along axis 13, and then later (during or after a gas or vapor sterilization step) moved into a position wherein they are connected in a hermetically sealed manner. In one embodiment, the subsystems 12, 14 are concentrically nested in a mating manner for axial telescopic relative movement along the axis 13. In one embodiment best illustrated in FIGS. 6 and 7, an activation housing assembly 28 within the upper portion of the vial adapter subsystem 12 is sized and shaped such that it is adapted to slidingly fit within a top opening in an upper end 54 of a main body 52 of the main body assembly 20. A radial seal 44, such as an O-ring by way of example and not limitation, is operatively interposed between the activation housing assembly 28 and the main body assembly 20.

In one embodiment, the subsystems 12, 14 are permanently connected by a frictional snap fit although the components can also be heat or ultrasonically welded together in other embodiments. In one embodiment, the subsystems 12, 14 are rigidly and hermetically sealed to each other, but some of the key internal components can move axially as needed to activate the system. See FIGS. 1-4B for examples.

Vial Adapter Subsystem

Figure 7:
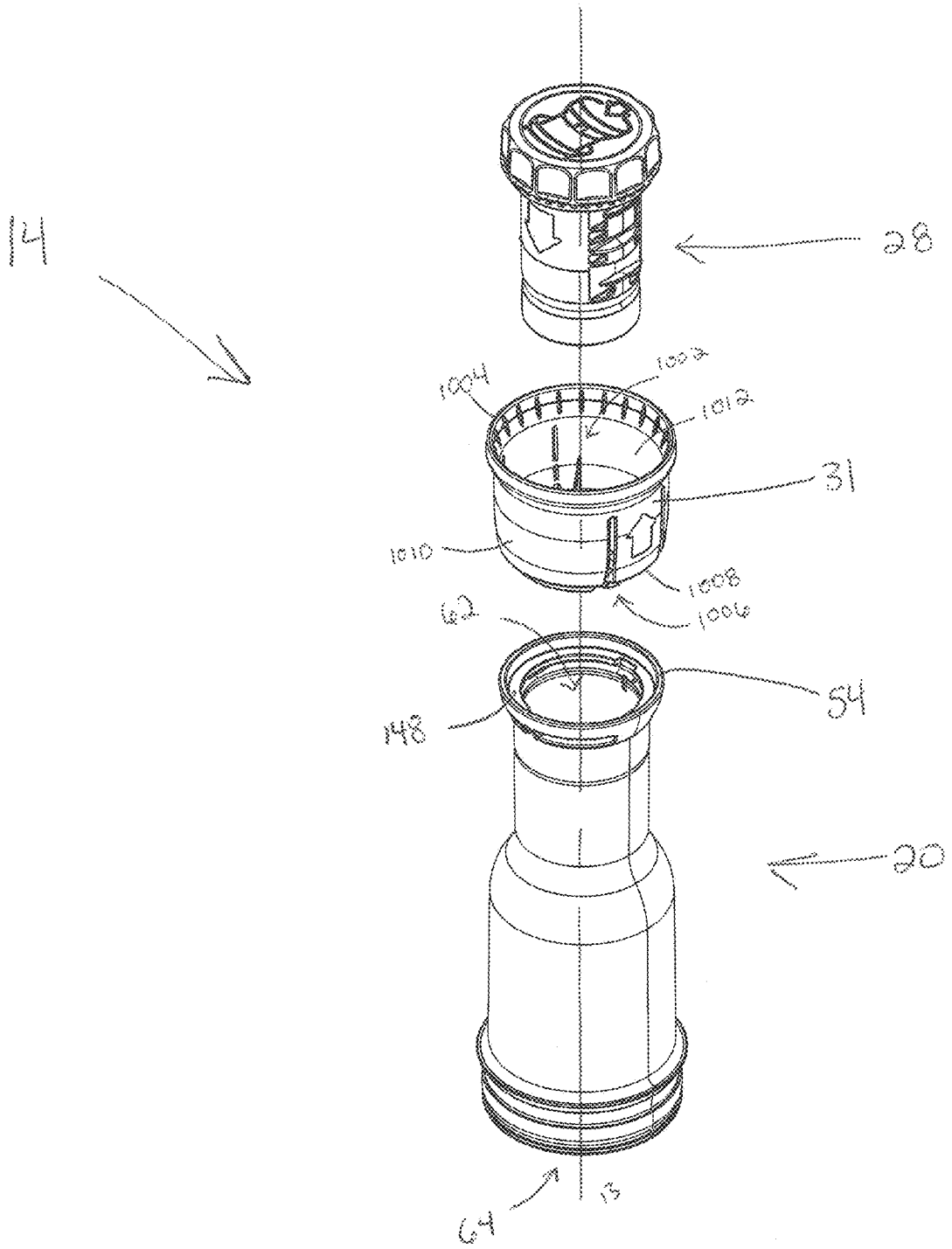
FIG. 7 is an exploded view of a vial adapter subsystem or subassembly according to one embodiment of the invention.
Figure 7A:
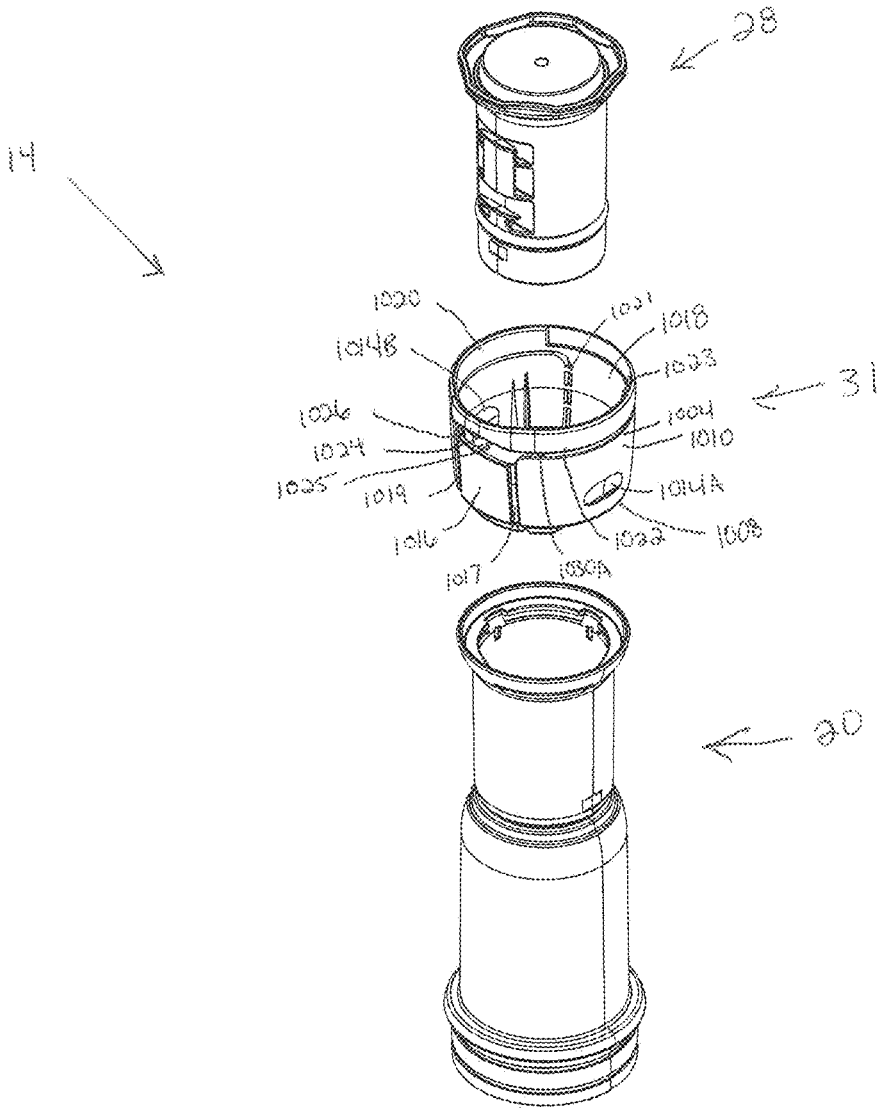
FIG. 7A is an exploded view of a vial adapter subsystem or subassembly according to another embodiment of the invention.

As best seen in FIGS. 7 and 7A, the vial adapter subsystem includes activation housing assembly 28, the main body assembly 20, and the product integrity ring 31. Each of these components will be described in greater detail below.

Activation Housing Assembly

FIGS. 8-10B show that the vial adapter subsystem 14 includes an activation housing assembly 28. The activation housing assembly 28 includes a tubular activation housing 30 with an interior surface 32 and an exterior surface 33, a normally closed needleless valve 34, a top cap 36 with seal 53, a filter 40, a vial access member 42, a seal 44, an optional check valve 38 and an optional adapter 46 (not shown). The needleless valve 34 and the vial access member 42 are rigidly mounted in fixed locations to the activation housing assembly 28 and provide air and fluid communication within the vial adapter subsystem 14. The filter 40 is rigidly mounted within the activation housing assembly 30 and provides air communication and filtration within the vial adapter subsystem 14. The top cap 36 is removably mounted to the activation housing assembly 28. The seal 44 is operatively mounted in a groove 218 in the activation housing 30 and provides a sealing surface within the vial adapter subsystem 14.

In another embodiment, the activation housing assembly 28 includes a tubular activation housing 30 with an interior surface 32, a normally closed needleless valve 34, a top cap 36, a filter 40, a vial access member 42, a seal 44, an optional check valve 38 and an optional adapter 46 (not shown). The needleless valve 34 is rigidly mounted in the activation housing 30 and the top cap 36 is removably mounted to one of the valve 34 or the activation housing 30 in covering relation to the valve 34. The vial access member 42 is rigidly mounted in a fixed location in the activation housing 30 and in fluid communication with the needleless valve 34. The filter 40 is mounted in one embodiment (FIG. 8) to the underside of the cross member 29 in the activation housing 30 and in another embodiment (FIG. 8C) to an upwardly directed or upper surface of the vial access member 42. The seal 44 is operatively mounted in a groove in the activation housing 30 as described below.

Activation Housing

In one embodiment the tubular activation housing 30 is generally cylindrical and has a circumferential wall 27 and an optional intermediate cross member 29 extending radially inwardly from the wall 27. The wall 27 defines an exterior surface 33 of the activation housing 30 and the wall 27 and cross member 29 together define the interior surface 32. An upper portion of the wall 27 of the activation housing 30 terminates at a proximal end with an upper rim 35 that surrounds a top opening 41 in the activation housing 30 and a bottom portion of the wall 27 terminates at a distal end with a lower rim 43 that surrounds a bottom opening 45. The intermediate cross member 29 defines a floor 47 at the bottom of the top opening 41 of the activation housing 30, as well as a ceiling 49 at the top of the bottom opening 45. The intermediate cross member 29 has a central opening 51 formed therein that extends vertically through the cross member 29. In one embodiment the central opening 51 of the cross member 29 is conical and tapered such that the diameter at the top of the opening is larger than the diameter at the bottom of the opening. This assists in the guiding, centering and locating of the mating part, which is the needleless valve 34.

Figure 9:
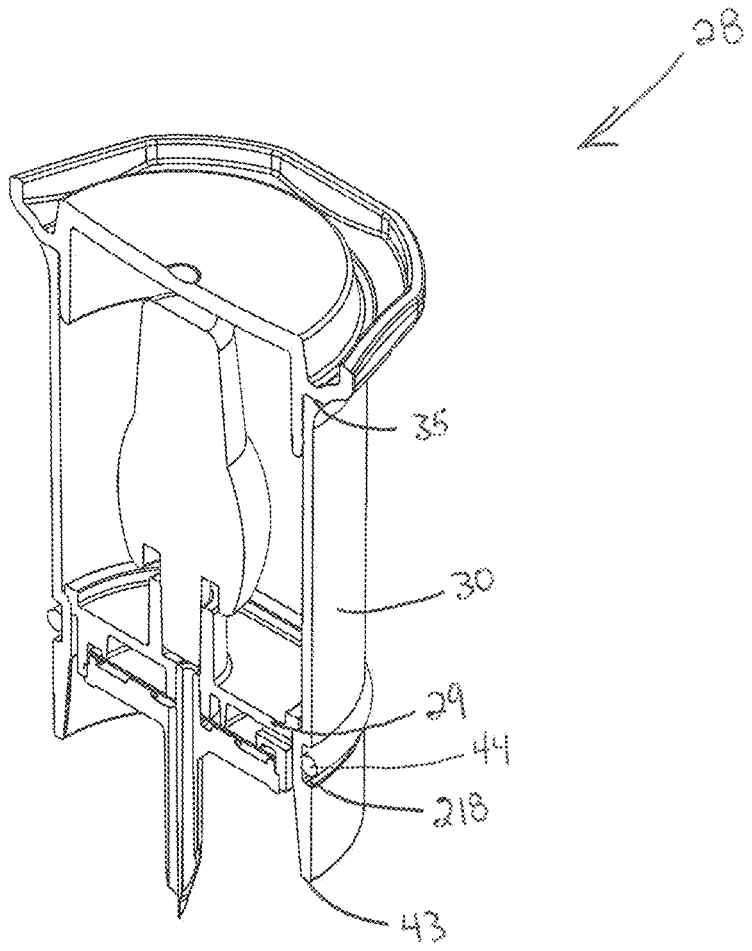
FIG. 9 is a cross-sectioned perspective view of portions of an activation housing assembly according to another embodiment of the invention.
Figure 9A:
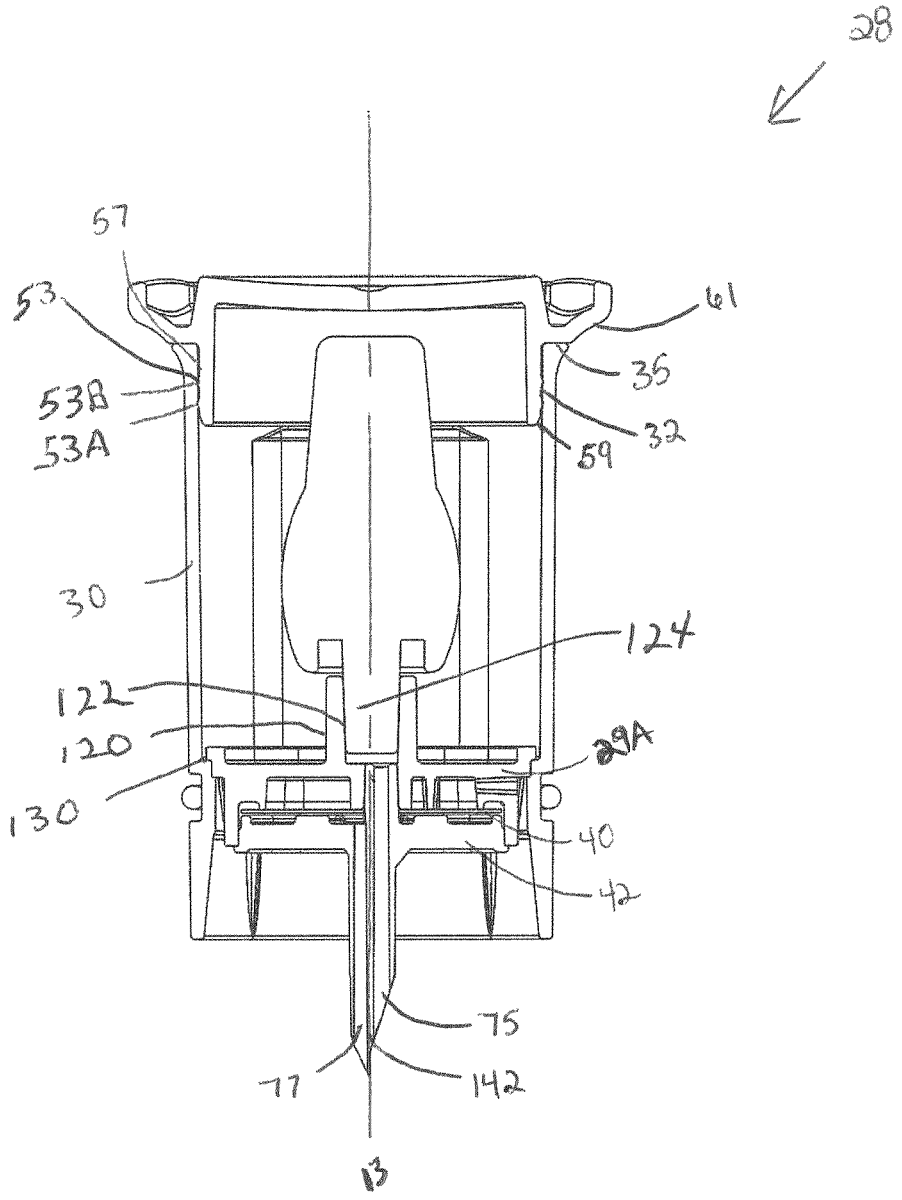
FIG. 9A is a cross-sectional view of portions of an activation housing assembly according to the embodiment of FIG. 9.
Figure 9B:
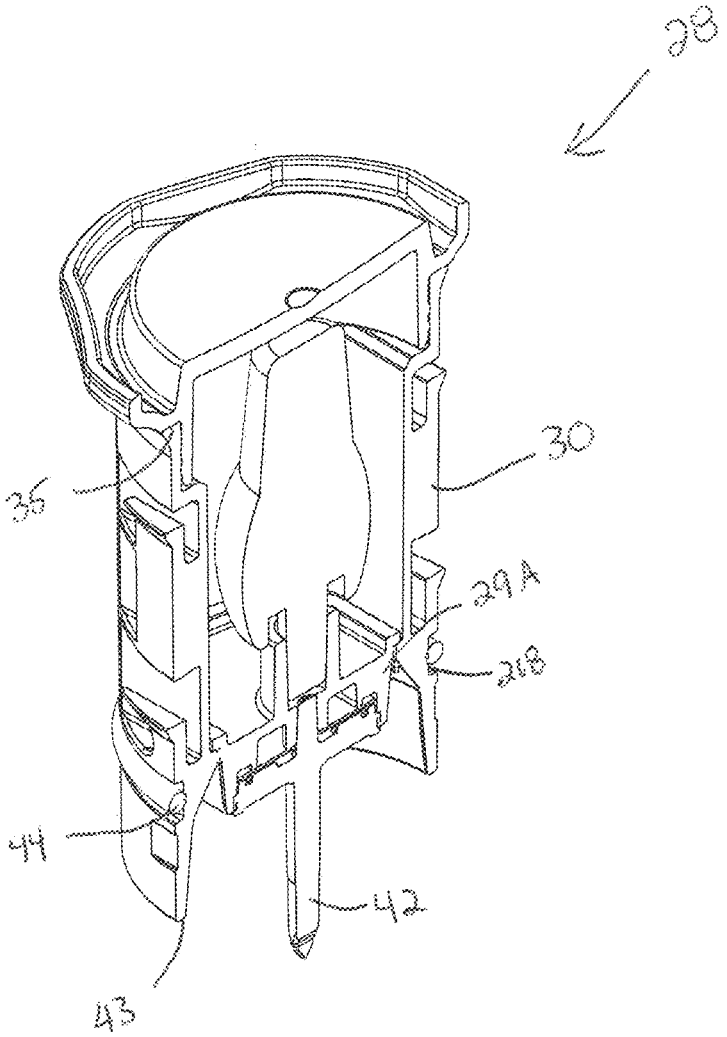
FIG. 9B is a cross-sectional perspective view of portions of an activation housing assembly according to the embodiment of FIG. 9 but is sectioned along an axis that is 90 degrees different than in FIG. 9.
Figure 9C:
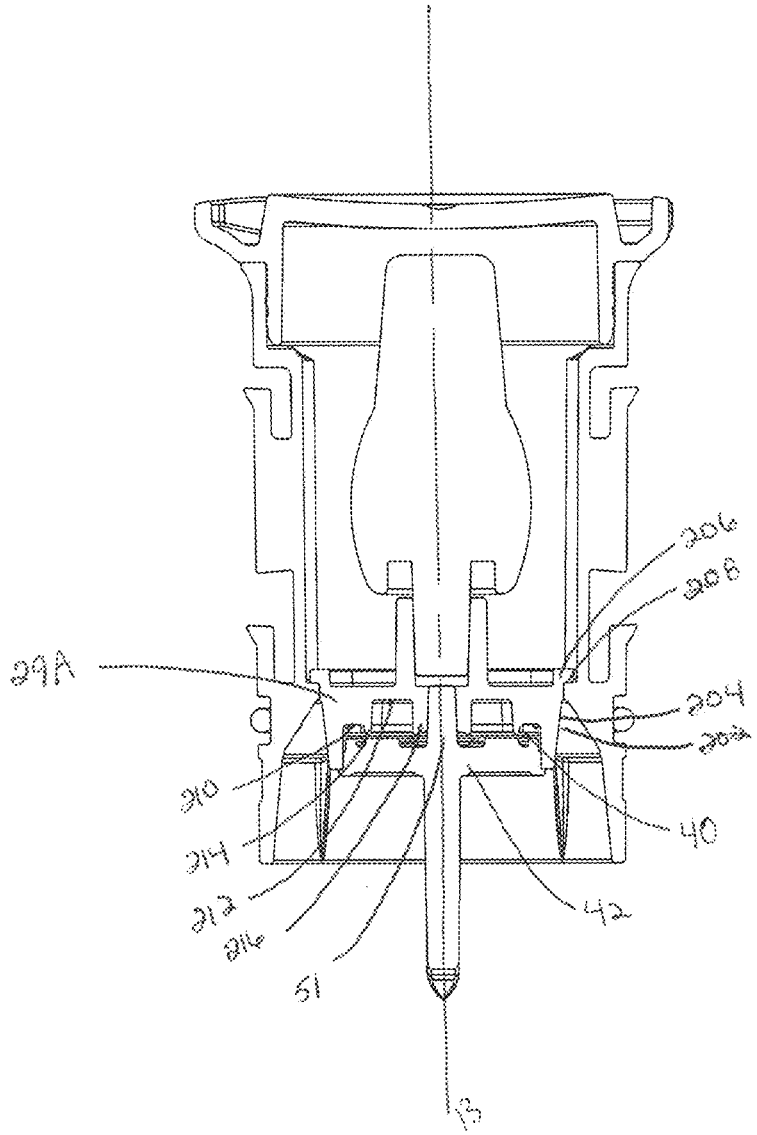
FIG. 9C is a cross-sectional view of portions of an activation housing assembly according to the embodiment of FIG. 9 but is sectioned along an axis that is 90 degrees different than in FIG. 9A.
Figure 9D:
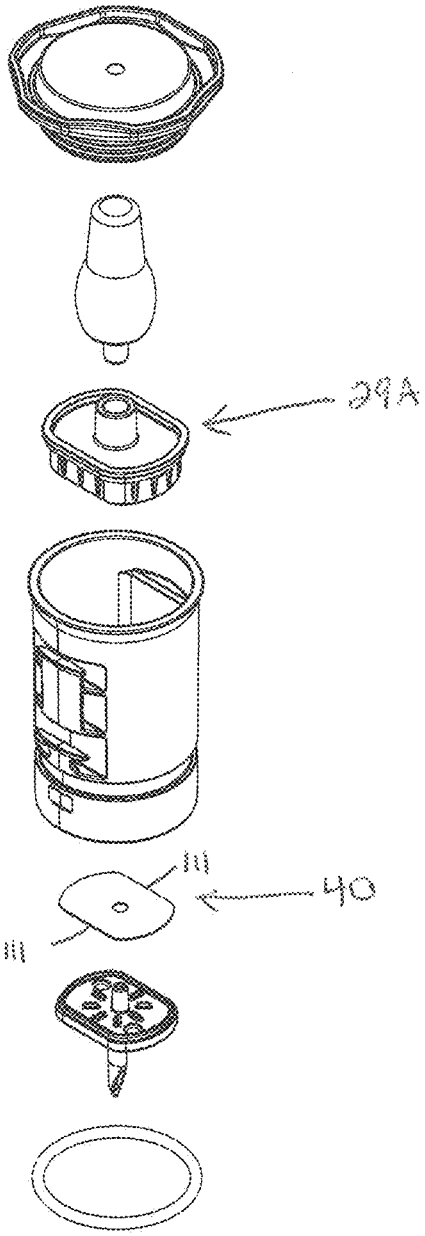
FIG. 9D is an exploded view of an activation housing assembly according to the embodiment of FIG. 9.

In one embodiment best seen in the partial cross-section of FIGS. 9-9D, the ceiling 49 of the cross member 29 may optionally include a number of features such as a radius 202 at the outer perimeter 204, an outer bore 206 extending upwardly that terminates at a shoulder 208, a narrow annular groove 210 extending upwardly and spaced radially inwardly from the shoulder, and a wider annular groove 212 extending upwardly and spaced radially inwardly from the narrow annular groove 210 such that a narrow annular rib 214 is formed between the wider and narrower grooves 210, 212. A second annular rib 216 is formed between the wider groove 212 and the central opening 51 in the cross member 29.

Figure 17:
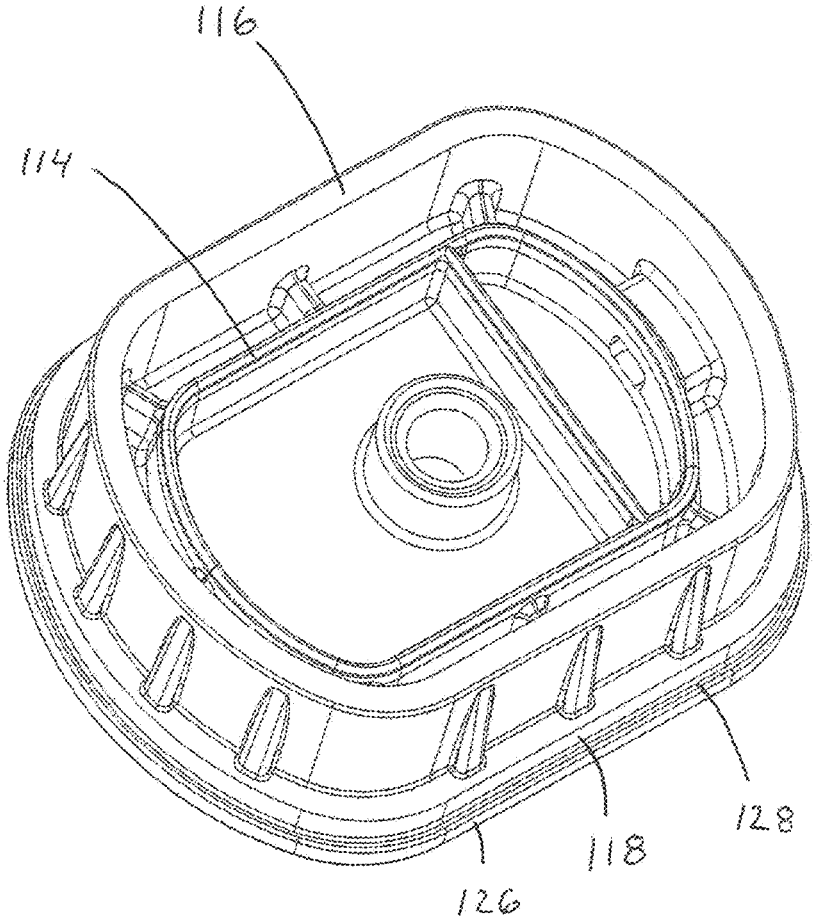
FIG. 17 is an enlarged perspective view of a bulkhead member according to one embodiment of the invention.

In another embodiment, the cross member 29 can be a separate piece or additional component hereinafter referred to as a bulkhead member 29A. As best seen in FIGS. 9-9D and FIG. 17, the bulkhead member 29A attaches to the activation housing 30 and can serve as a mounting point for the needleless valve 34, the filter 40 and the vial access member 42. On the underside there is an inner raised annular ring 114 that provides a surface on which to heat seal the filter 40 to the bulkhead 29A. An outer annular ring 116 also provides a surface and features for ultrasonically welding the vial access member 42 to the bulkhead member 29A. The top of the bulkhead member 29A has an outer peripheral rim 118 for ultrasonic welding of the bulkhead member 29A to the interior surface 32 of the activation housing 30. The bulkhead member 29, 29A also has a centrally located raised boss 120 with a tapered bore 122 therethrough for mating with and mounting in a fluid tight manner the distal end 124 of the needleless valve 34. The mounting is done by laser welding, solvent bonding, adhesive, heat sealing or other sealing methods. A tapered lead-in peripheral skirt 126 extends distally from the rim 118. The skirt 126 provides a limiting or stop surface 128 to prevent overtravel of the bulkhead 29, 29A during assembly by abutting an inwardly extending ledge or shoulder 130 on the activation housing 30.

Figure 8:
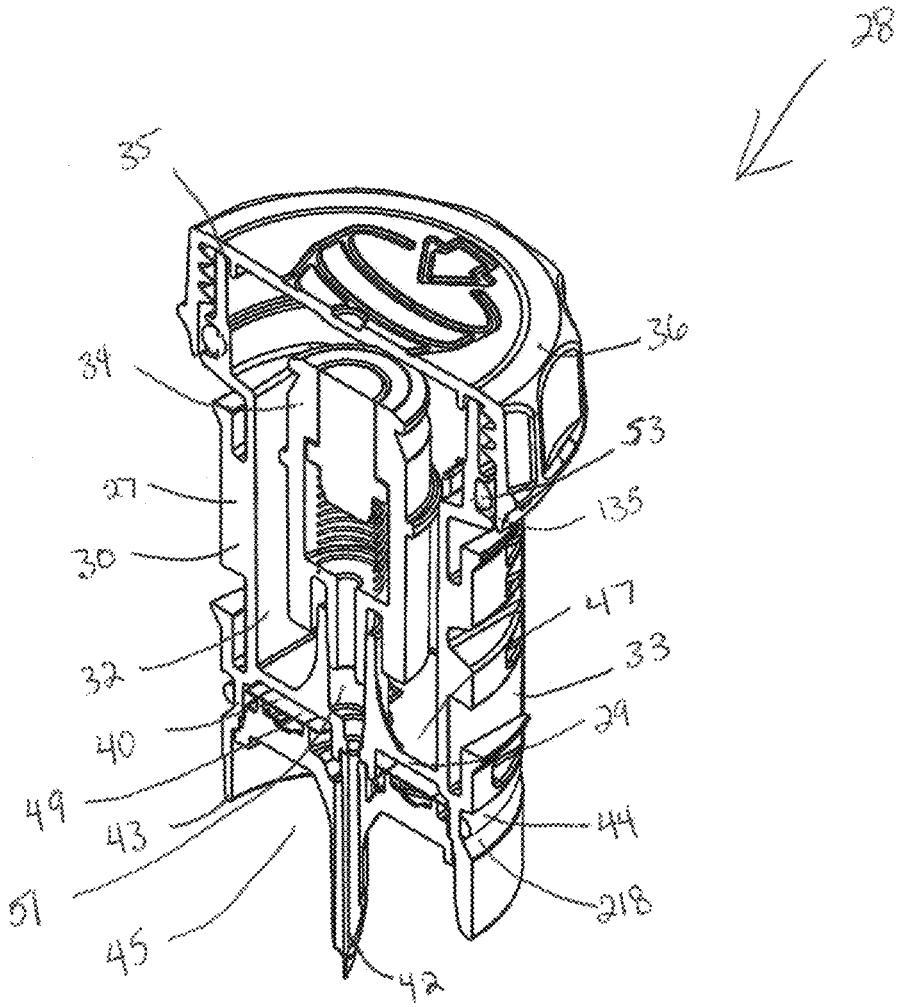
FIG. 8 is a cross-sectioned perspective view of an activation housing assembly according to one embodiment of the invention.
Figure 8A:
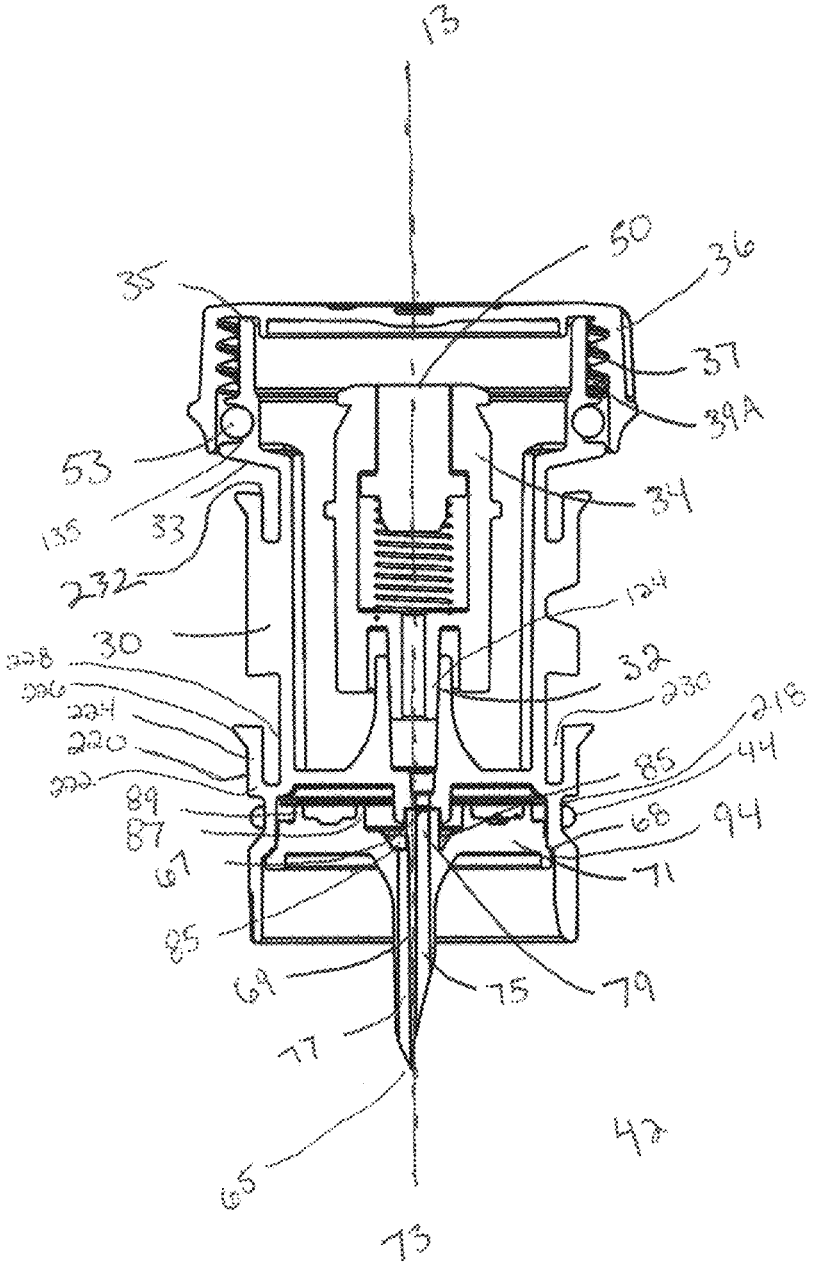
FIG. 8A is a sectional view of an activation housing assembly according to the embodiment of FIG. 8.
Figure 8B:
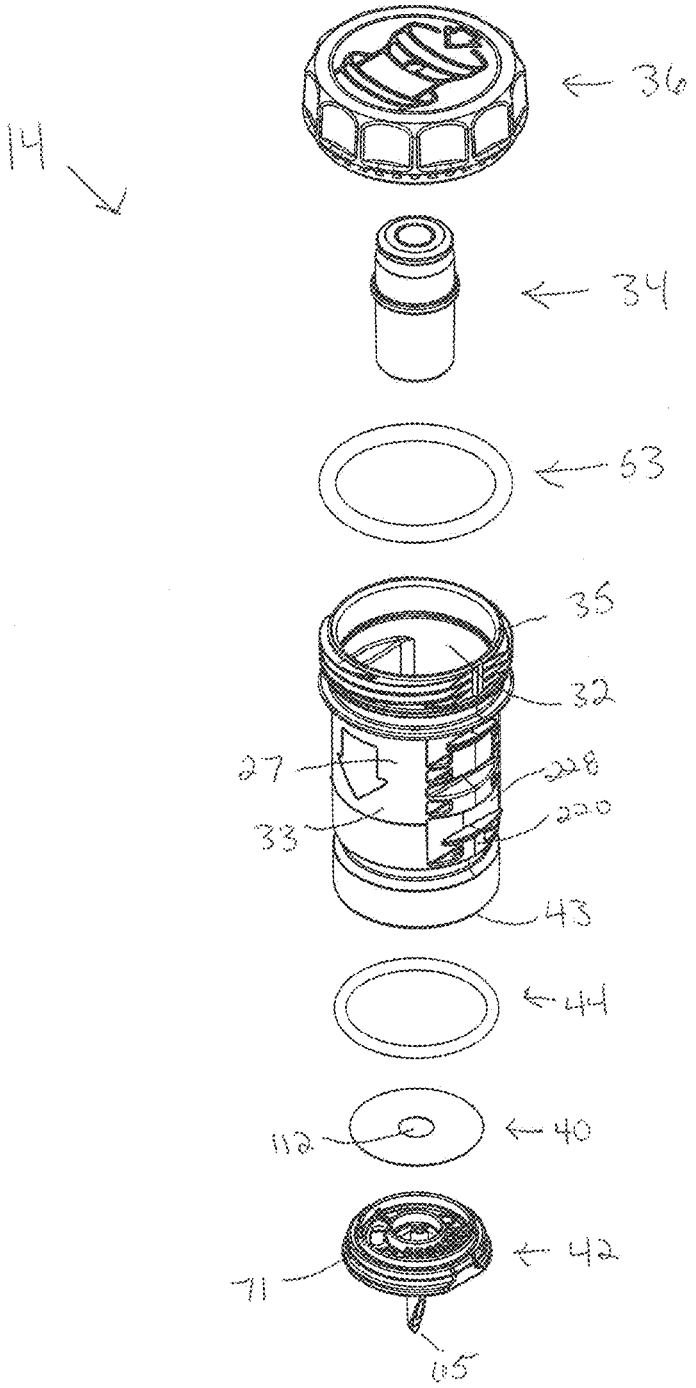
FIG. 8B is an exploded view of an activation housing assembly according to the embodiment of FIG. 8.

A circumferential annular groove 218 is formed in the exterior surface 33 of activation housing 30 between the upper and lower rims 35, 43. In one embodiment the groove 218 is spaced or offset above or below the cross member 29 (FIG. 8A). In another embodiment the groove 218 is adjacent to the cross member 29 or even integrally formed with the cross member 29. In the embodiment shown in FIG. 10-10A, the groove 218 is formed between the floor 47 and at least a portion of the ceiling 49 defined by the cross member 29 (not shown) or the bulkhead 29A. An annular, radial seal 44, such as an elastomeric O-ring or the like, is slid over the upper or lower portion of the activation housing 30 and into the groove 218 to allow the activation housing 30 and the main body assembly 20 to move smoothly and in a controlled, concentric manner vertically relative to each other yet maintain a hermetic seal to keep the contents inside the system 10. Thus, the activation housing 30 is configured to be slidingly received and telescopically mated with the top portion of the main body assembly 20, more particularly the main body 52.

The top of the activation housing 30 can provide different mating attachment features and sealing features that interface with the top cap 36. In one embodiment, the interior diameter 32 adjacent the top brim 35 of the activation housing 30 has or provides a smooth annular sealing surface. In another embodiment (not shown), at least one anchoring means such as a thread, lug, rib or the like is formed on the interior surface adjacent the top brim of the activation housing. In another embodiment such as illustrated in FIGS.

8 and 8A, the exterior diameter adjacent the top brim of the activation housing has at least one anchoring means, such as a thread, lug, rib or the like, formed thereon. Adjacent the lower end of the thread an annular groove 135 is formed in the outer diameter 33 of the activation housing 30.

An initial snap-locking means is provided proximal or above the O-ring groove 218 on the activation housing 30. Lower tabs and upper tabs extend from the activation housing 30 on opposite sides. The lower tabs are manufacturing snaps 220 and have a base portion 222 that is attached to the wall of the activation housing 30 and extends radially outwardly therefrom. These manufacturing snaps 220 create an audible click sound when installed into the main body assembly 20. A finger portion 224 that is joined to the base portion 222 and extends parallel to the central axis 13 of the activation housing 30. A ramped or outwardly beveled tip 226 is provided at the outer edge of the terminal end of the finger portion 224. Radially inward of the finger portions 224 of the tabs 220 clearance flats 228 are provided in the outer diameter 33 of the activation housing 30 such that gaps 230 are formed between the flats 228 and the finger portions 224. These gaps 230 allow space for the finger portions 224 of the tabs 220 to deflect radially inwardly and insure that the tabs 220 are resiliently deflectable when necessary. The gaps 230 are also sized, shaped and adapted to retentively receive mating features of the product integrity ring 31 as described below.

A similar structure of activation snaps 232 is provided as upper tabs 232, which are spaced proximally or above the lower tabs 220. When activating the device, these snaps create an audible click sound to confirm complete activation. This structure provides a one-way snap-locking mechanism so that the activation housing 30 cannot be withdrawn, removed, or disassembled from the main body 52 once it has been inserted.

Figure 16:
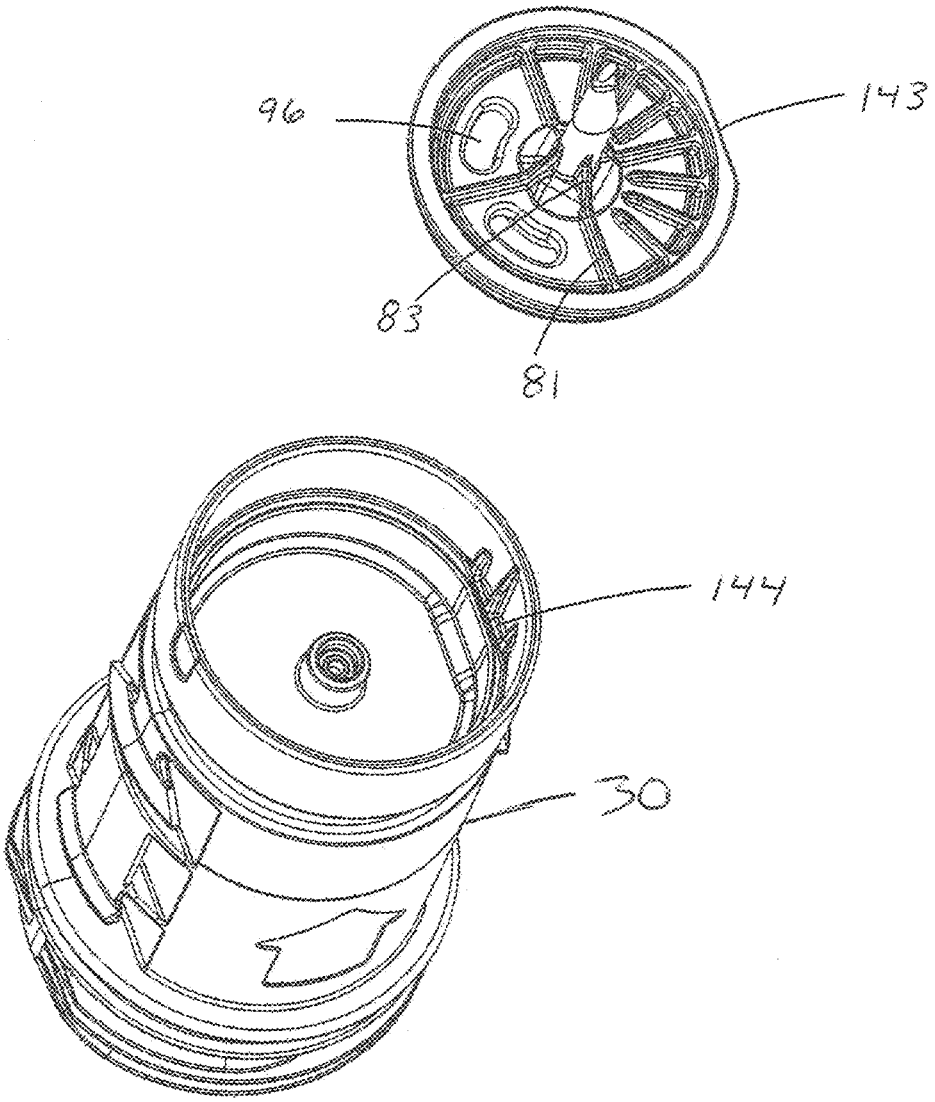
FIG. 16 is an exploded view of one embodiment of the vial activation housing and vial access member assembly.

In one embodiment as shown in FIG. 16, a key, notch, groove or keyway 144 is formed in the interior surface 32 of the activation housing 30. The structure 144 extends axially and helps align or orient the asymmetrical vial access member 42 for proper foolproof assembly into the activation housing 30 during assembly. In an alternative embodiment, the alignment or orientation can be provided by an axially extending key 146 protruding from the outer surface 33 of the activation housing 30.

In one embodiment, the activation housing 30 is formed of a substantially rigid, shatter-resistant, clear, opaque, or transparent polycarbonate or other thermoplastic material that is compatible with and can easily be attached to the vial access member 42.

Valve

The valve 34 can be selected from among many needle-free or needleless, normally closed check valves available for medical applications, such as the low or high pressure Borla B-SITE® available from Borla; the NUITIV® valve available from ICU Medical; or the CLAVE®, CHEMO-CLAVE®, CHEMOLOCK®, or other valves from ICU Medical, or the like. So that any one of the above-mentioned valves can be utilized, an optional adapter 46 (not shown) having a central fluid passageway 48 and a proximal end 50 defining a tapered female luer opening 132 can be provided to permanently attach the valve 34 to the activation housing 30 by adhesive or solvent bonding, ultrasonic or heat welding, or other suitable methods.

The normally closed needleless valve 34 has a normally sealed proximal end 50 that could include a female luer connector, male luer connector or other sealed connecting means and is mounted within the activation housing 30. In one embodiment, the needleless valve or connector 34 is permanently attached to the interior wall 32 of the activation housing 30 by a frictional fit or welding with solvent, heat or ultrasonic equipment. In another embodiment, the adapter 46 (not shown) can be similarly attached to the activation housing 30 and then the valve 34 is attached to the adapter 46.

Top Cap

In one embodiment, a top cap 36 has fastening means 37 such as a bore or boss with threads, lugs, ribs or the like on its lower surface 134 for removably attaching the cap 36 to mating fastening means 39 such threads, lugs, ribs or the like on the proximal end 50 of the normally closed needleless valve 34. In another embodiment the top cap 36 has threads 37 formed thereon for matingly engaging corresponding threads 39A on the inner or outer diameter 32, 33 of the activation housing 30. The top cap 36 maintains sterility of the valve 34 until removal. With respect to the threaded top cap 36 and activation housing 30 connection there can be multiple ways of maintaining and ensuring sterility. In one embodiment a seal 53 is operatively interposed between the top cap 36 and one of the normally closed needleless valve 34 or the activation housing 30. In one embodiment (not shown) the seal 53 is a continuous annular rib 136 that extends radially outward from an annular boss 138 that extends vertically downward from the inner or lower surface 134 of the top cap 36. The rib 136 sealingly engages with the inside diameter, inner surface, or interior surface 32 of the upper portion of the activation housing 30. In another embodiment, the seal 53 is a sealing ring or flexible rib 53 that curves radially inwardly and is located at the top of a bore 55 in the top cap 36. This arrangement can be easily molded in a plastic top cap 36 and is commonly referred to as a crab claw seal. In another embodiment, a seal 53 including a compressible sealing liner ring or disk can be mounted within a bore 55 formed in the top cap 36 or a sealing member such as metal or plastic foil can be adhered, crimped or bonded to the upper rim 35 of the activation housing 30. In another embodiment the top cap 36 can be a flip top cap. The flip top cap 36 has at least one seal 53 defined by a continuous annular sterility bead or rib, more preferably for redundant sealing purposes a plurality or at least two axially spaced apart beads or ribs 53A, 53B, extending around the periphery of a reduced diameter lower portion 57 that is adapted to tightly mount into the upper inside diameter 32 of the activation housing 30 to seal the same. The reduced diameter lower portion 57 of the top cap 36 terminates at its distal or lower end with a lead-in chamfer 59 to assist in guiding the top cap 36 inside the upper rim 35 and into the activation housing 30. The top cap 36 includes an enlarged diameter flange 61 adjacent the lower portion 57. Once the top cap 36 is mounted within the activation housing 30, the flange 61 provides an overhanging ledge for a user to push or pull on in a radially inward and/or upward direction to pop the top cap 36 off. In one embodiment shown in FIG. 8, the top cap 36 with threads on the inner diameter is screwed to mating threads on the outer surface of the activation housing 30. An annular groove is also provided in the outer surface of the activation housing 30. A seal 53, such as an O-ring, is mounted in the groove and creates a hermetic seal.

The top cap 36 is preferably injection molded of a high-density polyethylene (HDPE) opaque material but could be machined or made of other materials without significantly detracting from the invention.

Filter

Filter 40 is thin multi-layered disk constructed of an oleophobic and hydrophobic polytetrafluoroethylene (PTFE) membrane material available from Hangzhou Cobetter Filtration Equipment Co., Ltd. in Xiaoshan, Hangzhou, China. The top layer is an air permeable fibrous material and the bottom layer is a porous polypropylene film. The filter 40 can have a variety of shapes without detracting from the invention. For example, in one embodiment, the filter 40 is D-shaped in a horizontal cross-section due to a truncated portion 111 of the outer diameter that provides proper location and alignment of a hole 112 through the filter 40. In another embodiment, the filter 40 is substantially oval and includes a pair of opposite truncated portions 111 for location, hole alignment and fit within the assembly. In another embodiment, as shown in FIG. 8D, the filter 40 is cylindrical or "donut-shaped" with a cylindrical hole 112 in the center. In one embodiment, the filter 40 is mounted on the underside of the cross member 29 of the activation housing 30. In another embodiment, the filter 40 is mounted on the underside of the bulkhead member 29A of the activation housing assembly 28. In another embodiment, the filter 40 is mounted on the top surface of the vial access member 42 described below. The filter 40 can be mounted to these components or surfaces by heat sealing, gluing, ultrasonically welding or other known methods without detracting from the invention.

Vial Access Member

In one embodiment, the vial access member 42 is formed of a substantially rigid, shatter-resistant, clear, opaque, or transparent polycarbonate or other thermoplastic material that is compatible with and can easily be attached to the activation housing 30, which is made of a similar material.

Figure 1A:
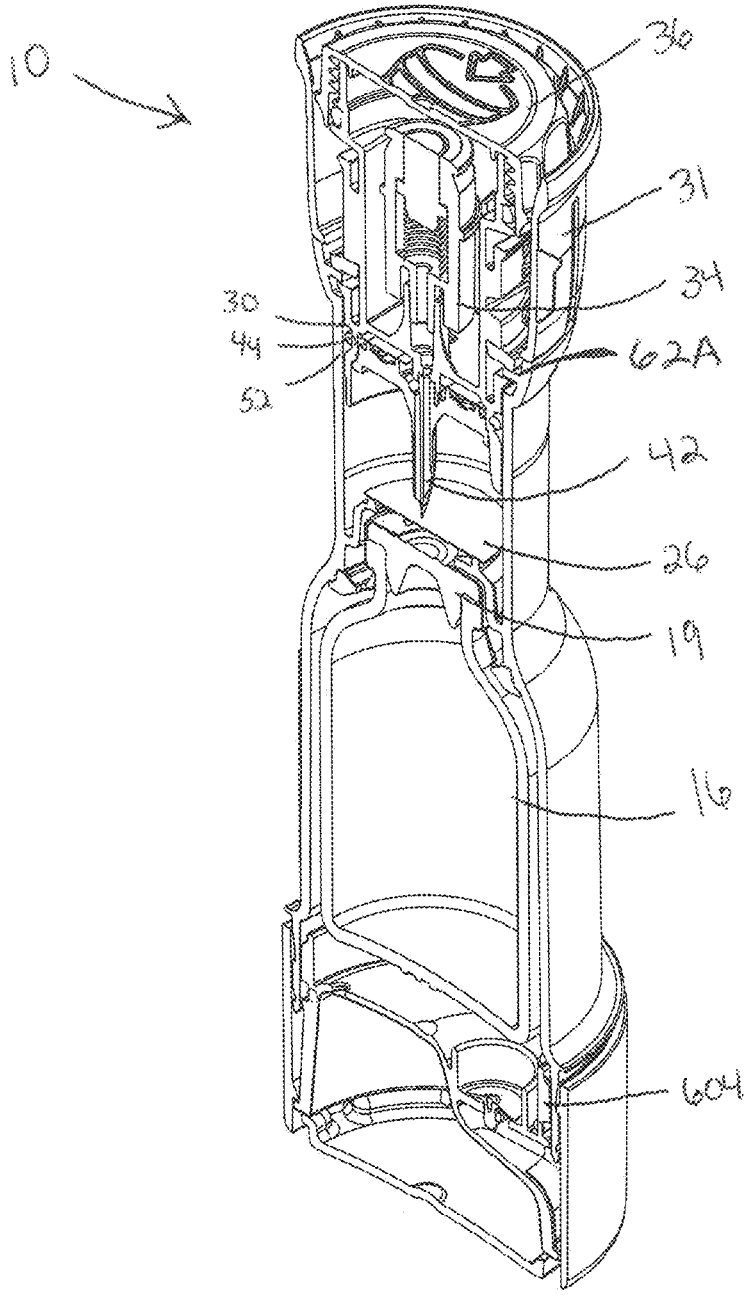
FIG. 1A is a cross-sectioned perspective view of a safety vial system according to the embodiment of FIG. 1.
Figure 1B:
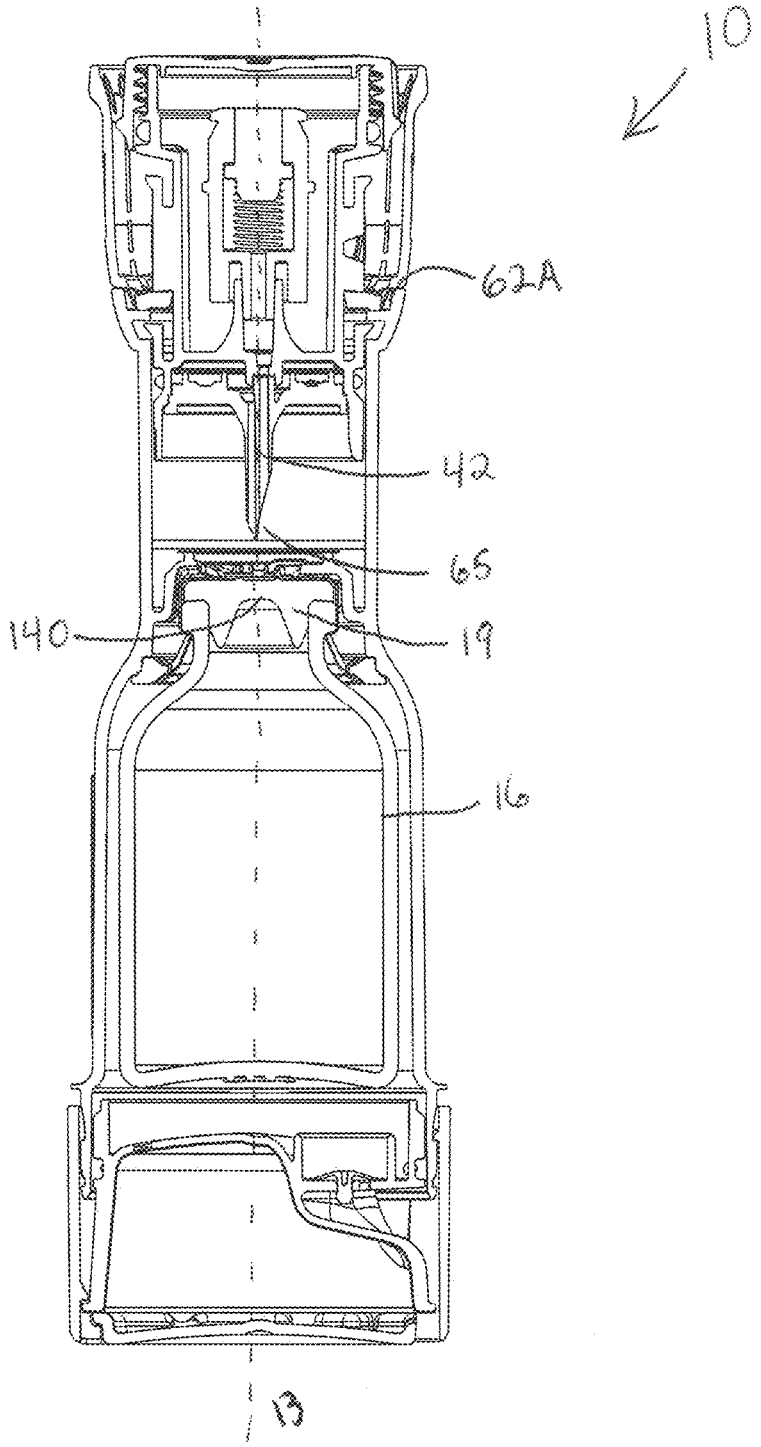
FIG. 1B is a cross-sectional view of a safety vial system according to the embodiment of FIG. 1 in a pre-activation state.
Figure 1C:
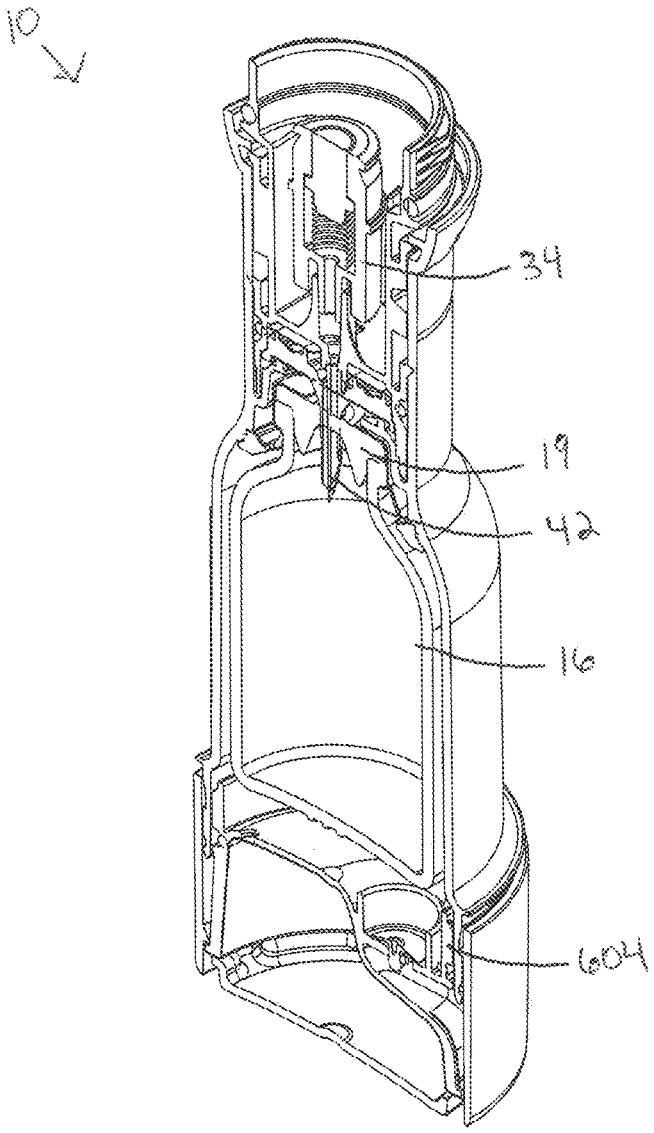
FIG. 1C is a cross-sectioned perspective view of a safety vial system according to the embodiment of FIG. 1, with the top cap removed and the system in an activated state.
Figure 1D:
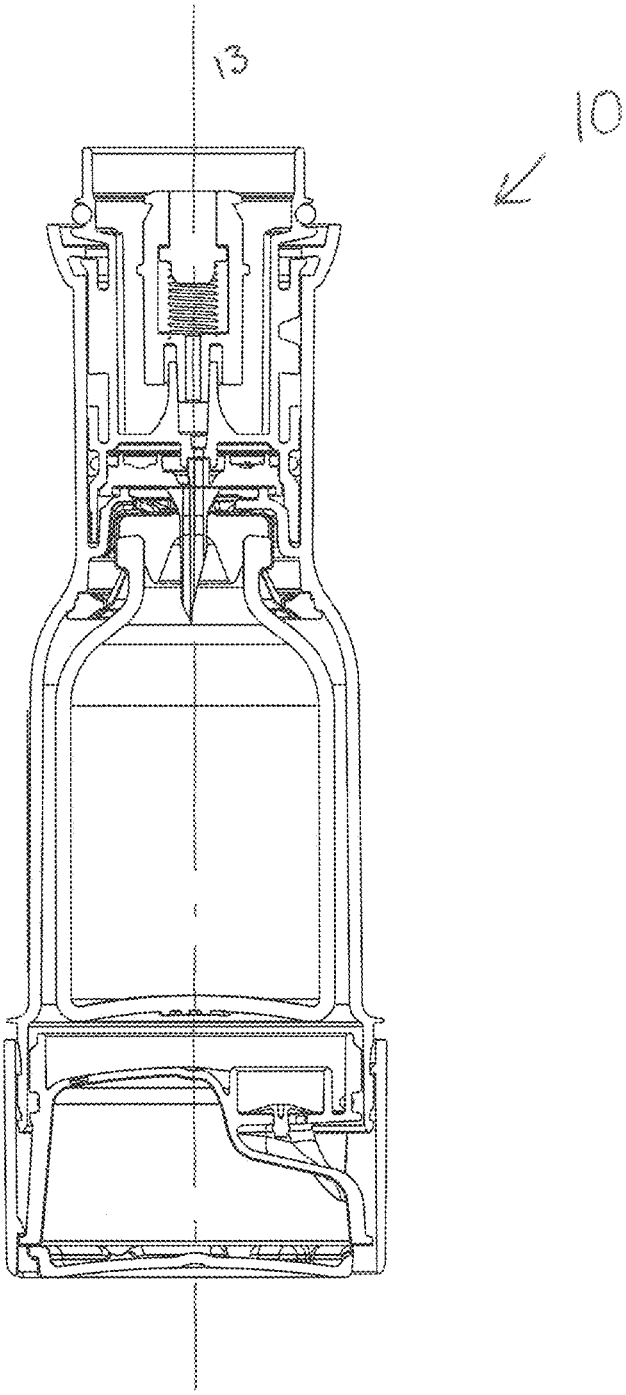
FIG. 1D is a cross-sectional view of a safety vial system according to the embodiment of FIG. 1, with the top cap removed and the system in an activated state.

FIG. 1B illustrates that the vial access member 42 includes a centrally located dual lumen spike. The access member 42 has distal end 65 that is pointed or spiked to pierce through the diaphragm or septum 140 of the vial stopper 19 to access the contents of the vial 16. FIG. 8A illustrates that the vial access member 42 has a proximal end 67 that is adapted to sealingly receive the mating surface on the activation housing or an optional adapter 46 (not shown) interposed therebetween. The vial access member 42 has a central body 69 with a mounting flange 71 attached thereto and extending radially outwardly therefrom. The central body 69 has a central longitudinal axis 73 and a first lumen 75 offset radially from the central longitudinal axis 73 of the central body 69 and a second lumen 77 offset radially from the first lumen 75 and the central longitudinal axis 73 of the central body 69. The first lumen 75 extends from the proximal end 67 to a distal end 65 to define a liquid fluid flow path for drug or diluent and the second lumen 77 defines a fluid flow path for air, gas, and/or liquid-gas mixtures. As such, the second lumen 77 is smaller in size or diameter than the first lumen 75 in one embodiment. The second lumen 77 also terminates or exits at the top of the mounting flange 71. The first lumen 75 provides the main intended flow path for liquid drug or diluent, or reconstituted drug and diluent in the case of a lyophilized drug. The second lumen 77 allows for pressure neutralization by allowing air to pass either way, into or out of the vial 16, as needed to maintain a neutral pressure overall in the system. The top portion 79 of the central body 69 that surrounds the drug lumen 75 is eccentric with the central longitudinal axis 73 of the vial access member 42 and is therefore offset with respect to the central longitudinal axis 13 of the activation housing 30. As illustrated in FIGS. 8, 8A, 9, 9A, 10, and 10A, an adapter 46 (not shown), cross member 29, bulkhead member 29A or other structure within the activation housing 30 is useful to bring the flow path back to the central longitudinal axis 13 of the activation housing 30 and concentric with the valve member 34. In one embodiment, the mounting flange 71 is a circular disk. The distal end 65 or tip of the central body 69 that extends below the mounting flange 71 is substantially oval in lateral cross-section. The air lumen 77 extends to the tip 65 and is longer than the drug lumen 75 in its extension below the mounting flange portion 71. This is to allow the air lumen 77 to enter the vial 16 first to relieve any pressure when the spike 42 punctures the diaphragm or septum 140 of the vial stopper 19. A web of material 142 exists between the offset lumens 75, 77, as can be seen in FIG. 8. In one embodiment as shown in FIG. 16, reinforcing and vertical travel limiting radial ribs 81 are formed on the bottom of the mounting flange 71. A gusset 83 formed between the bottom of the mounting flange 71 and one of the radial ribs 81 provides a radial alignment and positioning feature to aid in assembly, even from the outside during assembly if the parts are clear plastic. The gusset 83 also assists in making an imperfect, non-sealing puncture of the spike 42 through the barrier film or foil seal 26 so that air can flow for pressure neutralization during the initial phase of activation. In another embodiment, a plurality of spaced apart gussets 83 can be provided. A key, notch or keyway 143 can be provided in another embodiment shown in FIG. 16. The structure 143 aligns with a corresponding key or rib, keyway or notch 144 in the activation housing 30 to provide foolproof guidance and radial alignment in the assembly process.

Figure 8C:
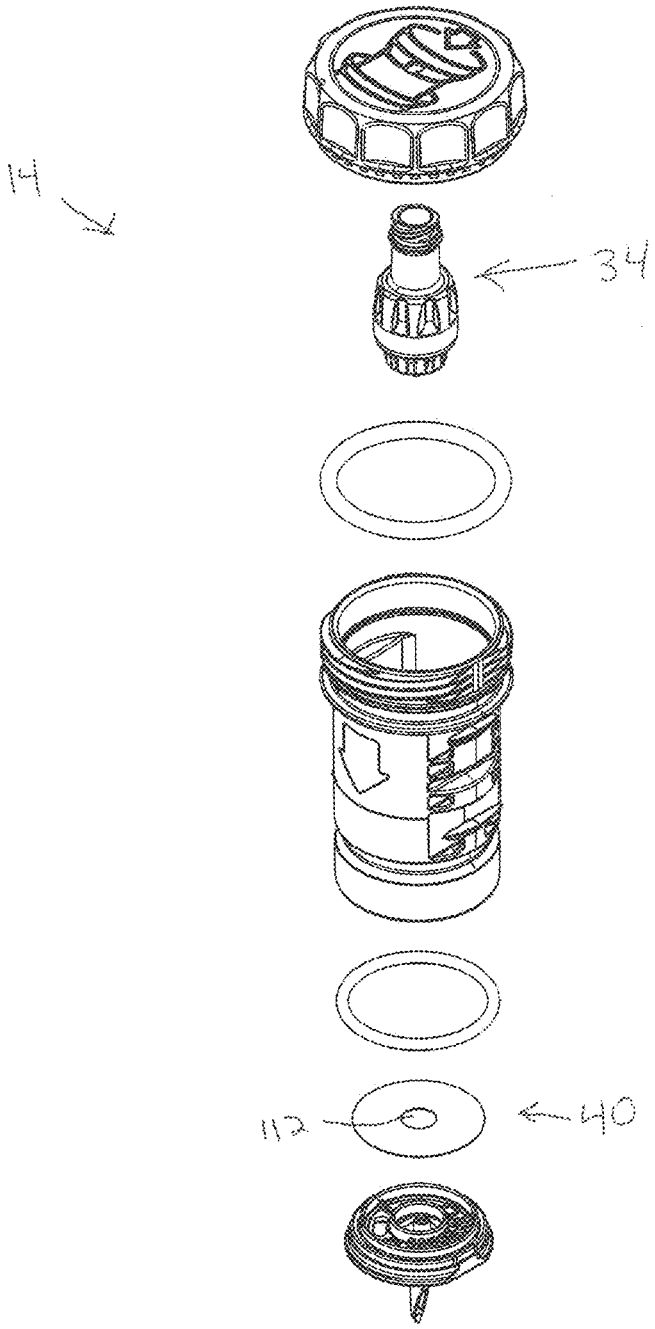
FIG. 8C is an exploded view of an activation housing assembly according to another embodiment of the invention utilizing a different needleless valve.

In one embodiment the upper surface of the mounting flange 71 of the vial access member 42 includes some important functional features. A central bore 85 is formed in the top surface of the mounting flange 71 of the vial access member 42. The central bore 85 is offset from the drug lumen projection 79 and in fluid communication with the drug lumen 75. An inner raised cylindrical ring 87 extends upwardly surrounding the central bore 85 from the top surface and an outer raised cylindrical ring 89 is spaced concentrically from the inner ring 87. Preferably the rings 87, 89 are substantially the same height and together define two annular rims that provide surfaces to support and seal against a filter 40. A pair of optional intermediate concentric rings 91, 93 (not shown) that are shorter in height than the inner and outer rings 87, 89 but the same height as each other extend upwardly from the top surface of the mounting flange 71 between the inner and outer rings 87, 89 and could provide an optional mounting and sealing surface for an optional second filter 40B (not shown), which is annular. In one embodiment an oleophobic first filter 40A in the shape of a circular disk would be mounted on the inner and outer rings 87, 89, while a hydrophobic second filter 40B that is annular would be mounted on the lower set of rings 91, 93. In one embodiment the hydrophobic and oleophobic functions of the main filter 40 described above could be parsed and allocated to the individual first and second filters 40A, 40B described here in any other combination of the locations described above. The outer diameter 94 of the mounting flange 71 of the vial access member 42 is adapted to fit within the bore or interior surface 32 of the activation housing 30, engage the shoulder 68 and is sealed by ultrasonic welding or the like to the activation housing 30. As best seen in FIGS. 8C, 8D, and 16, a plurality of air flow passages 96 are provided through the mounting flange 71 of the vial access member 42, preferably between the inner and outer rings 87, 89, and more preferably between the optional lower rings 91, 93 if they are present. The air flow passages 96 are in communication with the air lumen 77, the filter 40 and the bellows chamber 608 described below. They allow two-way communication of air and the filter 40 provides a barrier so that liquid diluent and medication does not go anywhere but into or out of the vial 16 through the drug lumen 75.

Figure 10:
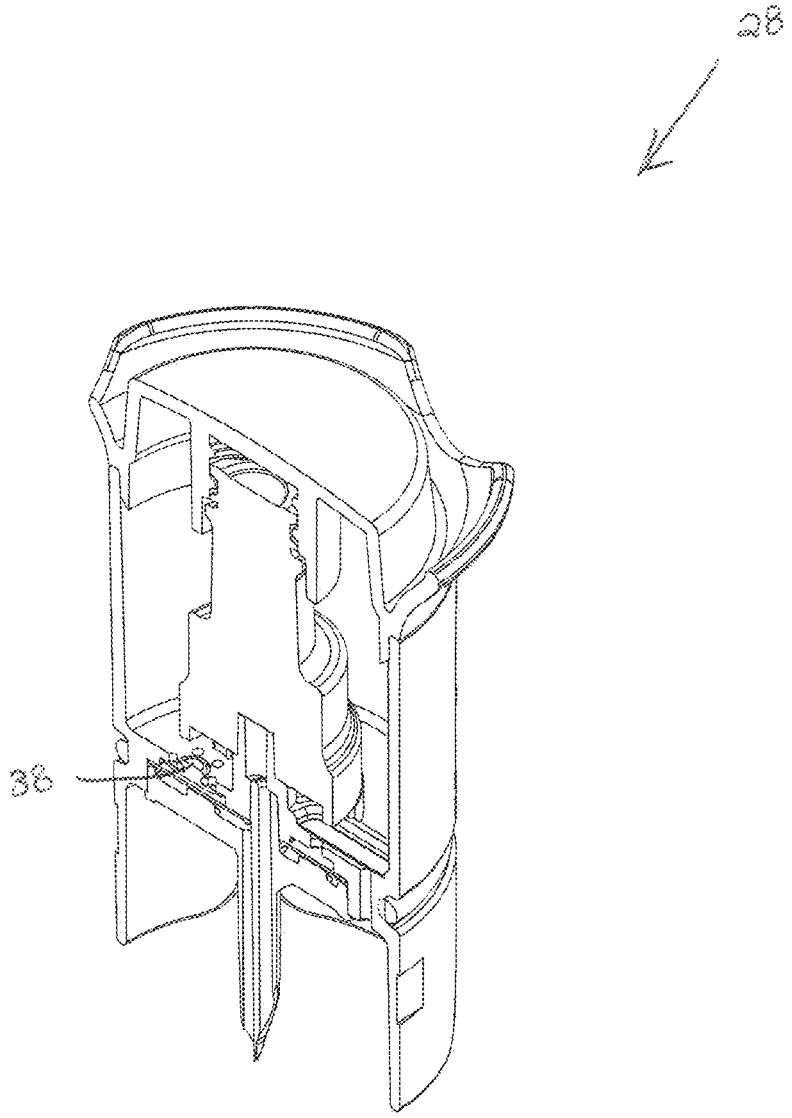
FIG. 10 is a cross-sectioned perspective view of an activation housing assembly showing another embodiment of the activation housing assembly with different top cap attachment according to the invention.
Figure 10A:
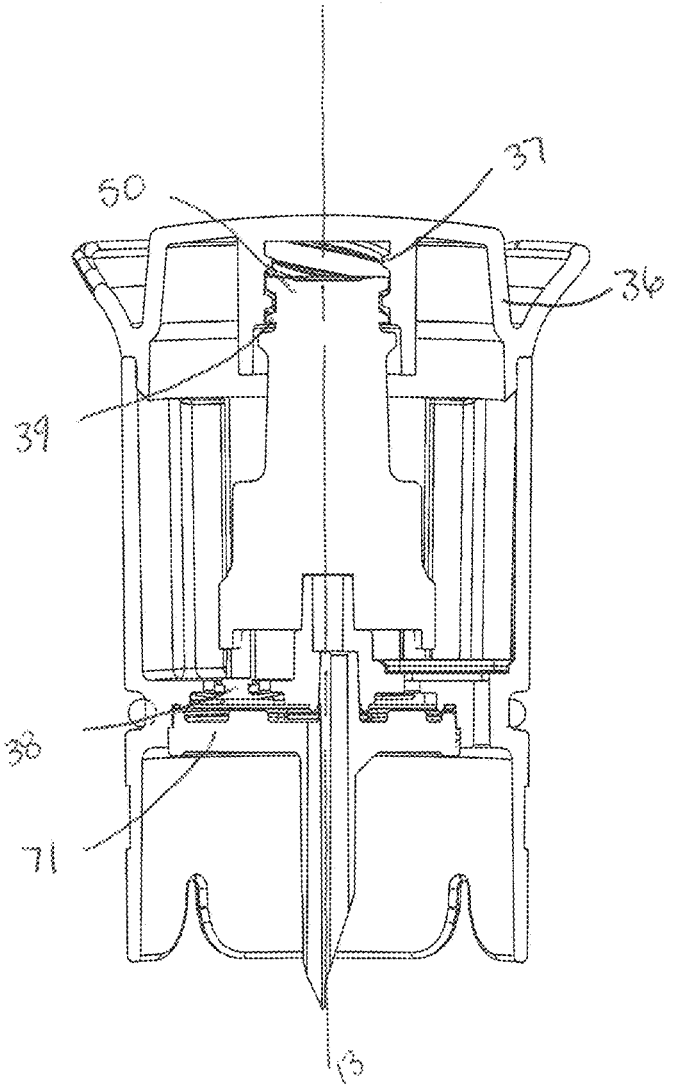
FIG. 10A is a cross-sectional view of portions of an activation housing assembly according to the embodiment of FIG. 10.
Figure 10B:
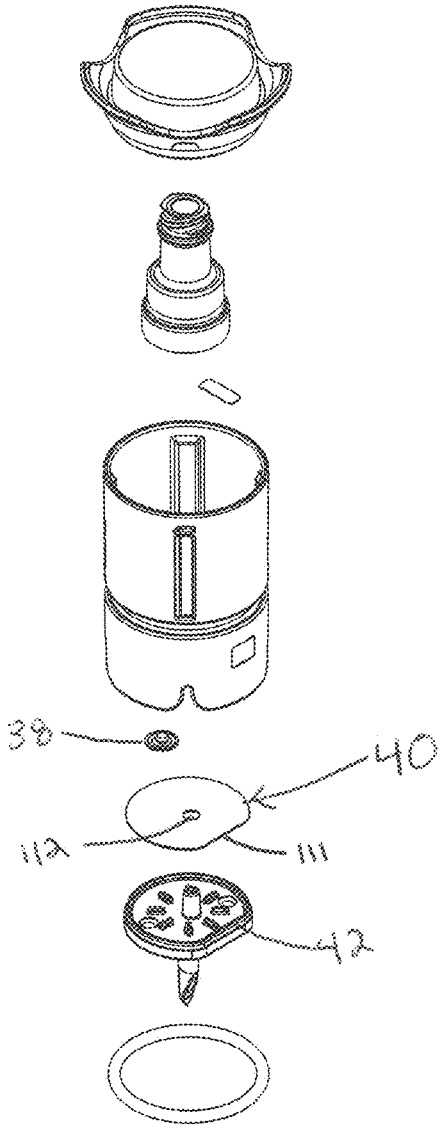
FIG. 10B is an exploded view of portions of the activation housing assembly according to the embodiment of FIG. 10.

If needed, as illustrated in FIGS. 10, 10A and 10B, a check valve 38 can be mounted in the mounting flange 71 to allow ambient air to enter the system to assist in maintaining a neutral pressure environment inside the vial system 10. In an alternative embodiment described below, a check valve 38 can be mounted in the bellows base 604 of the vial base subsystem 12 instead of or in addition to the check valve 38 mounted in the mounting flange 71 of the vial access member 42.

Seal

In one embodiment, the seal 44 is an elastomeric O-ring and is an installed in the annular groove 218 in the exterior surface 33 of the activation housing 30. The O-ring 44 is sized, shaped, and of a selected durometer between 15-70 ShoreA to create an effective hermetic but moving or dynamic seal between the activation housing 30 and the upper portion of the main body 52. See FIGS. 1A-1D. Rubber, silicone or other conventional materials are suitable for the seal 44.

Main Body Assembly

Figure 12:
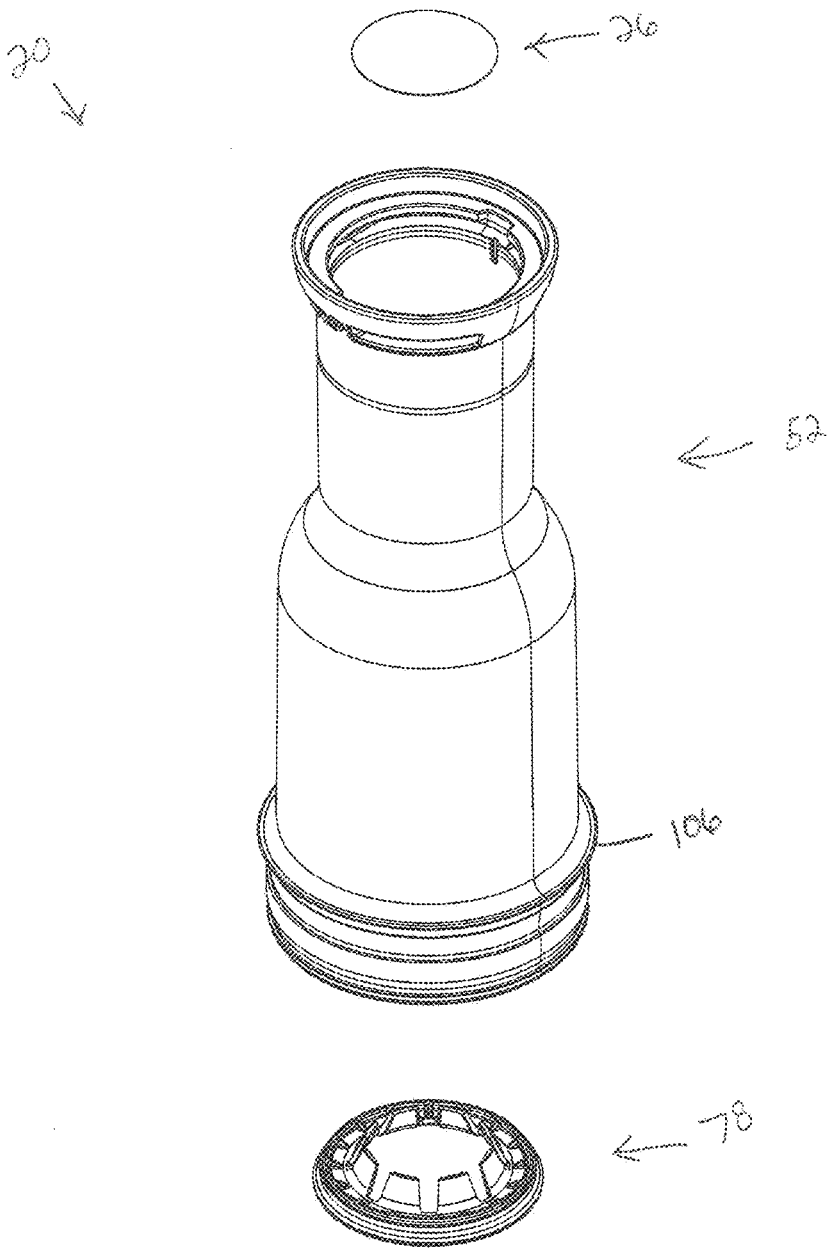
FIG. 12 is an exploded view showing the main body assembly according to one embodiment of the invention with the vial retention ring of FIG. 11B.
Figure 12A:
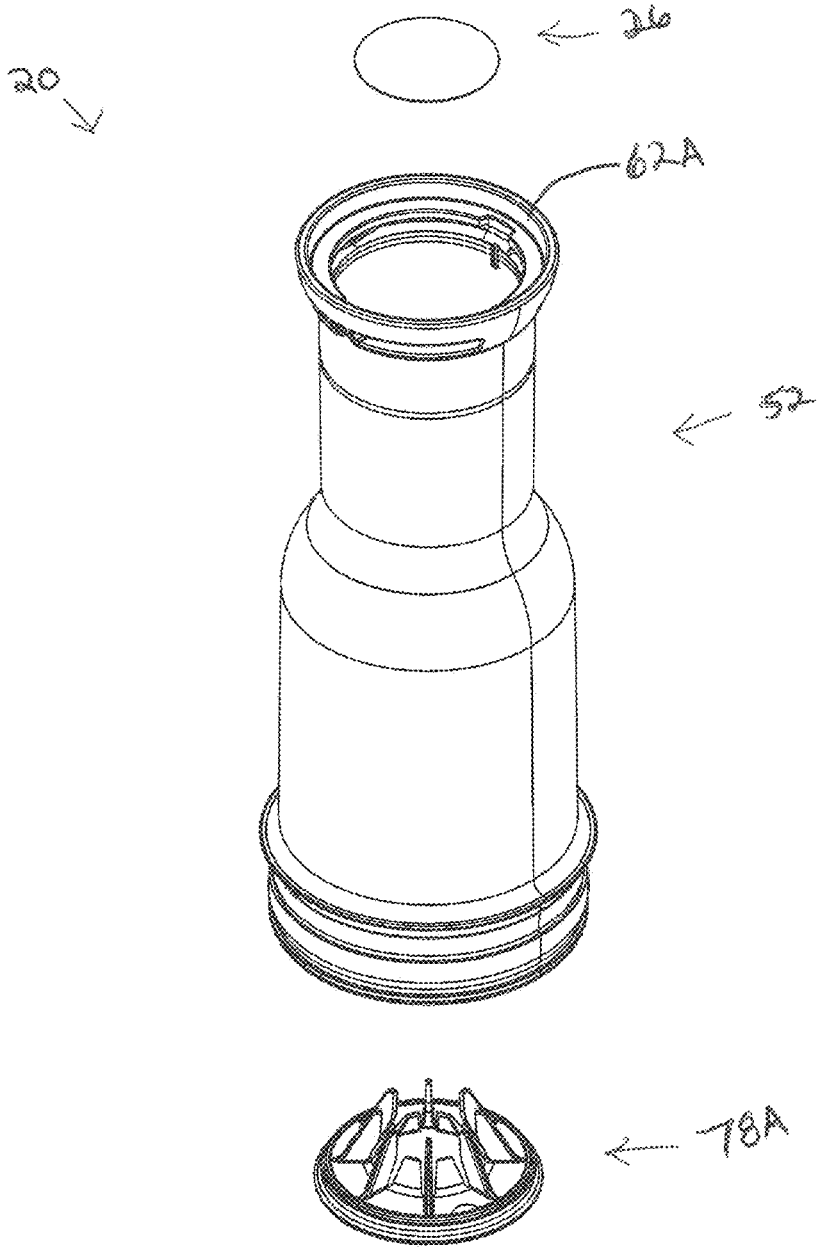
FIG. 12A is an exploded view showing the main body assembly according to another embodiment of the invention with the vial retention ring of FIG. 11.
Figure 12B:
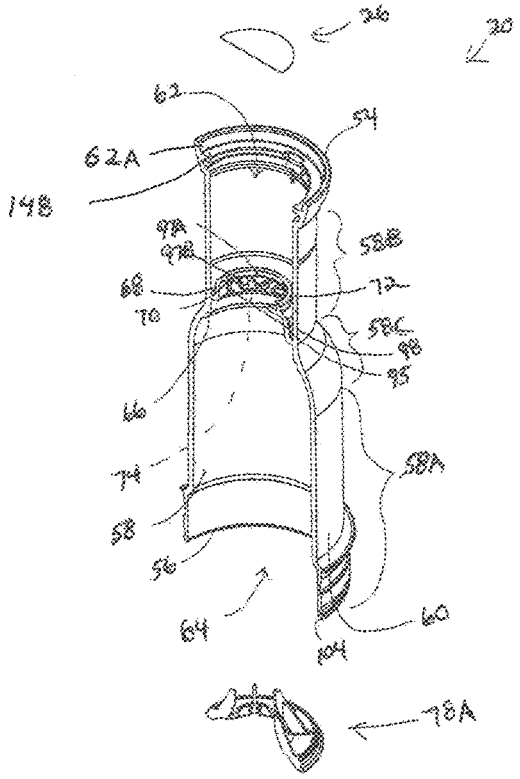
FIG. 12B is a cross-sectioned perspective view showing the main body assembly according to the embodiment of FIG. 12A with the vial retention ring of FIG. 11.
Figure 12C:
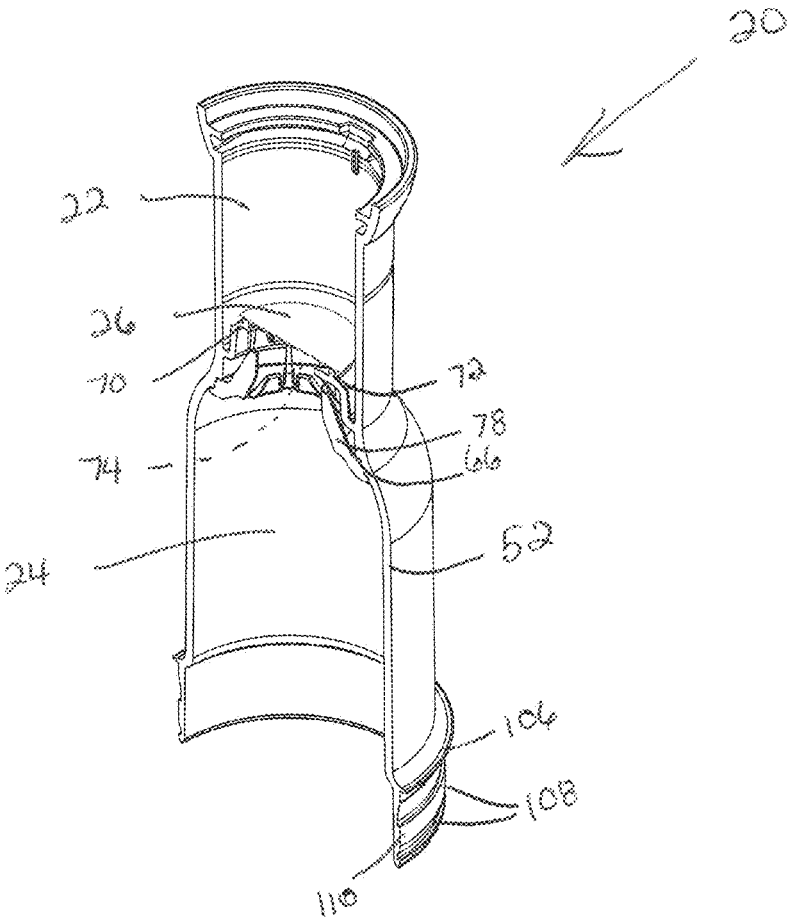
FIG. 12C is a cross-sectioned perspective view showing a main body assembly assembled according to the one embodiment.

As best seen in FIGS. 1-6, the vial adapter subsystem 14 includes a main body assembly 20 that is generally tubular, for example cylindrical, but can be any other shape needed to extend around, receive or accommodate the vial 16. As best seen in FIGS. 12C and 13A, the main body assembly 20 defines an upper chamber 22 and a lower chamber 24, which are separated by a barrier film 26 that is disposed between the two chambers 22, 24. In one embodiment, the barrier film 26 is a foil seal. The main body assembly 20 includes in one embodiment a hollow tubular main body 52, which is generally cylindrical although other shapes would be adaptable to the invention.

Main Body

In one embodiment, the main body 52 is formed of a substantially rigid, shatter-resistant, clear or transparent copolyester, polycarbonate, or other thermoplastic material so that the vial 16 and drug product 18 inside, as well as assembly, mixing and accessing activities related thereto can be visually observed by humans or automated inspection equipment. However, in other embodiments the material of the main body 52 or portions thereof could be semi-transparent, translucent, textured, or opaque and even colored to indicate a specific type of drug product 18 or class of drug being in the drug vial 16. The material or color of the components could also assist in proper identification and grouping of parts for the assembly process. Such material characteristics would also be useful with respect to other components of the system 10, such as the vial retention ring 78, 78A, the activation housing 30, top cap 36, and bottom cap 602 by way of example and not limitation. As seen in FIG. 12B, the main body 52 has an upper end 54, a lower end 56, an inner surface 58 or diameter, and an outer surface 60 or diameter. A top opening 62 and a bottom opening 64 are formed in the main body 52 at the upper and lower ends 54, 56 respectively.

The inner surface or diameter 58 has an enlarged lower portion 58A adjacent the lower end 56. The inner surface or diameter 58 has a shoulder 66 formed thereon projecting radially inward at the top of the enlarged portion 58A. The inner surface or diameter 58 has a narrowed or reduced diameter upper portion 58B adjacent the upper end 54. The inner surface 58 also has a midsection 58C disposed between the lower portion 58A and the upper portion 58B. The inner surface or diameter 58 in the upper portion 58B has a second shoulder 68 formed thereon projecting radially inward. A seal holder 70, which in one embodiment is a circular disk with an optional raised annular guide or mounting ring 72 and at least one hole 74 formed through the seal holder 70, is passed through the top opening 62 and attached to the shoulder 68 by heat sealing, ultrasonic welding, adhesive, or other suitable methods. In one embodiment, there is at least one hole 74 is centrally located; and in another embodiment, it is a single centrally located circular hole. In another embodiment, the seal holder 70 and hole 74 are integrally formed as a single unit molded together with the main body 52. In that embodiment, raised annular guide or mounting ring 72 can be omitted and a singular but more complex hole or central opening 74 can be provided through the seal holder 70. As best understood in view of FIG. 12B, the central opening 74 includes around its periphery a plurality of spaced apart centering, stabilizing and retaining ribs 95 that extend radially inward and downward for engaging the top of the vial stopper cover or hold down ring 21. The profile of hole 74 or the seal holder 70 can be equipped with six spaced apart, downwardly projecting fingers or teeth 97B, three triangular blocking teeth 97A to prevent the vial 16 from being pushed through barrier film 26, and three blocking teeth that have shortened or truncated free ends with respect to the other teeth 97A so as to allow more air flow through around area of the vial stopper 19.

A plurality of substantially vertical ribs 98 in the inner diameter 58C of the main body 52 just above the shoulder 66 is adapted to engage with a corresponding plurality of vertically extending grooves 100 in the inside diameter or interior surface 32 of the activation housing 30 to prevent relative rotation after activation. In another embodiment, the grooves 100 of the activation housing could be replaced with a plurality of ribs 100A extending radially inward on the inner diameter to accomplish the same anti-rotation function against ribs 98 or even one or more grooves 98A in the main body 52.

Figure 18:
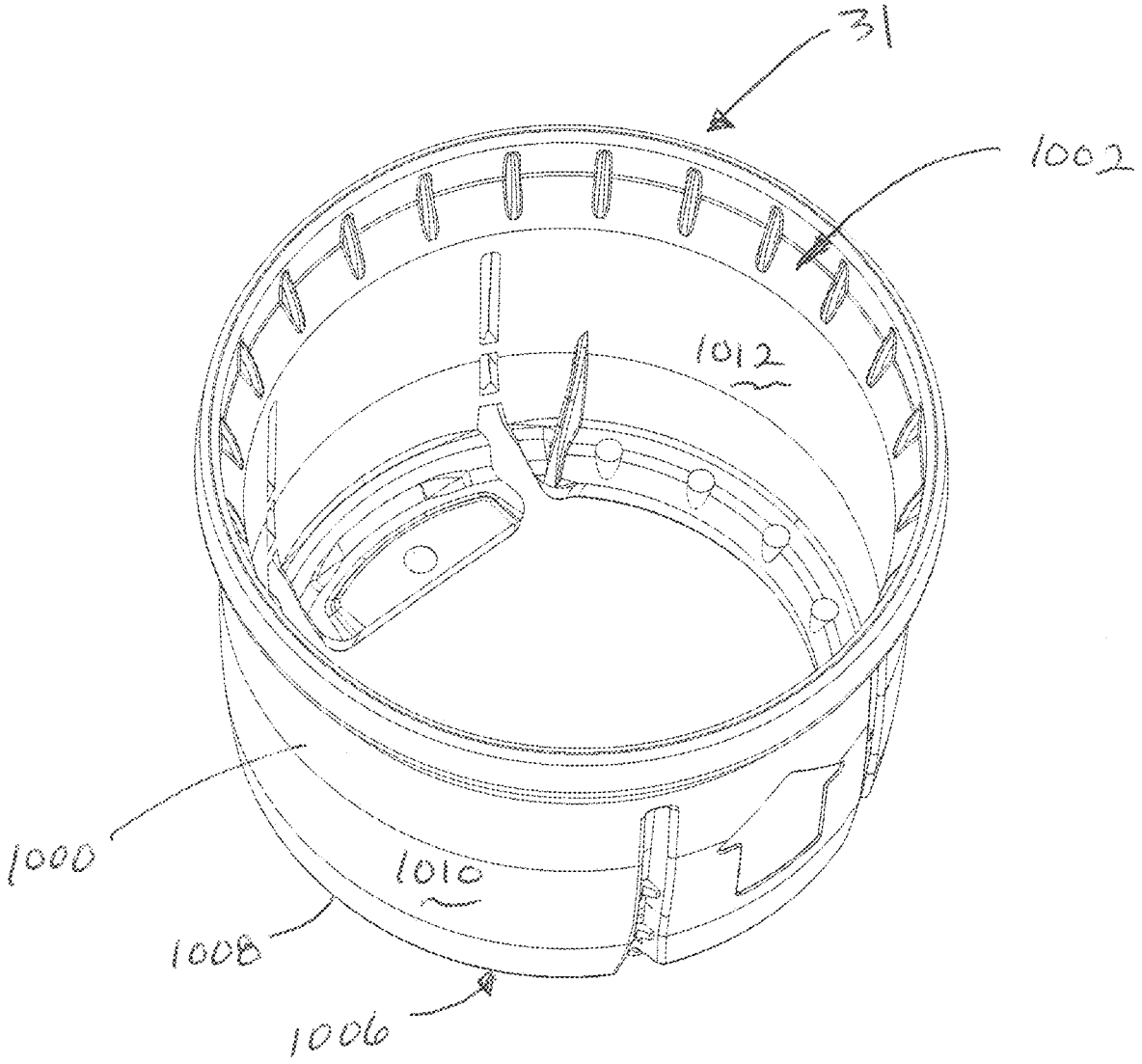
FIG. 18 is an enlarged top perspective view of a product integrity ring according to one embodiment of the invention.
Figure 18A:
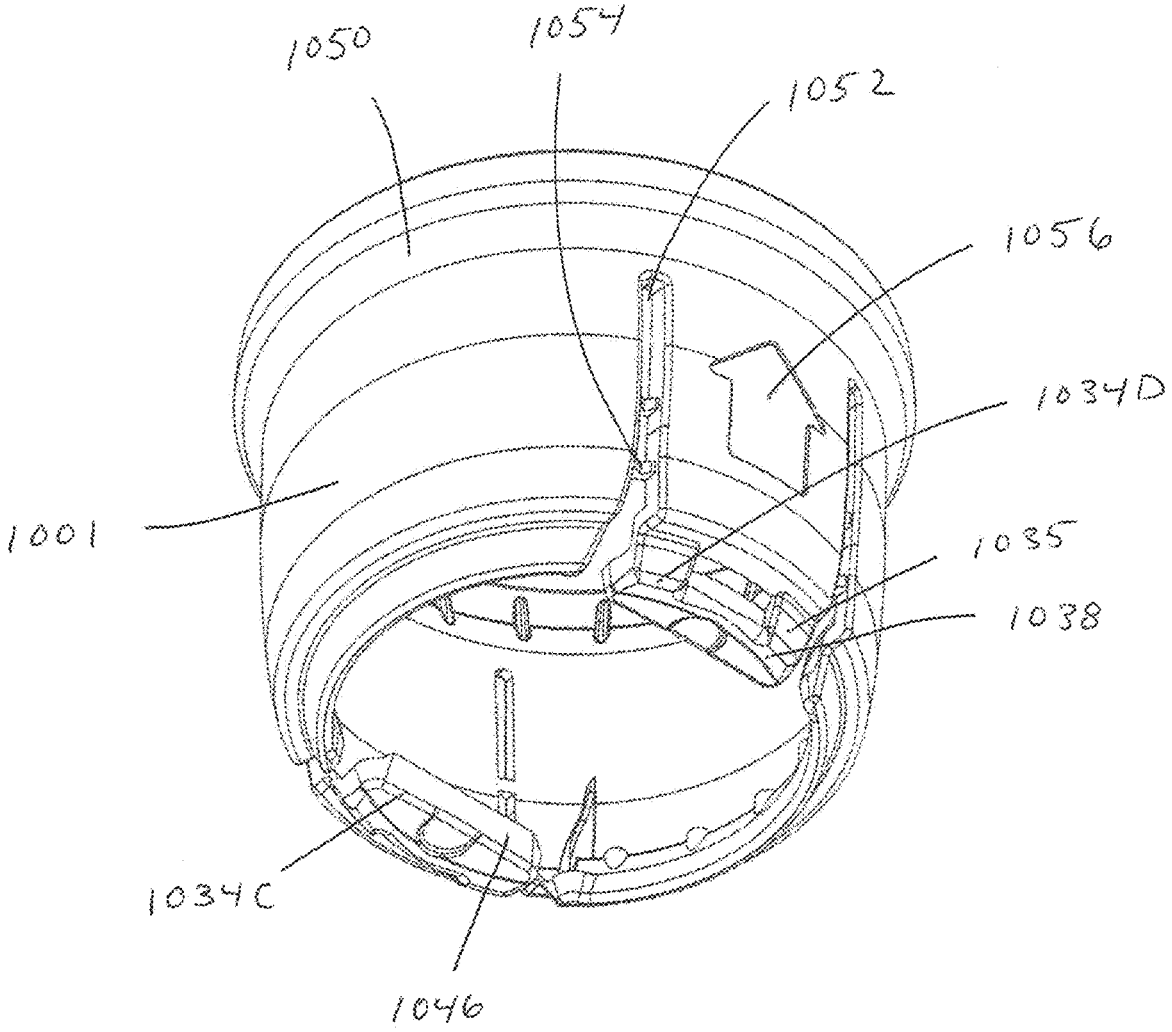
FIG. 18A is an enlarged bottom perspective view of a product integrity ring according to the embodiment of FIG. 18.

As best seen in FIGS. 1A, 1B and 12B, a couple of features near the top opening 62 of the main body 52 bear description in greater detail. Adjacent the top end 54 is the conical shaped opening 62A for receiving a foot portion 1038 and/or leg portion 1036 of the product integrity ring 31 as described below and seen in FIG. 18A. The conical opening 62A guides and centers the PIR 31 within the top opening 62 of the main body 52. The conical shaped opening 62A has a substantially horizontal annular shoulder 148 formed at its bottom. The shoulder 148 provides a surface for stopping or limiting the downward axial travel of the PIR 31.

Figure 13:
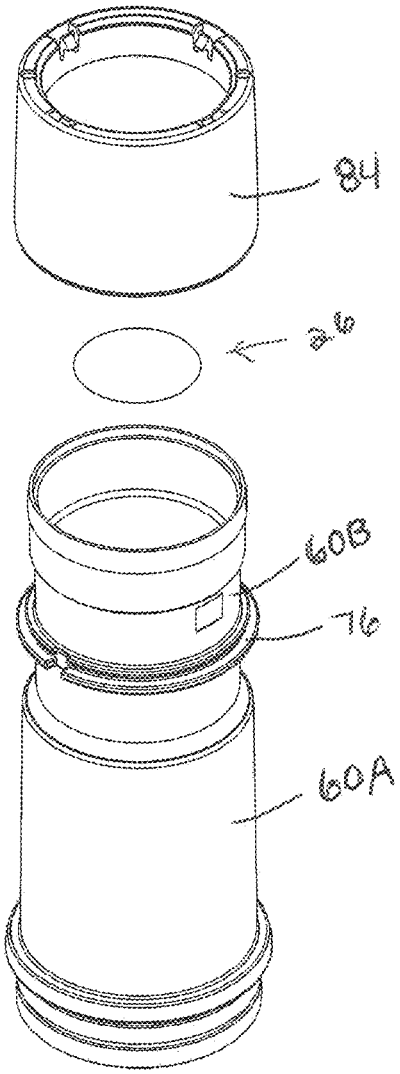
FIG. 13 is an exploded view showing the main body assembly according to another embodiment of the invention.
Figure 13A:
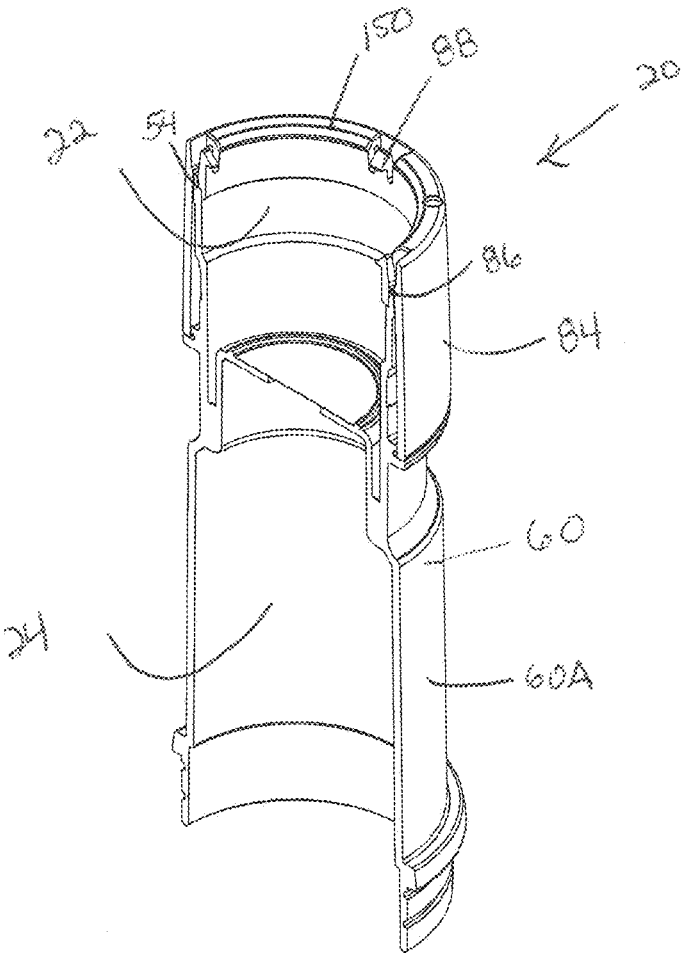
FIG. 13A is a cross-sectioned perspective view showing a main body assembly according to the embodiment of the FIG. 13.

As best seen in FIGS. 13 and 13A, the outer surface 60 also has an enlarged portion 60A at the bottom end and a narrowed or reduced diameter portion 60B at the upper end. An optional upper brim 76 can be provided on the outer surface 60 of the main body 52 adjacent the seal holder 70 and an optional hollow tubular sleeve collar 84 is concentrically mounted to the reduced diameter portion 58B of the main body 52. The sleeve collar 84 has an annular shoulder 86 projecting radially inward at the top. The annular shoulder 86 and the upper end 54 of the main body 52 are ultrasonically welded or permanently attached in a hermetically sealed manner. On the upper end 150 of the sleeve collar 84 a plurality of circumferentially spaced retention snaps 88 extend radially inward and downward. As best seen in FIG. 7C, the snaps 88 are constructed and arranged to retentively mate with a plurality of circumferentially spaced grooves 90 that extend vertically along the outer diameter of the activation housing 30, spaced above or proximally spaced from the circumferential O-ring groove 218 and distally spaced from the upper rim 35. The grooves 90 have a series of vertically spaced substantially horizontal stop bridges or position control surfaces 92, which when engaged by the snaps 88 prevent the activation housing assembly 30 from being withdrawn upwardly or backwards after partial or full activation. In another embodiment as shown in FIG. 10B, only two vertically spaced stop bridges 92 are needed—one for use during assembly of the device in manufacturing and another for completed activation by the user. In yet another embodiment, three vertically spaced stop bridges 92 are provided—one for use during assembly of the device in manufacturing, one at a midpoint of activation (just prior to breakthrough puncturing of the vial stopper 19), and one for completed activation.

In another embodiment, the functions of the sleeve collar 84 are integrated into at least one of the main body 52 and the activation housing 30, or both.

The bottom portion of the main body 52 at the lower end 56 has an inside diameter 58A around the opening 64 that receives and sealingly contacts the O-ring 101 and other portions of the vial base subassembly or subsystem 12 as discussed below. A chamfered lead in portion 104 is provided at the opening 64 to facilitate insertion of the vial base subassembly or subsystem 12 into the bottom portion 58A of the main body 52.

An annular push/stop ring 106 protrudes radially outward from the outer diameter 60 of the main body 52. In one embodiment the ring 106 is preferably on the enlarged lower portion 60A of the main body 52. The ring 106 has opposing upper and lower surfaces 107, 109 that are preferably substantially horizontal. The upper surface 107 is preferably substantially flat and thus provides a good location for applying a straight downward force for moving the vial base subsystem 12 from the first position to the second position. The lower surface is also substantially flat and thus provides a stop for limiting the upward travel of the vial base subassembly or subsystem 12 substantially beyond the second position. Alternatively, the ring 106 may be held stable while the vial base subsystem 12 has a force applied to it to push it upwardly to move from the first position to the second position. In another embodiment, the top cap 36 or other surface at or near the top of the device may be used similarly to the annular ring 106. It may serve as a stop resisting an upward force or a pushing surface for application of a downward force.

A plurality of vertically or axially spaced circumferential grooves 108 are formed in the outer diameter 60A below the ring 106, or in other words between the ring 106 and the lower end 56 of the main body 52. In one embodiment there are two grooves 108 and an intervening rib 110 is defined between the two grooves 108.

Barrier Film

As best seen in FIGS. 12B and 12C, a barrier film or foil seal 26 is mounted to the seal holder 70 on or inwardly adjacent to the mounting ring 72 to extend over or operatively cover the at least one hole 74. The barrier film 26 can be attached by adhesive, heat sealing, ultrasonic welding, or other suitable methods. The barrier film 26 can be any fluid impermeable material such as plastic, metal or a layered composite suitable for medical grade applications and capable of withstanding gamma, heat, or vapor sterilization. The barrier film 26 divides the assembly into separated or isolated zones and therefore allows for dual sterilization methods to be utilized during the assembly and manufacture of the device.

Vial Retention Ring

A vial retention ring 78, which in one embodiment shown in FIGS. 11, 11A, 11B, and 1A such as for vials 16 with a 13 mm or 20 mm outside diameter top opening, has an annular rim 80 and a plurality of circumferentially spaced J-shaped clips 82 extending inwardly and upwardly from the annular rim 80, is passed through the bottom opening 64 and attached or secured to the shoulder 66 by heat welding, ultrasonic welding or other suitable methods. The J-shaped clips 82 are arranged to deflect both axially upward and radially outward when the vial 16 is forced proximally or upwardly into the main body assembly 20. As shown in FIG. 1B, the vial retention ring 78 engages the lower shoulder of the hold down ring 21 at the neck 15 of a vial 16 after the vial 16 is coupled with the main body assembly 20 and thus centers and captures the vial 16, preventing or at least limiting the vial 16 from moving axially downward with respect to the main body 52 once fully engaged.

Figure 11:
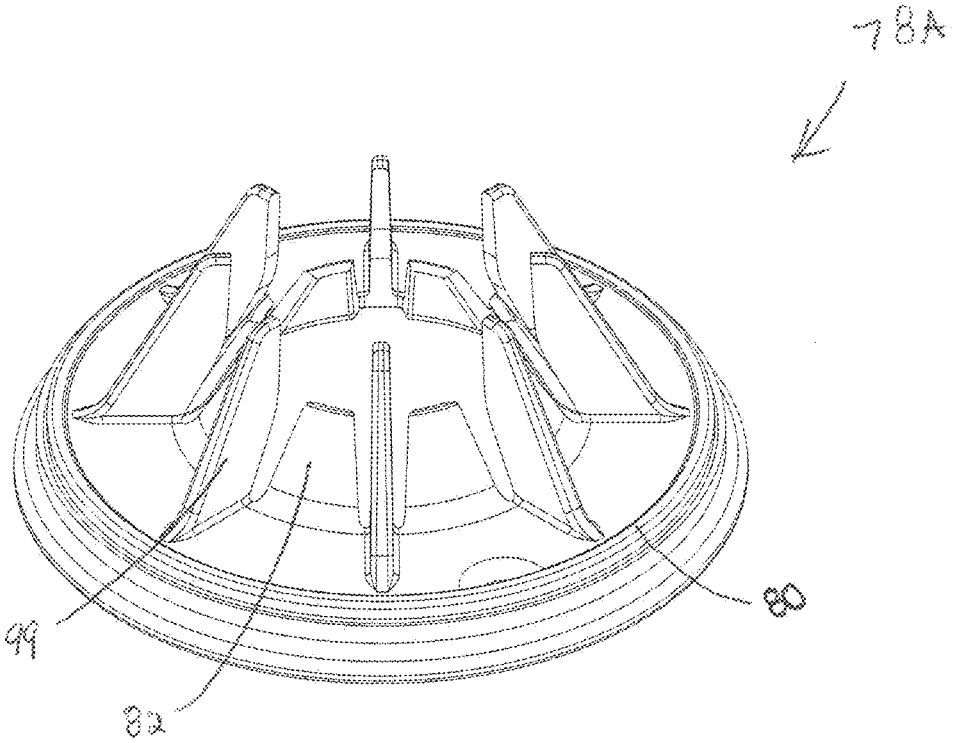
FIG. 11 is an enlarged top perspective view showing a vial retention ring of the safety vial system according to one embodiment of the invention.
Figure 11A:
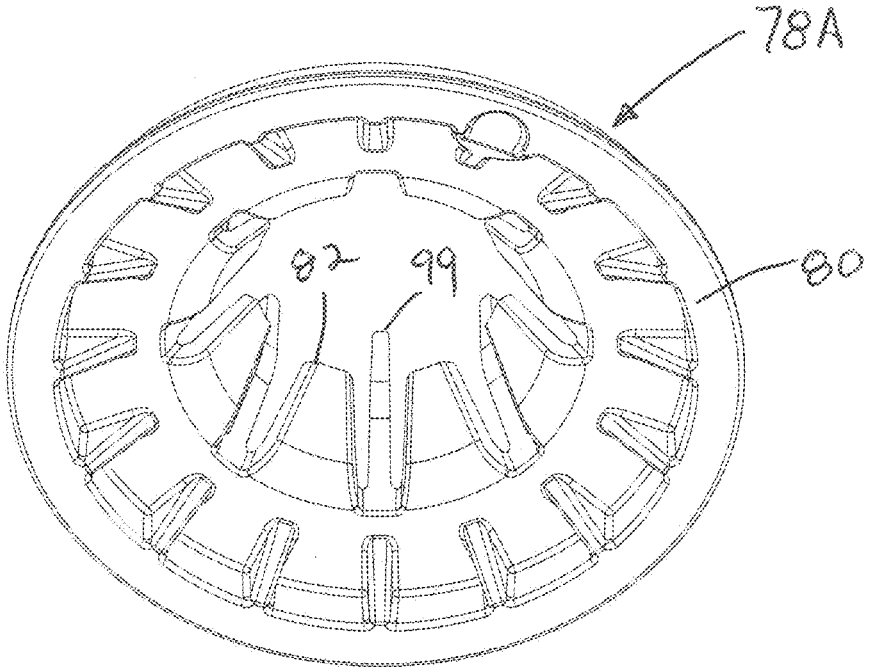
FIG. 11A is an enlarged bottom perspective view showing a vial retention ring of the safety vial system according to the embodiment of FIG. 11.
Figure 11B:
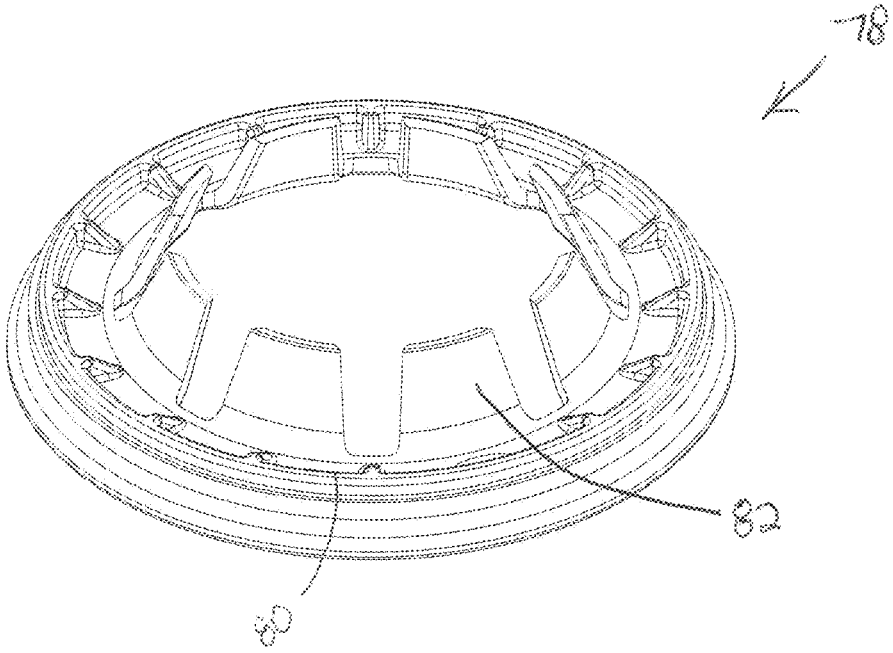
FIG. 11B is an enlarged top perspective view showing a vial retention ring of the safety vial system for a different size vial according to another embodiment of the invention.

In another embodiment, as best understood in view of FIGS. 11 and 11A, where the size differential between the diameter of the hold down ring 21 on the vial 16 and the midsection 58C of the main body is greater, the vial retention ring 78A is sized and shaped for smaller vial sizes and has a plurality of vertical supports 99, each attached to a base portion of the J-shaped clips and arranged between the J-shaped clips so that the vial 16 is concentrically stabilized with respect to the retaining ring and the main body. Thus, the vial 16 is suspended or retained in the main body assembly 20 of the safety vial system 10 while reducing the opportunity for the sides of the vial 16 to be contacted.

In one embodiment, the vial retention ring 78 is formed of a substantially rigid, shatter-resistant, clear or transparent co-polyester, polycarbonate, or other thermoplastic material so that it can easily be attached to the main body 52, which is made of a similar material. However, in other embodiments the material of the vial retention ring 78 or portions thereof could be semi-transparent, translucent, textured, or opaque and even colored to indicate a specific type of drug product 18 or class of drug being in the drug vial 16. The material or color of the components could also assist in proper identification and grouping of parts for the assembly process.

Product Integrity (Pull) Ring

A product integrity ring 31 can be provided to prevent premature activation of the device prior to use. The product integrity ring can also provide flexibility in manufacturing and assembly by allowing the device to be snapped together by pressing down on the upper surface of the top screw cap 36. The product integrity ring 31 interconnects the activation housing assembly 28 and the main body assembly 20 in such a manner that axial and radial relative movement between those two assemblies is limited or prevented. See FIGS. 18-19A and FIGS. 1-3, 6-7A.

In one embodiment, the product integrity ring 31 is a tubular element constructed of a linear low-density polyethylene material, which provides some flexibility and elastic deformability. However, other similar materials can used without detracting from the invention. The product integrity ring 31 has a tubular body 1000 with a top opening 1002 surrounded by an upper rim 1004 and a bottom opening 1006 surrounded by a lower rim 1008.

The tubular body has a midsection 1001 located between the upper and lower rims 1004, 1008. The tubular body 1000 has an outer surface 1010 and an inner surface 1012.

In one embodiment, a pair of generally opposing elongated grooves 1014A, 1014B is formed in the outer surface 1010 of the tubular body 1000 of the product integrity ring 31, extending horizontally in one embodiment. The grooves 1014A, 1014B define a pair of generally opposing pinch locations PL1, PL2 on the PIR 31. Approximately 90 degrees away from each of the grooves 1014A, 1014B or pinch locations PL1, PL2, flexing bowing portions 1016, 1018 of the product integrity ring 31 are formed. Channels 1017, 1019 are formed spaced apart circumferentially in the outer surface 1010 of the tubular body 1000 on both sides of the flexing bowing portion 1016 to increase the flexibility thereof. Similarly channels 1021, 1023 are formed spaced apart circumferentially in the outer surface 1010 of the tubular body 1000 on both sides of the flexing bowing portion 1018 to increase the flexibility thereof.

A pull ring portion 1020 of the product integrity ring 31 is formed adjacent the upper rim 1004, which defines its upper edge. The lower edge 1022 of the pull ring portion 1020 has a unique profile that helps it accomplish the many desired functions of the pull ring portion 1020. In one embodiment, an upwardly arched portion 1024 of the lower edge 1022 located above the flexing bowing portion 1016 defines a finger access opening 1025 configured to allow insertion of a user's finger or thumb. A smaller arcuate protrusion 1026 is centrally formed on the arched portion 1024 of the lower edge 1022 to allow easier, more secure gripping of pull ring portion 1020 with a gloved finger or thumb because users in the medical field usually wear gloves. In an alternative embodiment, a finger access opening can include a flexing tab underneath the arched portion 1024 to allow deeper access into the space behind the flexing tab.

A circumferential separation slot 1028 is formed below the pull ring portion 1020 and extends through the tubular body 1000 as further described below. The slot 1028 first extends horizontally circumferentially around the tubular body 1000 from the finger access opening 1025 above the flexing bowing portion 1016 toward and then adjacent to the rear flexing bowing portion 1018. At least one web of material 1030A bridges the slot on either side of the finger access opening 1025 to detachably join the pull ring portion 1020 at its lower edge 1027 with the rest of the tubular body 1000. Adjacent to the rear flexing bowing portion 1018, the separation slot 1028 curves downwardly and extends toward the bottom end or lower rim 1008 of the product integrity ring 31. As the separation slot 1028 extends downward, the perforations 1031 through the tubular body 1000 provide a tear away aspect of the PIR 31. A plurality of webs 1030B, 1030C detachably interconnects the pull ring portion 1020 to the midsection 1027 of the PIR 31 and the rear flexing bowing portion 1018. One of the plurality of webs 1030C is a retention web and is substantially thicker than the other webs, located adjacent the lower rim 1008 and on one side of the tab or flexing bowing portion 1016. The retention web 1030C is configured to be substantial enough or strong enough to remain intact so the pull ring portion 1020 remains joined or connected with the tubular body 1000 despite being peeled back by the user.

At the top of the rear flexing bowing portion 1018 and the pull ring portion 1020, a thinned section of material 1032 allows for greater flexibility and inversion of the pull ring portion 1020 at the rear flexing bowing portion 1018. It acts as a hinge or pivoting feature to allow the pull ring portion 1020 to be pulled into a vertical position with minimal force or effort.

Figure 19:
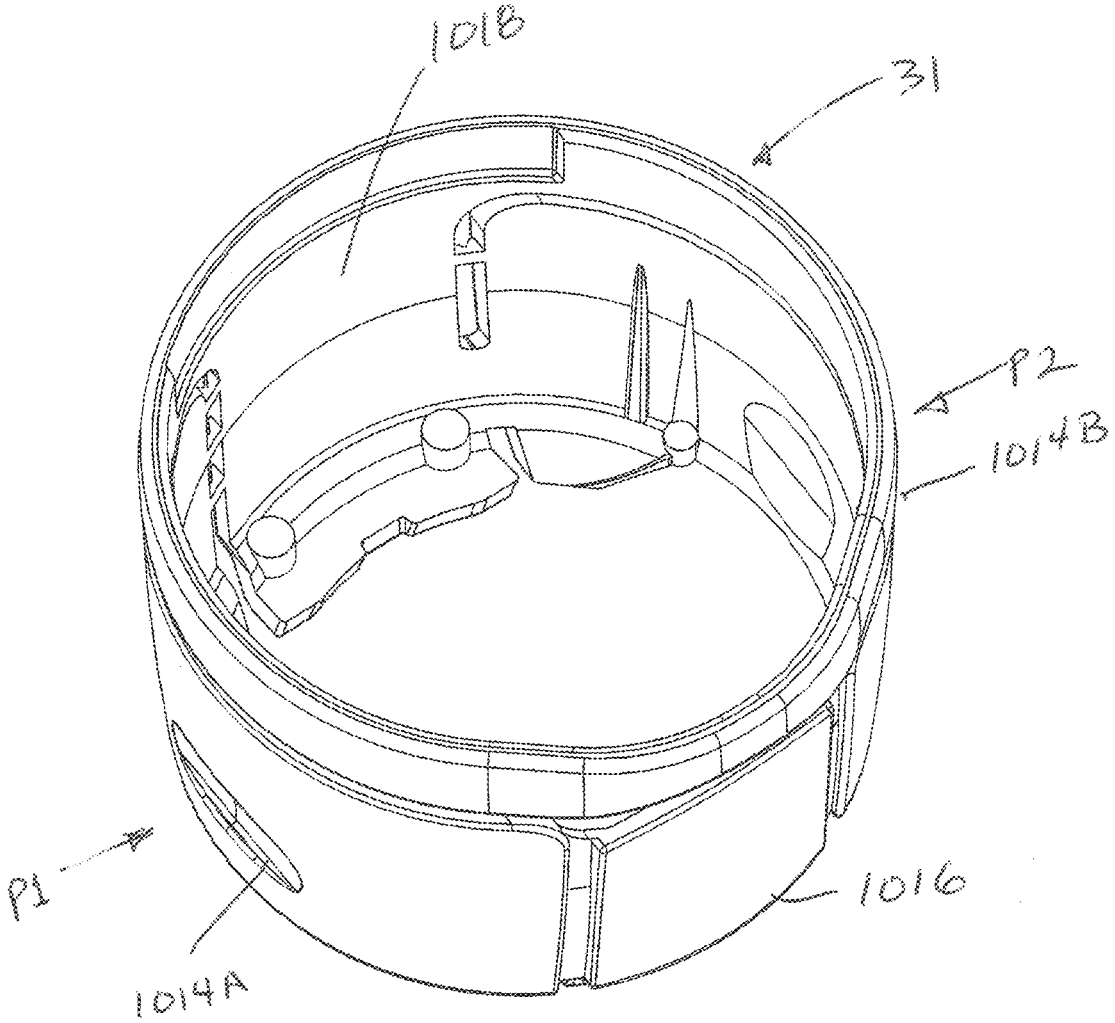
FIG. 19 is an enlarged top perspective view of a product integrity ring according to another embodiment of the invention.
Figure 19A:
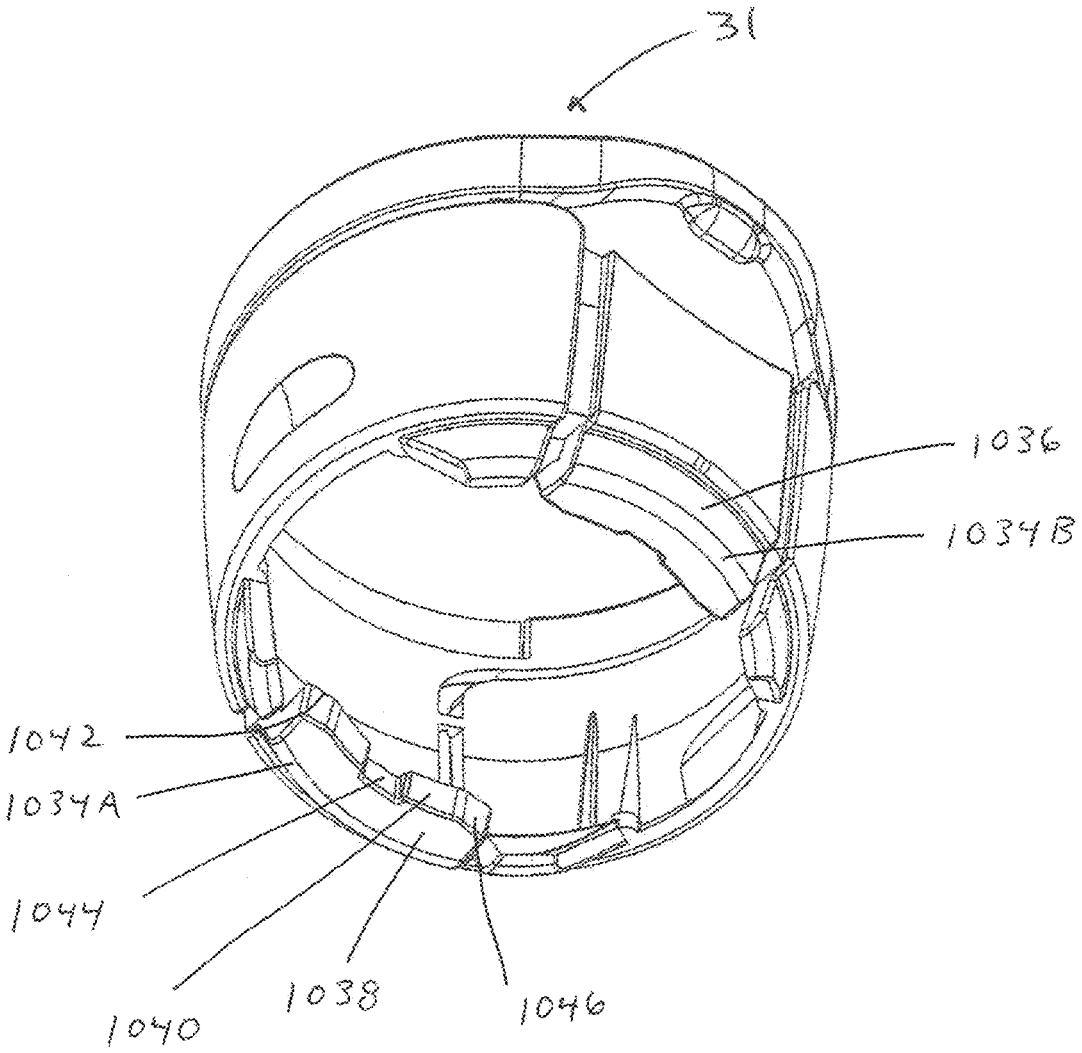
FIG. 19A is an enlarged bottom perspective view of a product integrity ring according to the embodiment of FIG. 19.

A pair of generally opposing tabs 1034A, 10346 extends radially inward from the rim 1008 of the bottom opening 1006 of the PIR 31 adjacent the bowing portions 1016, 1018. As best seen in FIG. 19A, each tab 1034A, 1034B has a specific geometry to assist with assembly, removal and prevention of activation. The tab 1034A, 10346 has a downwardly extending upright leg portion 1036 and a substantially horizontally extending foot portion 1038. The foot portion 1038, however, is angled slightly upwardly. In one embodiment the angle is approximately 5-15 degree, or more preferably about 10 degrees from horizontal. An angled lead surface 1040 is also provided on the inside of the upright leg portion 1036 to assist in future assembly with the main body assembly 20. Each tab 1034A, 10346 is connected to the inside of the tubular body 1000 and extends radially inward and has a terminal end or edge 1042 that generally arcuate so that the activation housing assembly 28 can be inserted into the product integrity pull ring or PIR 31 when sufficient force is applied at the pinch locations PL1, PL2 or grooves 1014A, 1014B.

In one embodiment, a gating opening or notch 1044 is formed in the central part of the arcuate edge 1042 of the tab 1034A, 10346 to prevent any excessive flash from the molding process from extending beyond the rest of the arcuate edge and interfering with the insertion of the activation housing assembly 28 into the PIR 31. The opposite ends of the arcuate edge 1042 have flat portions 1046 that mate with corresponding opposing flat surfaces 228 which define the undercuts or ledges on the activation housing 30.

In another embodiment, the product integrity ring 31 has undercut engaging features but instead of being rigidly attached to the rest of the PIR tubular body 1000, the undercut or ledge engaging features are provided in the form of two opposing tabs 1034C, 1034D that are connected to the PIR tubular body 1000 by one or more thin sections of material or "living hinges" 1035. The hinges 1035 allow the tabs 1034C, 1034D to flex radially outward when the activation housing assembly 28 is inserted into the proximal end of the PIR 31 and pressed axially downward. When sufficient axial force is applied, the tabs 1034C, 1034D flex outwardly to allow the lower portion of the activation housing 30 to pass through. Then the tabs 1034C, 1034D pivot back radially inward to their original positions, fitting within the undercut feature on the activation housing 30 to prevent activation. With these flexing tabs 1034C, 1034D, the PIR shown in FIGS. 18 and 18A can be removed from the device by gripping the PIR tubular body 1000 at the shoulder 1050 and sliding it off the activation housing assembly 28 in the direction of the arrow 1056 on the PIR. A series of vertical channels 1052 around the tubular body 1000 allow for additional movement of the flexing tabs. At least one web 1054 is located within each of the vertical channels 1052 to maintain structure of the tubular body 1000 during molding and assembly and show whether the integrity of the device has been compromised.

Vial Base Subsystem

As best understood in FIGS. 14-14D, 15-15C, the vial base subsystem 12 includes a bellows bottom cap 602, a bellows base 604, a bellows film 606 attached to the bellow base 604 (preferably in a sealed manner), and a seal 101, such as an O-ring for example, operably disposed between the lower portion of the main body 52 and one of the bellows base 604 and the bottom cap 602. In some embodiments where a relatively large volume is to be withdrawn from the drug container, a one-way valve 638 and an associated filter 640 are optionally mounted on the bellows base 604 to allow secondary airflow into the device to maintain a neutral pressure environment within the device during use and still allow a relative small overall device size.

Bellows Base

The bellows base 604 is constructed of a high-density polyethylene (HDPE) suitable for molding, machining, and use in medical grade applications. This material seals effectively with the bellows film 606. However, other materials can used without detracting from the invention.

Figure 14:
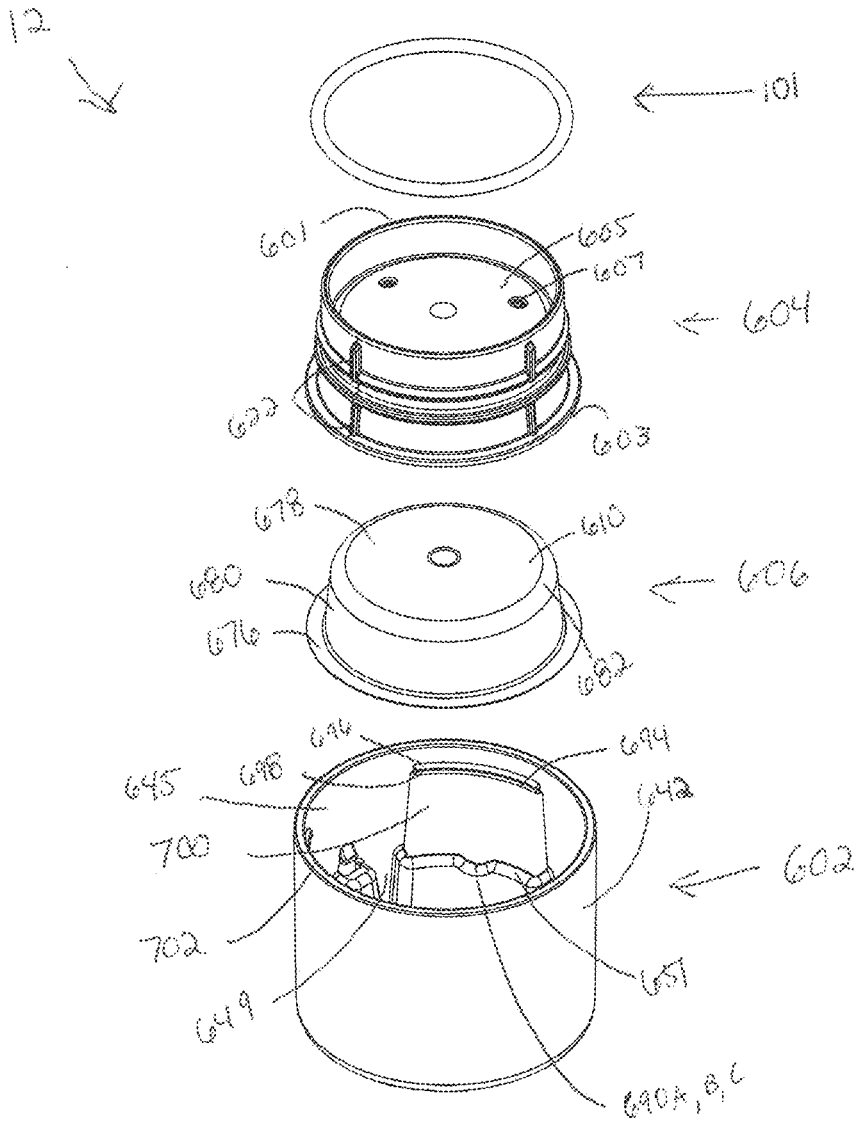
FIG. 14 is an exploded view of the vial base subsystem according to one embodiment of the invention.
Figure 14A:
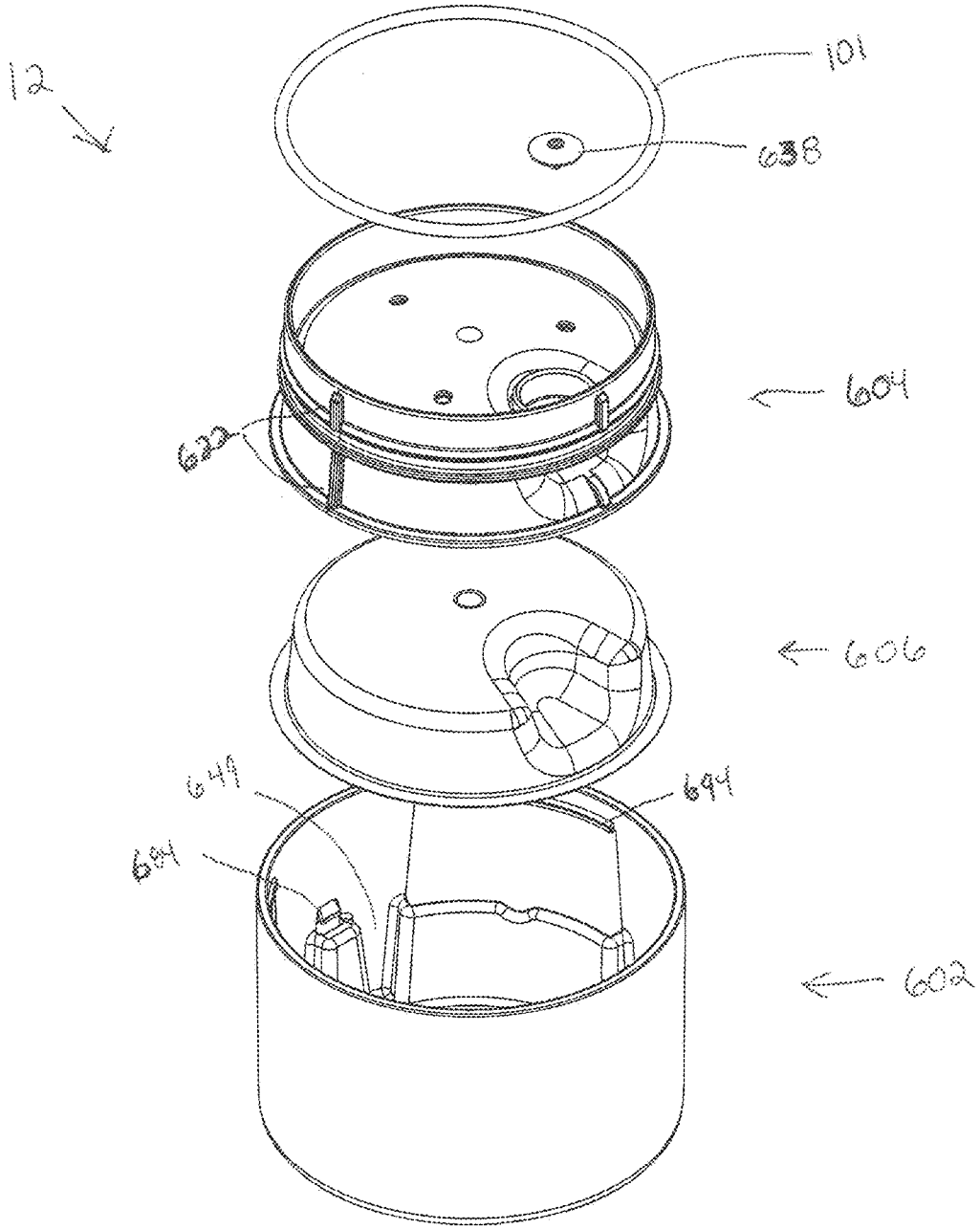
FIG. 14A is an exploded view of the vial base subsystem according to another embodiment of the invention.
Figure 14B:
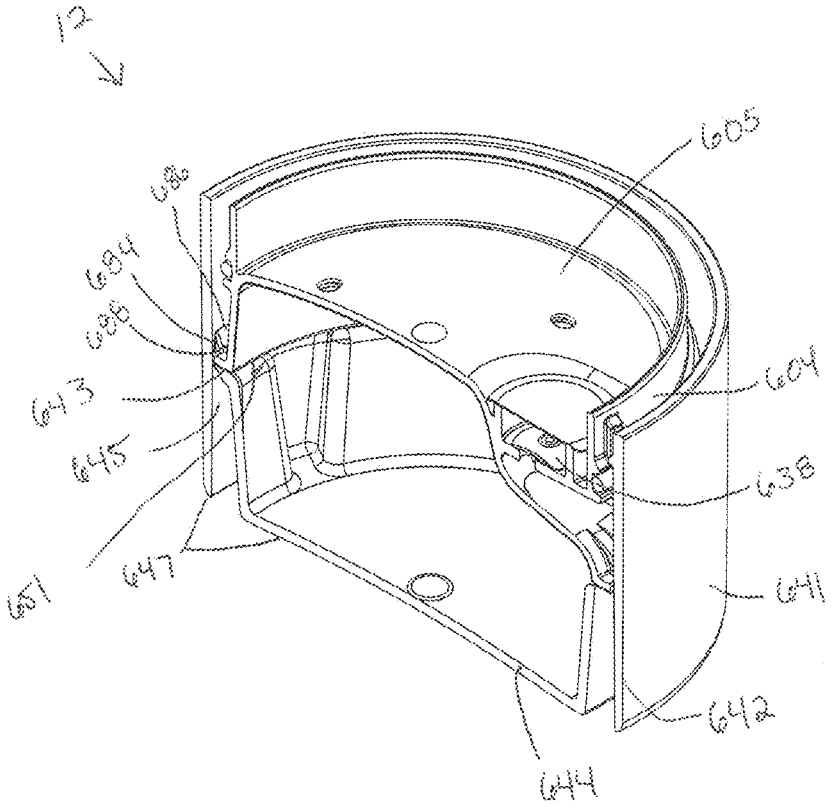
FIG. 14B is a cross-sectioned perspective view of an assembled vial base subsystem according to one embodiment of the invention.
Figure 14C:
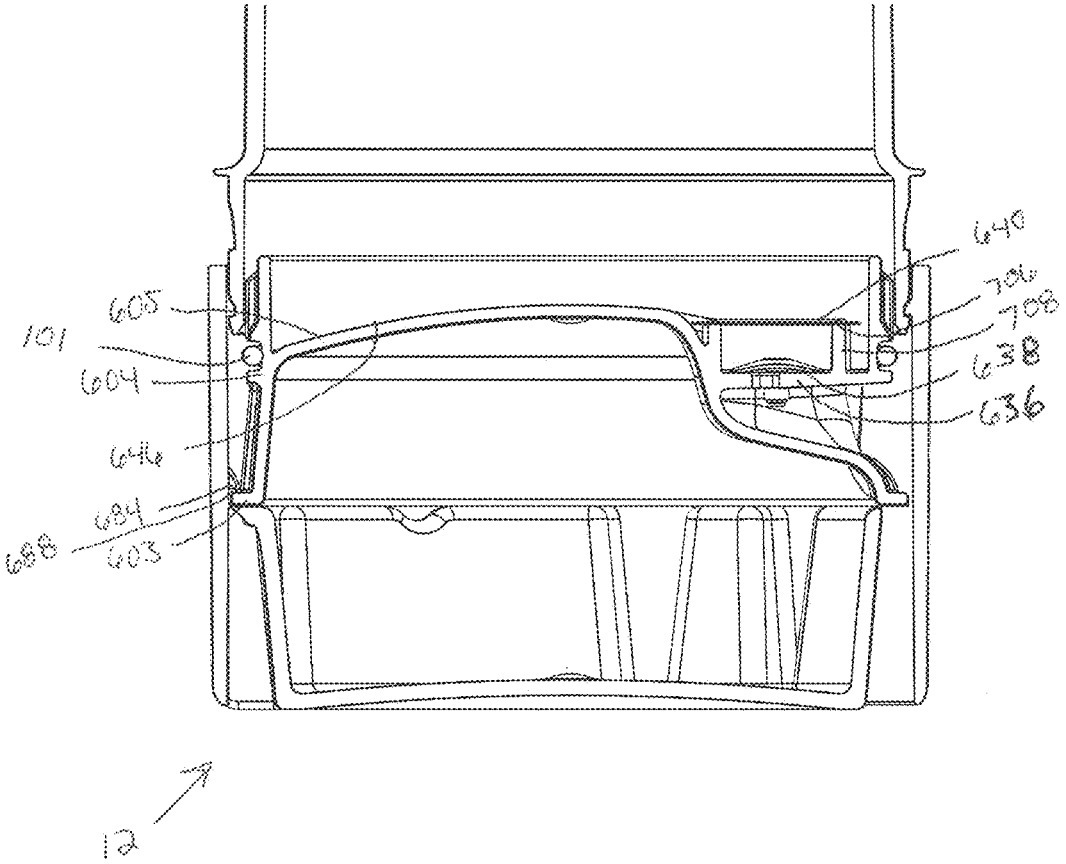
FIG. 14C is a cross-sectional view of an assembled vial base subsystem in a first position according to one embodiment of the invention.
Figure 14D:
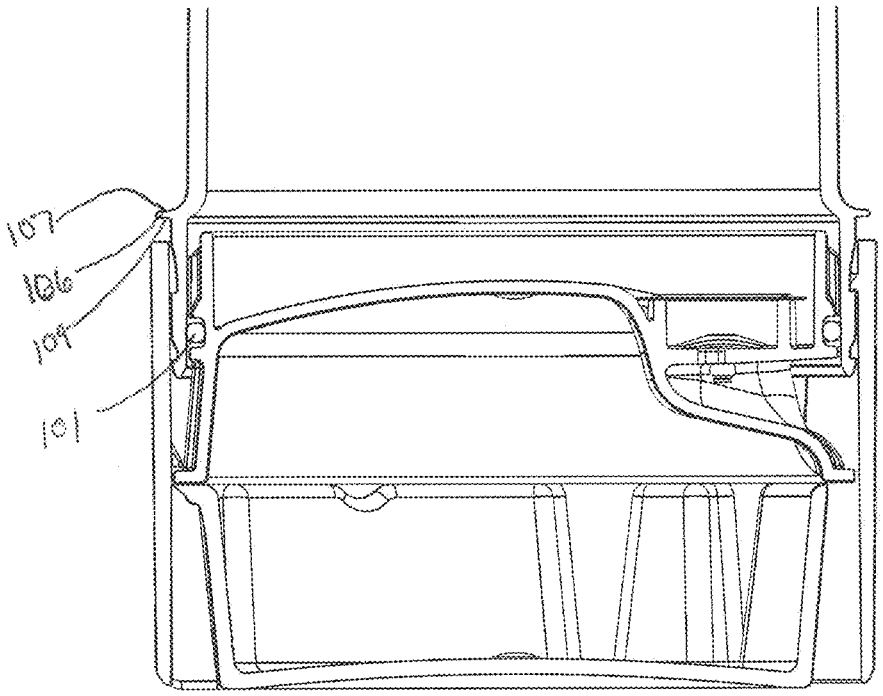
FIG. 14D is a cross-sectional view of an assembled vial base subsystem in a second position according to one embodiment of the invention.

In one embodiment, which is best seen in FIGS. 14-14D, the bellows base 604 is tubular and an intermediate wall 605 extends across the inside of the bellows base 604 between the upper and lower ends 601, 603 thereof. One or more holes 607 extend through the wall 605 of the bellows base 604 to allow air or vapor to pass through and into an expandable chamber 608 formed between the underside of the bellows base wall 605 and the top or upper surface 610 of the bellows film 606.

Figure 15:
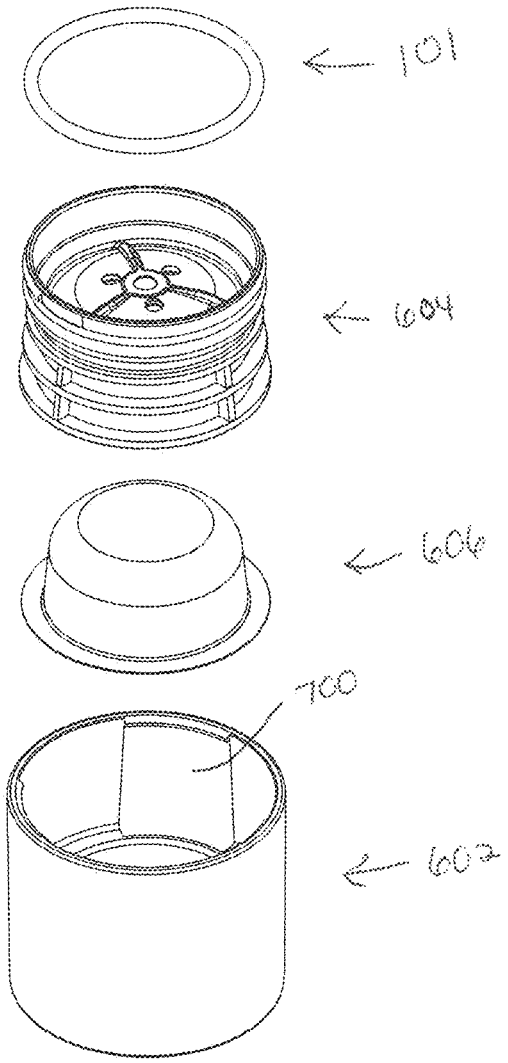
FIG. 15 is an exploded view of the vial base subsystem according to another embodiment of the invention.
Figure 15A:
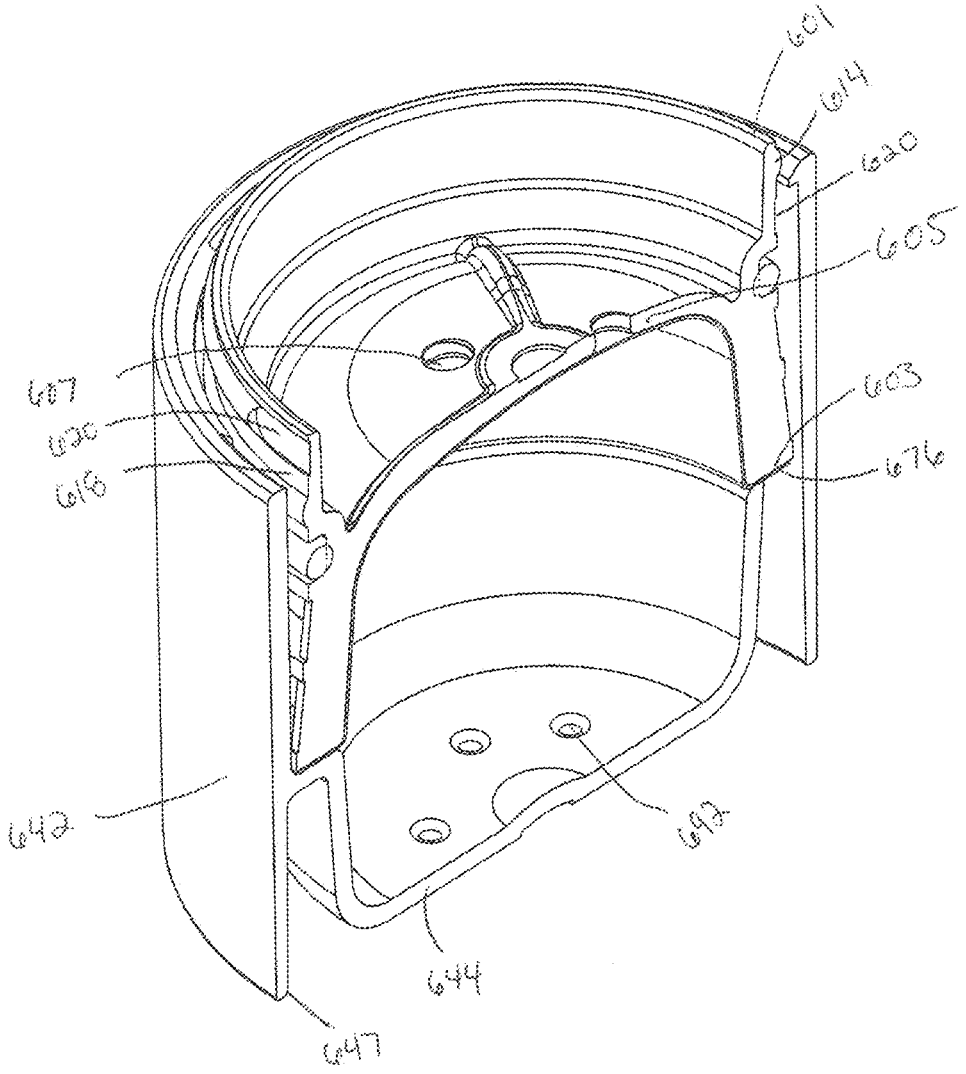
FIG. 15A is a cross-sectioned perspective view of an assembled vial base subsystem according to the embodiment of the FIG. 15.
Figure 15B:
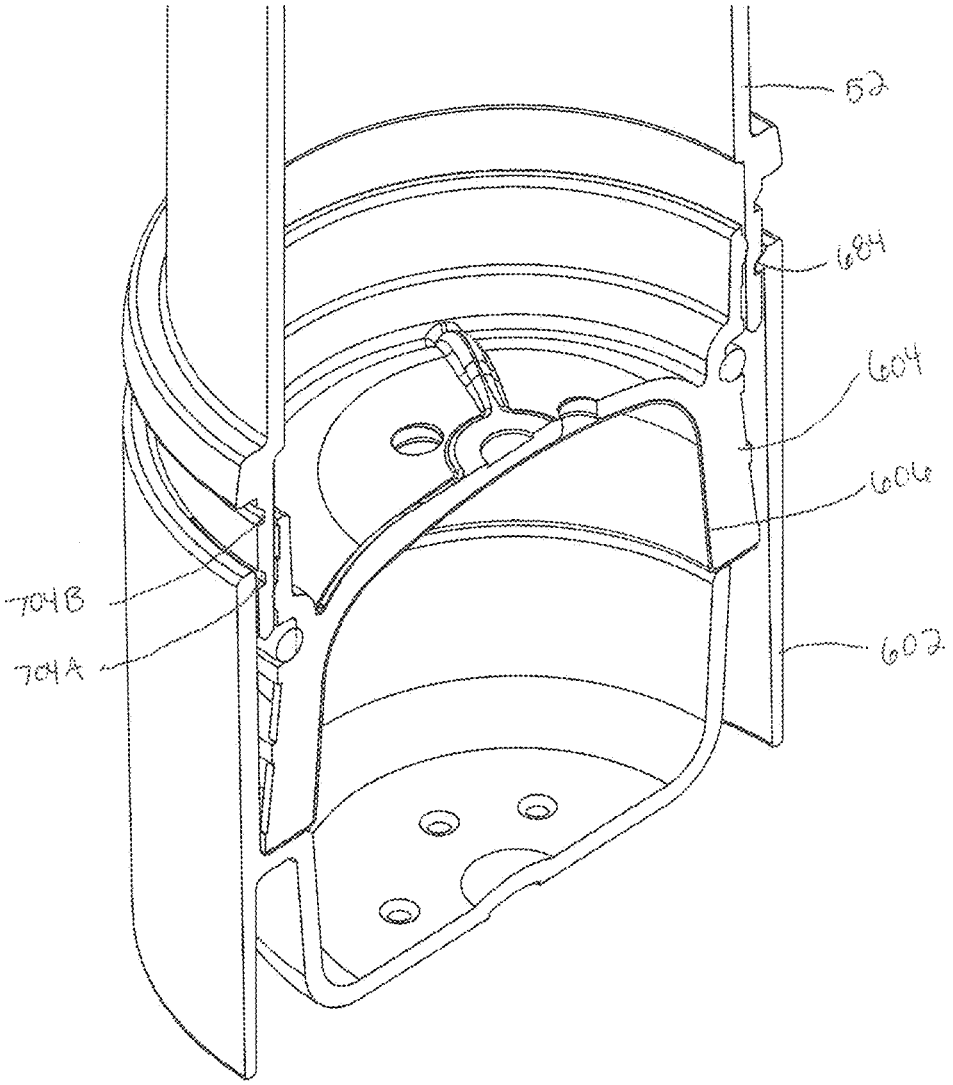
FIG. 15B is a cross-sectional perspective view of an assembled vial base subsystem in a first position according to the embodiment of the FIG. 15.
Figure 15C:
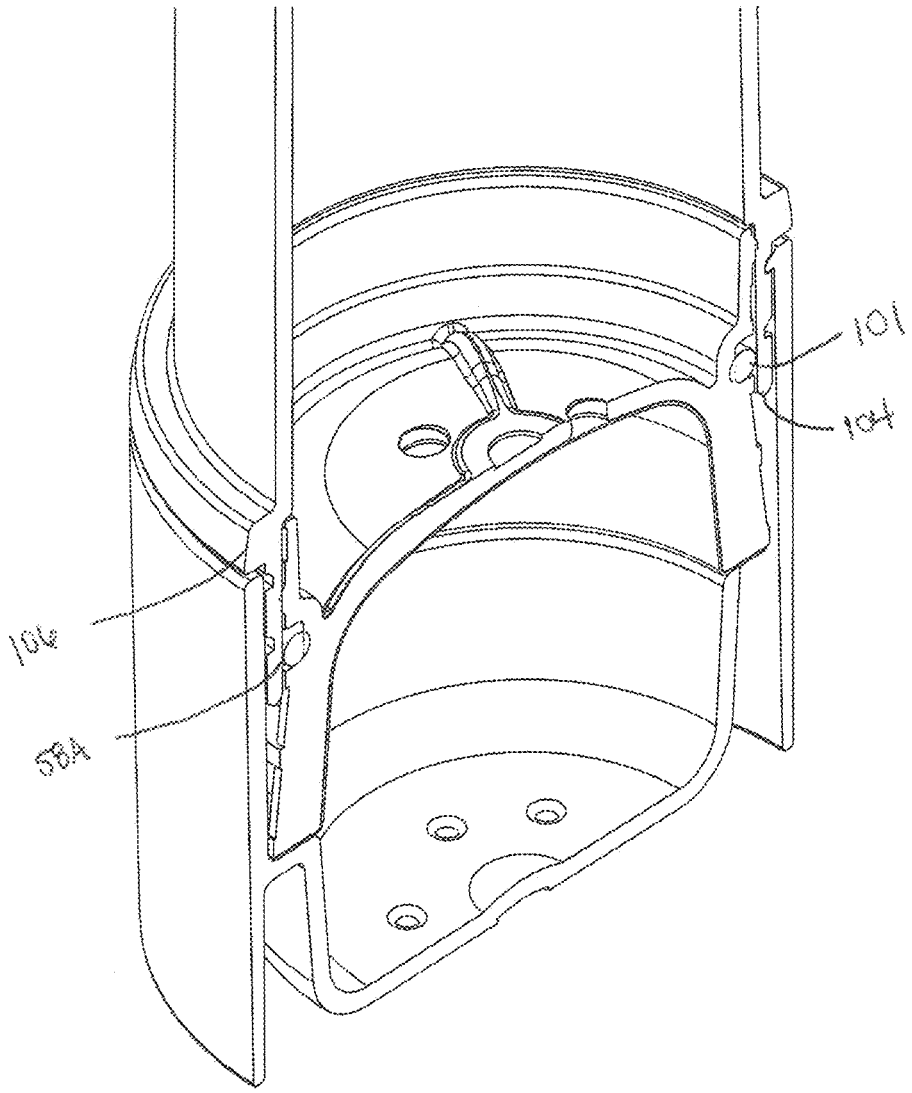
FIG. 15C is a cross-sectional perspective view of an assembled vial base subsystem in a second position according to the embodiment of the FIG. 15.

In one embodiment shown in FIGS. 15-15C, the bellows base 604 near its upper end 601 includes a plurality of axially spaced annular ribs 614 extending outwardly circumferentially above an annular groove 616 for the O-ring 101. A recess 618 is formed between each adjacent pair of the axially spaced ribs 614 and one or more notches, breaks or gaps 620 are provided in the each of the ribs 614. In one embodiment a first gap 620 is provided in the top rib 614 and a second gap 620 is provided in the lower rib 614 on the opposite side of the circumference. The gaps 620 define a tortuous path $P_T$ for sterilization gases or vapors to flow through during manufacturing of the safety vial assembly. In this and other embodiments shown in FIGS. 14-14D, a plurality of axially extending ribs 622 are spaced around the outer circumference of the bellows base 604. The axial extending ribs 622 extend outwardly above and below an annular groove 616 for the O-ring 101 and may be continuous (with no gaps) or interrupted (with gaps) without detracting from the present invention. The axial ribs 622 help guide and maintain concentric alignment of the components during assembly, fit into the bottom bore or opening 64 of the main body 52, and can be used as mating locating features during assembly.

After installation, the gaps formed between each of the axial extending ribs 622 above the annular groove 616 allow sterilant gases to enter the device during the sterilization processing. In a hybrid embodiment, if the axial ribs 622 are utilized and interrupted they can also contribute to the complexity of the tortuous path $P_T$.

As seen in FIG. 14, the lower end 603 of the bellows base 604 includes a substantially flat annular surface that provides a surface for mating with the brim of the bellows film 676. In one embodiment, the mating of the brim of bellows film to the flat annular surface at the lower end 603 of the bellows base 604 can be accomplished with heat sealing, ultrasonic welding or other joining process which can establish and maintain a sealed connection between the components.

Bellows Film

The bellows film 606 is a thin impermeable flexible sheet of material that is thermoformed into a hat like structure with a radially enlarged brim 676 sealingly attached to the proximal or lower end 603 of the bellows base 604. A raised crown portion 678 is sized and shaped to substantially fit within or conform to the lower or proximal portion 603 of the bellows base 604. As mentioned above, the film 606 helps define the limits of the expandable bellows chamber 608.

Figure 21:
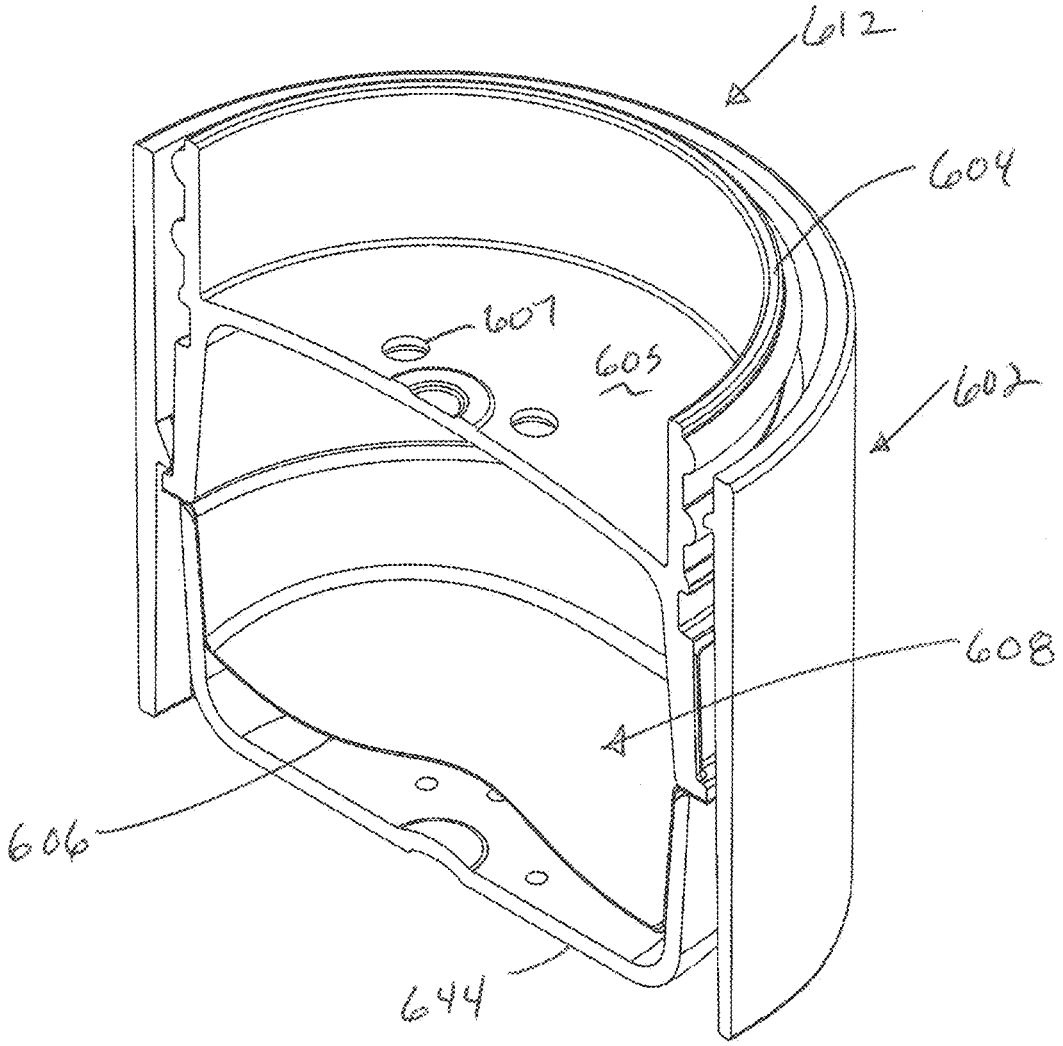
FIG. 21 is a cross-sectioned perspective view of the vial base subsystem showing the bellows film displaced from the bellows base such that the bellows chamber is in an expanded condition according to one embodiment of the invention.
Figure 22:
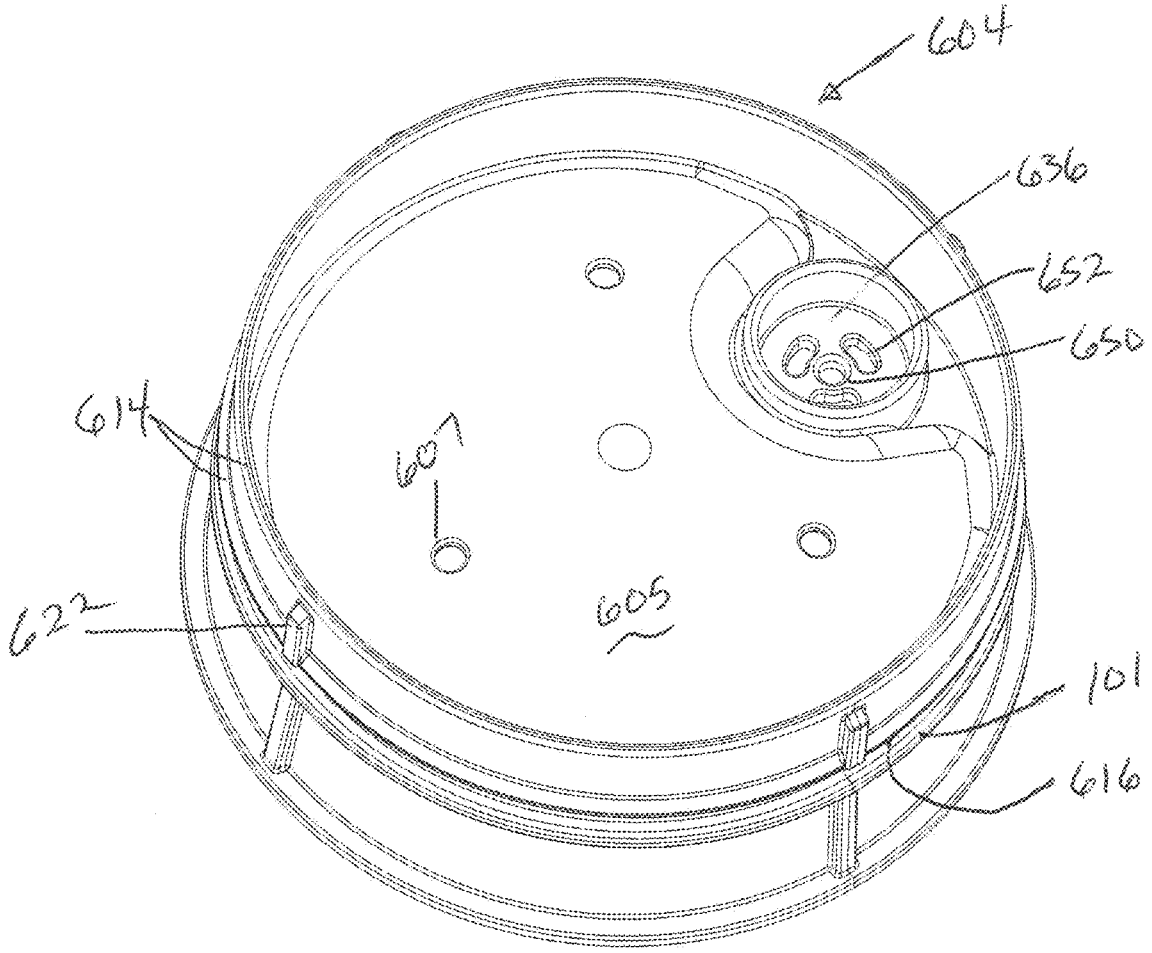
FIG. 22 is a perspective view of a bellows base having a valve seat for a check valve and a filter seat according to one embodiment of the invention.

The film 606 is manufactured by AMCOR under the trade designation PFP-100, IONOMER/ULDPE/EVA and is 0.010 inches (0.254 millimeters) thick. The material is a multiple layer film comprising an ionomer layer, an ultra-low-density polyethylene layer, and an ethylene vinyl acetate layer. Heat sealing layer is same as vapor contact layer. As shown in FIG. 21, the material needs to be very flexible to invert upon itself in use. The bellows film 606 has a wall 680 that extends from the brim 676 to a central raised crown portion 678. A radius 682 is interposed between the wall 680 and raised crown portion 678. The wall 680 is drafted smaller from the brim 676 to the crown portion 678 to assist in removal from a mold if a molding process is utilized.

One-Way Valve

As shown in the embodiments in FIGS. 4 and 4B, the vial base subsystem 12 has an optional one-way valve 638 mounted in the intermediate wall 605 of the bellows base 604, isolated and independent from the bellows film 606. The one-way valve 638 is an optional feature that is only necessary for the larger vial sizes where an added volume of gaseous fluid is desirable to be drawn through the system for maintaining a neutral pressure environment within the system throughout its use. Once all the fluid or air is withdrawn from the bellows and the bellows is substantially empty, the one-way valve 638 opens to define a passage to allow ambient air to be drawn into the system for pressure equalization. As shown in the FIG. 23 detail, a flat valve seat 636 is formed in the intermediate wall 605 of the bellows base 604 near the outer perimeter. In one embodiment, the valve seat 636 is recessed below the upper surface 646 of the intermediate wall 605 of the bellows base 604. A plurality of flow orifices or vent holes 648 are arranged around a central opening 650 for mounting the valve 638. The valve seat 636 is fluidly connected through the vent holes 648 to a passage 652 that extends outside the device. In one embodiment a side port 654 is connected to the passage 652. The side port 654 opens to the environment outside the bellows base 604. In another embodiment, the port 654 could exit the bellows base 604 and the device at other locations without detracting from the invention. The one-way valve 638 includes a valve member 656 that is toadstool or mushroom shaped with a generally cylindrical stem 658 and a domed upper portion 660 attached to the cylindrical stem 658. An optional, centrally located blind hole 662 is provided in the valve member 656 for temporarily receiving a mounting pin (not shown) to assist in handling, placement and installation of the valve member 656 during assembly. The mounting pin is removed after the valve 656 is installed. The valve stem 658 is elongated with a top end 664 connected to the underside 666 of the domed upper portion 660 and an opposite lower end 668. The valve stem 658 is preferably made of an elastomeric material, such as silicone by way of example, not limitation, and has an enlarged annular rib 670 adjacent the lower end 668. The annular rib 670 is sized and shaped to provide the resistance necessary to impede the valve 638 from easily being pulled back out of the bellows base 604 after installation. The upper portion 660 of the valve member 656 is umbrella shaped and has a concave lower surface 666 that extends to a circular outer rim 672 that intersects with a convex upper surface 674. The domed upper portion 660 has a thickness at its center that is greater than the thickness at the outer rim 672.

Bottom Cap

The bottom cap 602 encases and protects the bellows 608, the bellows base 604 and more importantly the bellows film 606.

As best seen in FIGS. 14-15C, the bottom cap 602 is a substantially rigid cup-like structure formed of a polypropylene material. Polypropylene is preferred because of its moldability, strength, shatter-resistance and durability. However, other materials could be used without detracting from the invention. The cap 602 has a tubular outer sleeve portion 642 and an interior bottom cup portion 644 rigidly, permanently attached along spaced apart portions of its brim or periphery 643 to the inner surface 645 of the outer sleeve portion 642. The resulting gaps 649 in the attachment of the bottom cup portion 644 to the outer sleeve 642 provide one or more passages for air to enter under the bellows film 606, allowing for its expansion and contraction within the bottom cup portion 644. The sleeve 642 is substantially cylindrical in one embodiment and has a smooth outer surface 641. The inner surface 645 is more complex and has several features of interest. Adjacent to the lower end 647 of the cap 602 a ledge 651 extends radially inwardly from the inner surface 645 around its inner periphery. The ledge 651 is comprised of a plurality of spaced apart bridge elements 651A, 651B, 651C, etc. that interconnect the outer sleeve 642 and the bottom cup portion 644.

As stated above, the gaps 649 between the bridge elements 651A, 651B, 651C, etc. are useful functionally, as well as in the molding process. A short distance above the ledge 651, at least one and more preferably a plurality of mating retaining elements or snap detents 684 also extends radially inward from the inner surface 645 of the cap sleeve 642. The upper side 686 of the detents 684 is ramped or angled inwardly. The lower sides 688 of the snap detents 684 are substantially horizontal and extend inwardly from the inner surface 645 to join with the upper side 686. The detents 684 are preferably centrally disposed over each of the bridge elements 651A, 651B, 651C, etc. The detents 684 and the bottom cap brim 643 thereof define a gap or space into which the bellows base brim 603 can snap into during assembly of the vial base subsystem 12, as best understood in view of FIGS. 14B and 14C.

Figure 20:
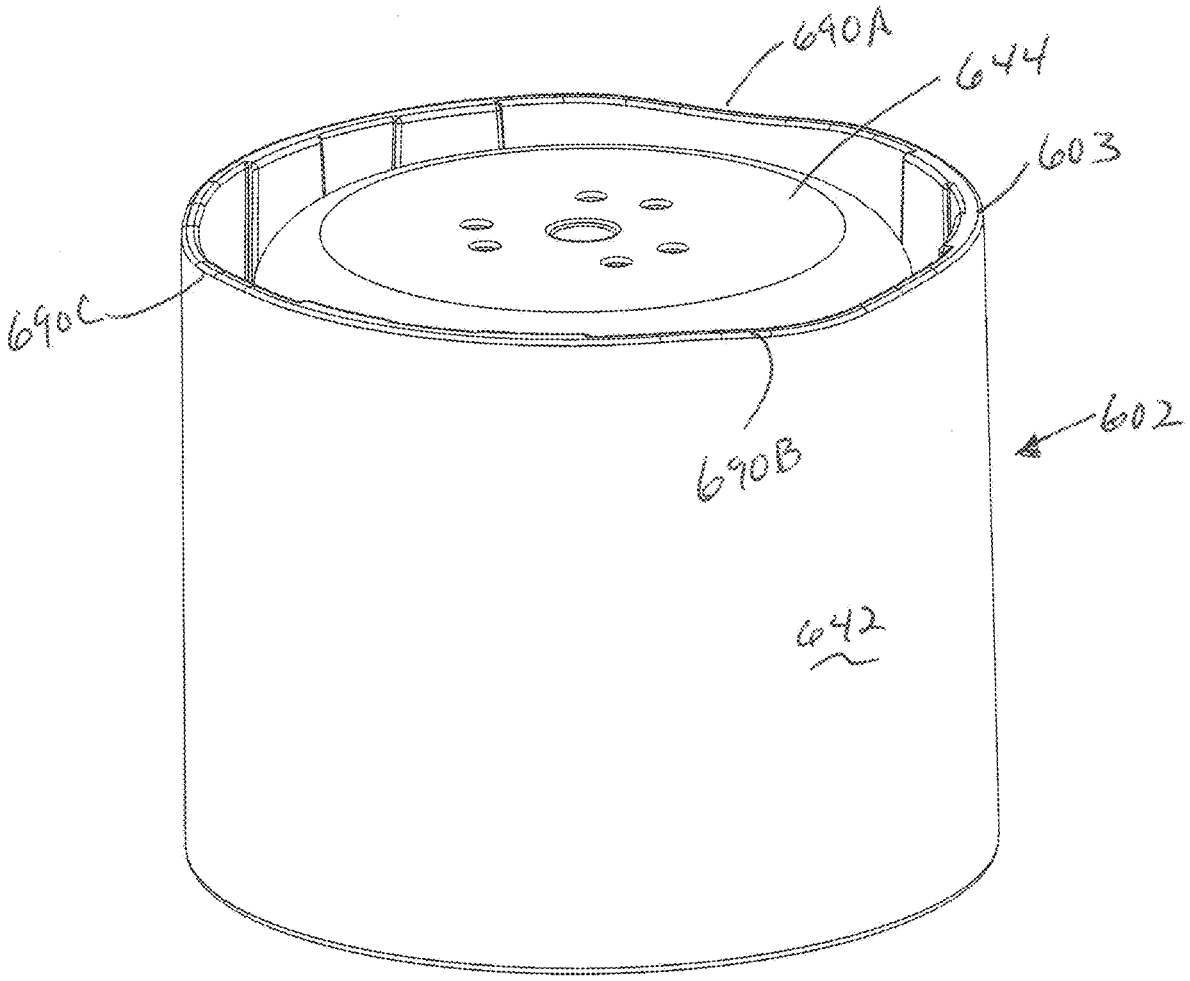
FIG. 20 is an enlarged bottom perspective of a bottom cap according to one embodiment of the invention.
Figure 20A:
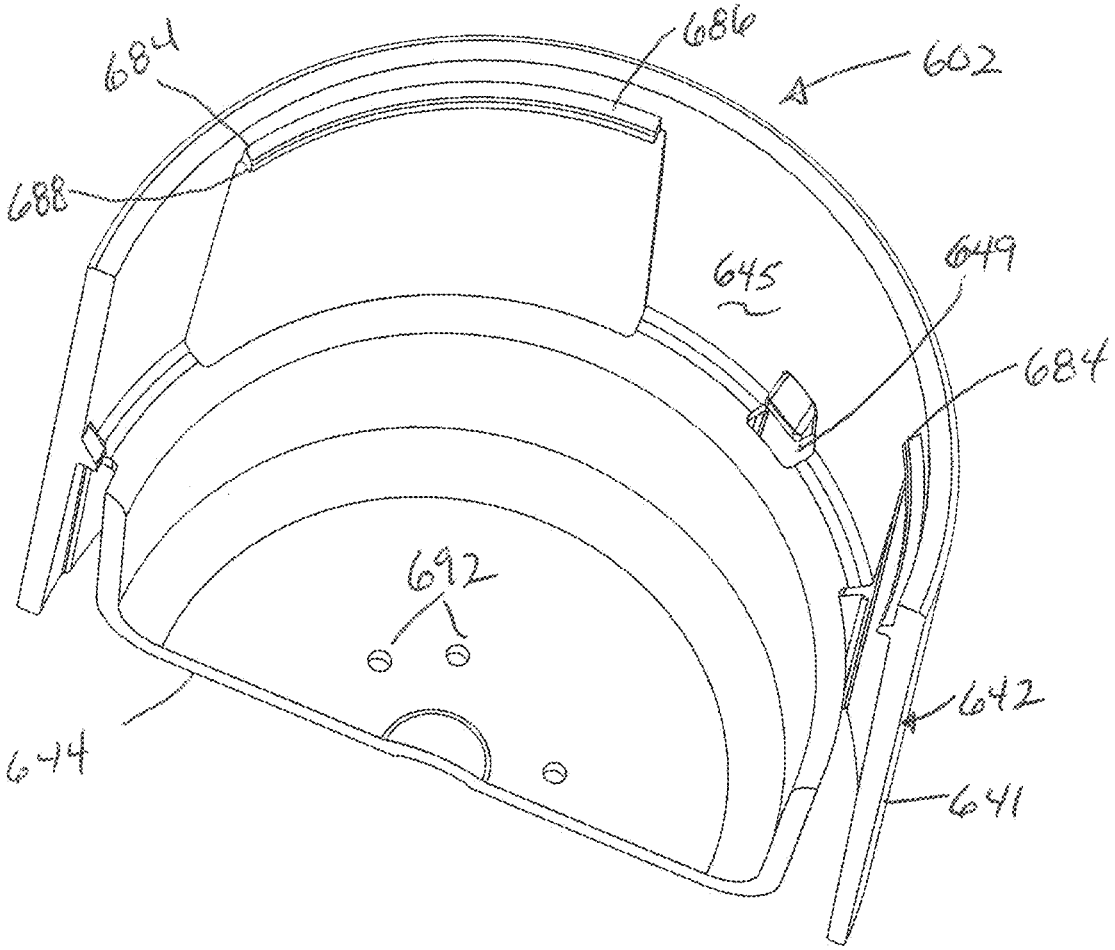
FIG. 20A is an enlarged cross-sectioned perspective view of the bottom cap according to the embodiment of FIG. 20.

The brim 643 of the cup portion 644 is attached to the inner surface 645 of the outer sleeve 642 at a location remote from or above the bottom 647 of the outer sleeve 642, and the bottom of the cup portion 644 is elevated above the plane of the bottom 647 of the sleeve 642. The lower portion of the outer sleeve 642 below its junction with the cup portion 644 serves as a stand for the device and will absorb most of any impact if the device is dropped. In one embodiment (FIG. 20), three venting archways 690A, 690B, 690C are provided on the lower end surface 603 of the outer sleeve 642, with vent holes 692 at the bottom of the cup portion. In another embodiment (FIG. 14A), three archways 690A, 690B, 690C are located at the top of the inner cup portion 644. These features prevent a vacuum from being formed when the device is placed upon a smooth flat surface and allow the escape of any ambient gases remaining in the cup portion 644.

A plurality of snap ledges 694 are provided adjacent to the top of the outer sleeve 642. The top ledges are aligned with the lower ledges and the recesses described below. The ledges 694 have a ramped upper surface 696 and an inwardly angled lower surface 698.

For molding purposes, a plurality of recesses 700 are formed on the inner surface of outer sleeve 642 just below the top ledges 694 and extend to the bottom of the inner surface 645. In one embodiment there are three recesses 700A, 700B, 700C spaced equally around the inner periphery of the inner surface 645.

The top end surface 702 of the outer sleeve 642 provides a stop surface to prevent any further downward movement of the assembly from above.

The bottom cap 602 encases and protects the bellows chamber 608, the bellows base 604 and more importantly the bellows film 606. The snaps 694 on the bottom cap 602 engage with circumferential grooves 108 or rings 704A, 704B on the lower portion 56 of the main body 52. The snaps 694 engage the lower circumferential ring 704A to define position 1 for sterilization. Then bottom cap 602 can be moved upward to disengage the snaps 694 from the lower ring 704A and then the snaps 694 re-engage with the upper ring 704B to define position 2 which hermetically seals the device.

Filter

Figure 23:
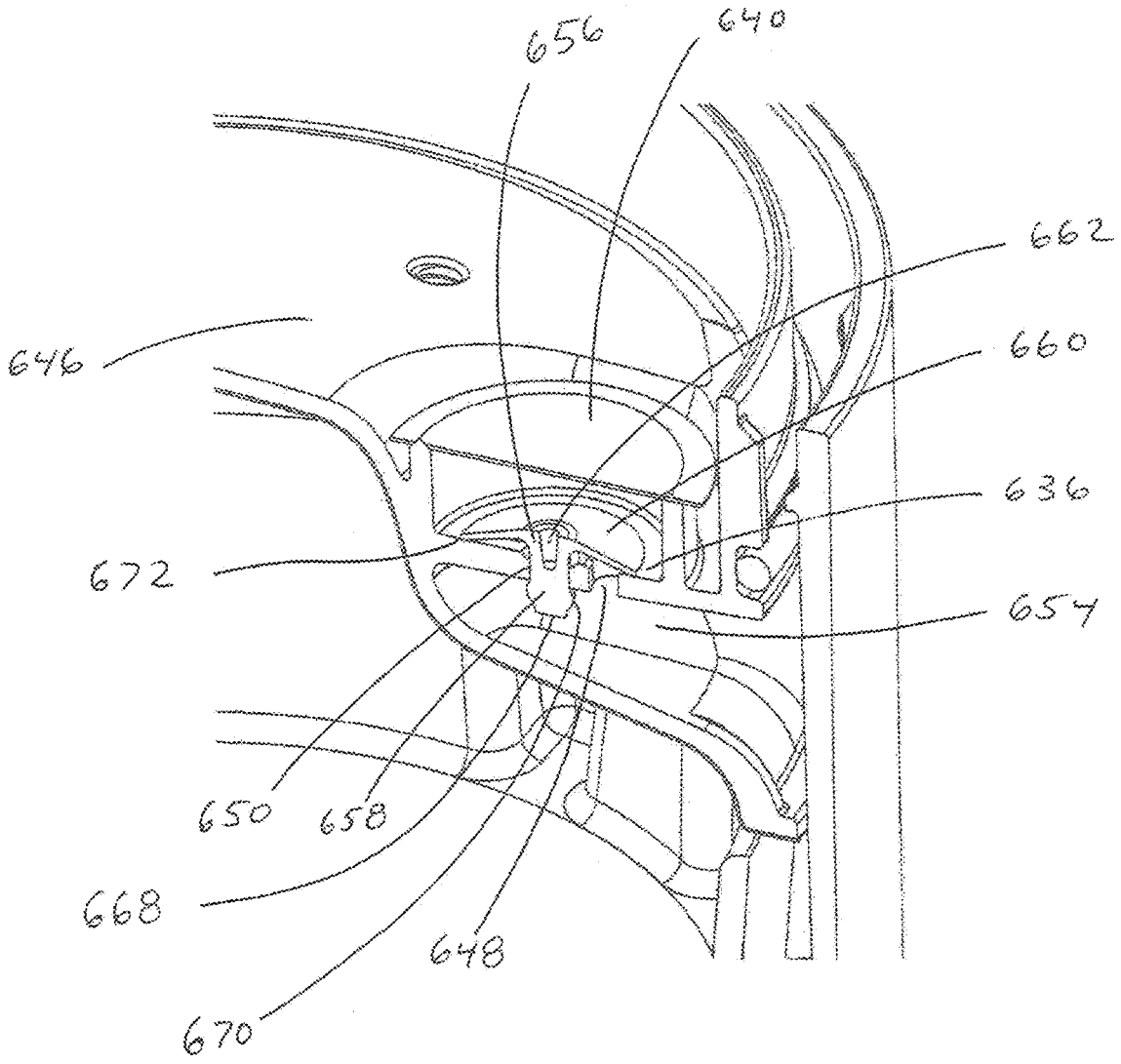
FIG. 23 is a cross-sectioned partial perspective view of a vial base subsystem assembled according to one embodiment of the invention.

An optional filter 640 in the vial base subsystem 12, and most likely in the bellows base 604, such as already described herein, can be operatively disposed before or after the one-way valve 638. The functions and material of the filter 640 are the same as described with respect to the optional filter 40 that can be in the activation housing subassembly 28. In one embodiment as shown in FIG. 23, a thin circular disk of the filter material is adhered, heat sealed or otherwise sealingly attached to the upper rim 706 of a tubular boss 708 formed in the bellows base 604 around the one-way valve 638.

Mating of Vial Base Subsystem & Vial Adapter Subsystem

In one embodiment, as seen in FIGS. 14C and 14D, the main body 52 and bottom cap 602 have mating retaining elements 684, 704A, 704B. In one embodiment the mating retaining elements include a groove 704A or more preferably a pair of spaced apart circumferential grooves 704A, 704B formed on an exterior surface 806 of the main body 52. The mating elements further include one or more radially inwardly protruding tongues 808; 808A, 808B on the bottom cap 602 that snap into the groove or grooves 108, 704A, 704BB in the main body 52 to retain the vial base subassembly 12 to the main body assembly 20. It has been found that three tongues 808A, 808B, 808C equally spaced around the circumference of the bottom cap 602 provide good guidance, centering and retaining forces. Three equally spaced slots 810A, 810B, 810C are provided, one between each of the tongues 808A, 808B, or 808C for ease of molding or manufacturing.

A hermetic seal 609 is provided between the exterior surface 611 of the bellows base 604 and the interior surface 58 in the lower portion of the main body 52. The seal 609 can be formed of a silicone material or other suitable materials for sealing. In one embodiment, the seal 609 is an elastomeric O-ring mounted in a groove 616 formed on the exterior surface 611 of the bellows base 604 and is moveable with the bellows base 604 as described below. In another embodiment, the seal is mounted in a groove 617 formed on the interior surface 58 of the lower portion of the main body 52.

Process of Making

The process for making the safety vial system 10 of the present invention includes, in general, the steps of providing a vial 16 filled with a drug 18, providing a vial adapter subsystem 14, providing a vial base subsystem 12, aligning these components so that they share a common longitudinal axis 13, and then connecting, coupling, or joining the vial adapter subsystem 14 and the vial base subsystem 12 together so that the filled vial 16 is captured therebetween. During or after a sterilization step, the vial base subsystem 12 is moved from a first position wherein a sterilization passageway therethrough is open to allow a sterilant operative access to exposed surfaces, volumes and spaces within the system 10, especially exterior surfaces of the vial 16, into a second position wherein the sterilization passageway is sealed closed, the filled vial 16 is fully enclosed, and the system 10 is a completed sterilized unit ready for use. These basic steps can each include several substeps as further described below.

Vial Adapter Subsystem Assembly

The process for making the vial adapter subsystem 14 of the present invention includes the steps of assembling the activation housing assembly 28, the main body assembly 20 and the product integrity ring 31.

In one embodiment as best seen in FIGS. 10-10B, the activation housing assembly 28 is assembled as follows. In one embodiment, an optional check valve 38 is inserted, and preferably press fitted, into a through hole 113 in a cross member 29 of the activation housing 30. In one embodiment, the edges of the filter 40 are heat sealed to an annular flange, which is preferably raised, on the underside of the generally horizontal cross member 29 of the activation housing 30. In one embodiment, the spike 42 is attached to the activation housing 30. In one embodiment the attachment is accomplished by ultrasonic welding. One end of the spike 42 is inserted into the central hole 51 extending through the activation housing 30. The central hole 51 in the activation housing 30 is tapered so that it is larger at the underside entrance and smaller at the exit of the hole 51 at the top. The distal or pointed end 65 of the spike 42 is arranged to point downward, while the proximal end 67 is inserted into the central hole 51 through the activation housing 30. The proximal end 67 of the spike 42 has a mating taper so that the spike 42 centers and seals with the inner surface of the hole 51. The flange 71 of the spike 42 is ultrasonically welded to the (outer) rim on the underside of the activation housing 30. An air pathway cover is attached to the bridging surface of the activation housing 20. The needleless valve 34 is then attached, preferably permanently, by solvent bonding, ultrasonically welding, or laser welding it to activation housing 30, more particularly to the bridging surface or cross member 29 that separates the distal and proximal ends 43, 35 of the activation housing 30. A seal 44, such as an O-ring, is installed into the groove 218 provided in the outer or exterior surface 33 of the activation housing 30. The cap 36 is screwed on to the Luer threads of the needleless valve 34 or threads on the activation housing 30, whichever the case might be.

In another embodiment as best seen in FIGS. 9-9D, the activation housing assembly 28 is assembled as follows. A bulkhead member 29A is provided as a foundation for attaching many of the elements prior to being installed into the activation housing 30. In one embodiment, an optional check valve 38 is inserted, and preferably press fitted, into a through hole 113 in the bulkhead 29A. The edges of the filter 40 are heat sealed to an annular first raised flange 114 on the underside of the bulkhead member 29A. The spike 42 is attached to the bulkhead member 29A. In one embodiment the attachment is accomplished by ultrasonic welding. One end of the spike 42 is inserted into the central opening 51 extending through the bulkhead member 29A. The central hole 51 in the bulkhead member 29A is tapered so that it is larger at the underside entrance and smaller at the exit of the hole in the top of the bulkhead 29A. The distal or pointed end 65 of the spike 42 is arranged to point downward, while the proximal end is inserted into the central opening 51 of the bulkhead 29A. The proximal end of the spike 42 has a mating taper so that the spike 42 centers and seals with the inner surface of the hole or opening 51. The flange 71 of the spike 42 is ultrasonically welded to the (outer) rim 116 on the underside of the bulkhead 29A. The resulting bulkhead supported assembly is then lowered into the activation housing 30 until it rests on the shoulder 130 inside the activation housing 30, where it is attached, more preferably hermetically sealed, by ultrasonic welding or other known method of attachment to the activation housing 30. The needleless valve 34 is then solvent bonded or laser welded to the central post at the proximal end of the bulkhead 29A. A seal 44, such as an O-ring, is installed into the groove 218 provided in the outer or exterior surface 33 of the activation housing 30. The cap 36 is screwed on to the Luer threads of the needleless valve 34 or threads on the activation housing 30, whichever the case might be.

In another embodiment as best seen in FIGS. 8-8C, the activation housing assembly 28 is assembled as follows. In one embodiment, the edges of the filter 40 are heat sealed to the cylindrical rings 87 and 89 on the top side of the spike 42. The spike 42 is attached to the activation housing 30. In one embodiment the attachment is accomplished by ultrasonic welding. The proximal end of the spike 42 is inserted into the offset hole extending through the lateral cross member or generally horizontal bridge portion 29 of the activation housing. The outer peripheral edge of the spike 42 is also welded to the inner diameter or interior surface 32 of the activation housing 30. The distal or pointed end 65 of the spike 42 is arranged to point downward, while the proximal end 67 is inserted into the offset hole in the activation housing 30. The flange of the spike 42 is ultrasonically welded to the shoulder 68 on the underside of the activation housing 30. The needleless valve 34 is then solvent bonded, ultrasonically welded, or laser welded to the cross member or bridging surface 29 that separates the distal and proximal ends 43, 35 of the activation housing 30. A seal 44, such as an O-ring, is installed into the groove 218 provided in the outer or exterior surface 33 of the activation housing 30. A seal 53, such as an O-ring, is installed into the groove at the top of the activation housing 30. The cap 36 is screwed on to the threads on the top of the activation housing 30.

Assembly of Main Body Assembly

In one embodiment, the main body assembly 20 is assembled as follows.

In one embodiment, an optional sleeve 84 is ultrasonically welded to the main body 52 to provide undercut snaps 88 to retain the activation housing 30 and prevent it from being pulled away from the rest of the vial adapter assembly 14.

In one embodiment, the vial retention ring 78 or 78A is inserted into the bottom portion 58A of the central bore of the main body 52 from underneath and ultrasonically welded to the retention shoulder 66 on the main body 52.

The barrier film 26, which can be an aluminum foil seal, is heat sealed to an elevated, smooth, flat, horizontal annular mounting ring 72 within the central bore of the main body 52. A non-elevated substantially flat, smooth surface can also be used for the heat sealing surface or seal holder 70 in another embodiment without significantly detracting from the invention. In one embodiment, the raised mounting ring 72 can be used to target, guide and assist with correct placement of the seal on the annular surface. In one embodiment, a gap exists between the barrier film 26 and the seal holder 70.

Figure 7B:
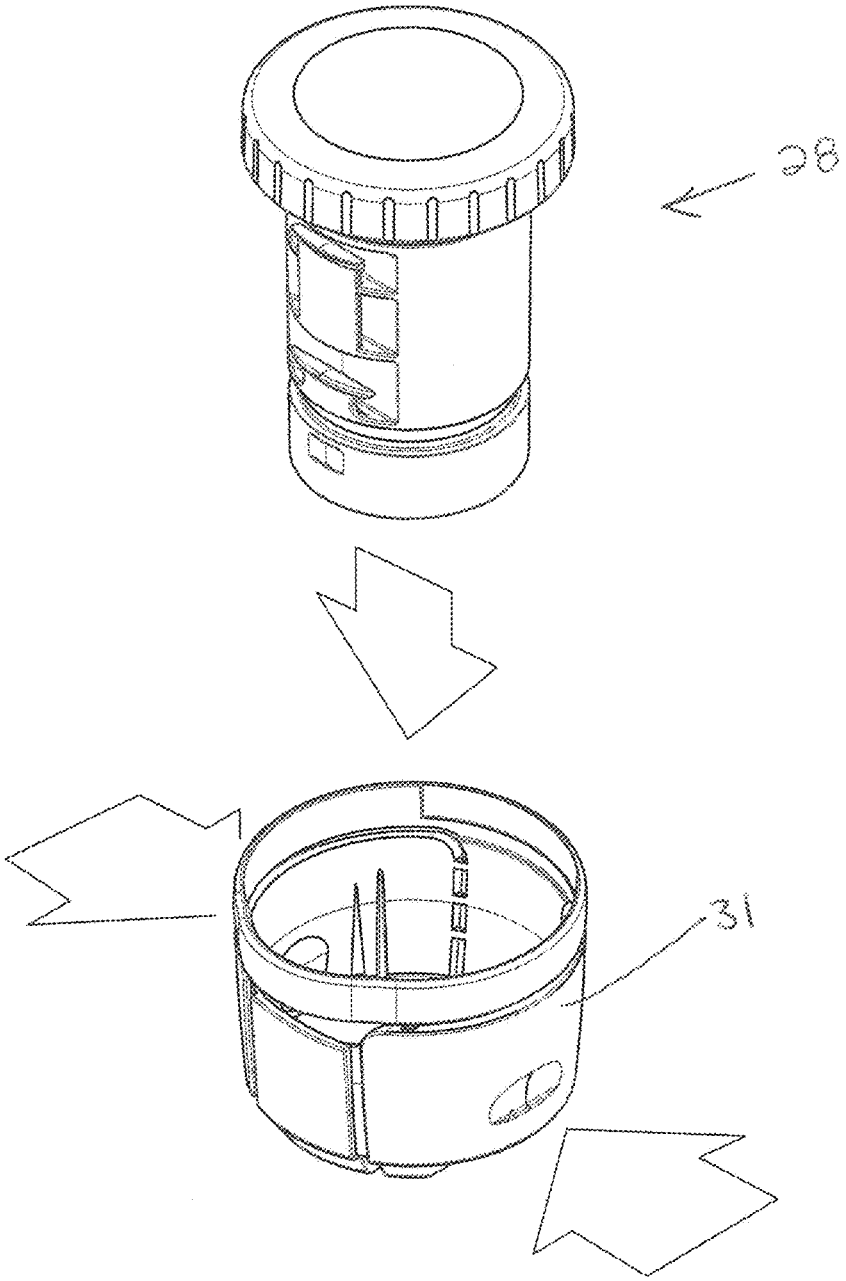
FIG. 7B is an exploded view of an activation housing and product integrity ring assembly according to the embodiment of FIG. 7A.
Figure 7C:
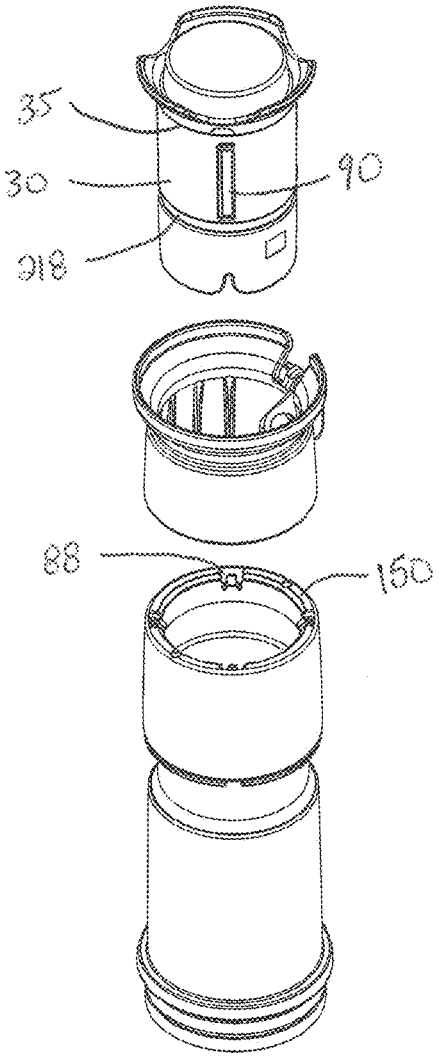
FIG. 7C is an exploded view of a vial adapter subsystem or subassembly according to another embodiment of the invention.

Assembly of Activation Housing Assembly, Main Body Assembly and Product Integrity Ring In one embodiment as best seen in FIGS. 7A and 7B, the assembly process is as follows. To install the activation housing 30 into the product integrity ring 31, the product integrity ring 31 is placed upright into a fixture (not shown) that supports the bottom of the product integrity ring 31 and encases at least the lower portion of the tubular body 1000.

Opposing pinching forces are applied at the pinch locations PL1, PL2 or grooves 1014A, 1014B. The resulting pinching force causes the product integrity ring 31 to elastically deform and shorten along the pinching axis 1013 and elongate along an axis 1015 normal to the pinching axis 1013, which causes the flexing bowing portions 1016, 1018 and the tabs 1034A, 1034B at the bottom thereof to move radially outwardly until the arcuate edges 1042 of the tabs 1034A, 1034B define a circle of greater diameter than the outer diameter 33 of the activation housing 30. The lower portion of the activation housing 30 is then inserted into the top opening 1002 of the product integrity ring 31, which is still substantially circular, and into the now oblong bottom portion 1007 of the PIR 31 until the tabs 1034A, 1034B align with the two D-shaped channels or grooves in the outer diameter 33 of the activation housing 30. When the opposing pinching forces are released and the product integrity ring 31 resiliently or elastically returns to its original shape, the tabs 1034A, 1034B spring radially inwardly to mate with and retentively engage the two D-shaped channels or grooves on the outer diameter 33 of the lower portion of the activation housing 30.

In an alternative embodiment as best seen in FIG. 7, the assembly process is as follows. To install the activation housing 30 into the product integrity ring 31, the product integrity ring 31 is placed upright into a fixture (not shown) that supports the bottom of the product integrity ring 31 with space for the PIR hinges 1035 to move, allowing the tabs 1034C, 1034D to flex radially outward when the activation housing assembly 28 is inserted into the proximal end of the PIR 31 and pressed axially downward. Then the tabs 1034C, 1034D pivot back radially inward to their original positions, fitting within the undercut features on the activation housing 30.

In one embodiment, the main body assembly 20 can also be provided and joined with the activation housing assembly 28/product integrity ring 31 in a similar axially aligned way. The main body assembly 20 is placed upright into a fixture (not shown) that supports at least the bottom of the main body assembly 20. In the embodiments described above, the product integrity ring 31 has already been joined with the activation housing 30. The activation housing assembly 28/product integrity ring 31 is pressed axially downwardly into the top opening 58 of the main body assembly 20 until the manufacturing snaps 220 on the activation housing 30 resiliently deflecting inwardly and then springing back outwardly to engage the horizontal flange 148 on the main body 52 and prevent the disconnection or disassembly of the system. In the engaged and locked position, the conical shaped opening 62A of the main body 52 also surrounds the foot portion 1038 and/or leg portion 1036 of the product integrity ring 31.

In another embodiment, the activation housing assembly 28/product integrity ring 31 attached is pressed axially downwardly into the top opening 58 of the main body assembly 20 until the lower snaps on the main body assembly 20 slide up over the ramped ledges on the interior of the PIR, resiliently deflecting outwardly and then springing back inwardly to engage the control surfaces 92 in the grooves 90 of the activation housing 30 and prevent the disconnection or disassembly of the system.

The entire vial assembly subsystem or vial adapter subsystem 14 can now be sterilized. In one embodiment, the sterilization is accomplished by gamma radiation sterilization.

Vial Base Subsystem

The vial base subsystem 12 is assembled as follows.

The assembly process includes heat sealing the bellows film 605 to the bellows base 604. Alternatively, the bellows base 604 and bellows film 605 can be integrally formed in a two-shot molding process. In the heat sealing method, the periphery of the bellows film 605 is heat sealed to a planar surface on the lower end 603 of the bellows base 604. Of course, the location of the planar surface depends upon the orientation of the bellows base 604 during assembly. When the bellows base 604 is in the orientation shown in FIG. 14, the planar surface is located at the bottom of the bellows base 604.

In one embodiment an optional umbrella-shaped valve 638 is installed into a mating valve seat 636 formed in the bellows base 604. The valve 638 is normally closed, but when sufficient vacuum pressure exists in the volume around the vial 16, the valve 638 opens and operatively allows a one-way flow of additional ambient air to be drawn into the system through an air passageway 652 to maintain a neutral pressure environment within the system during withdrawal of the drug 18 from the vial 16.

In another embodiment an optional check valve filter 640 is mounted in the bellows base 604 upstream of the check valve 638 to filter ambient air drawn into the system.

The assembly process includes installing the O-ring seal 609 into the groove 616 in the outer or exterior surface 611 of the bellows base 604.

The assembly process includes installing the bellows base assembly 612 (bellows base, bellows film, O-ring seal, optional valve, optional filter) into the bottom cap 602 by inserting or press fitting it through the top opening 613 of the bottom cap 602 until it reaches the lower ledge 651 and clears the ramp shaped snap detents 684, so they retain the lower edge 603 of the bellows base assembly 612 in the bottom cap 602.

The above steps can be completed with the bottom cap 602 in an upright position at a concentric vertically oriented workstation in a sequence of operations, although it will be understood that the orientation and order can be varied as logic allows. The bellows film 606 to bellows base 604 attachment can be done in-line or in an offline operation.

Now the vial base subsystem 12 is complete and can be left or placed in an upright position and transferred on belt or moving table to packaging for later final assembly or they could be immediately transferred to the final assembly area without packaging. There is no need for sterilization of this assembly as that will be addressed later, as described below.

Vial Preparation

The drug vials 16 will be filled and closed in a conventional manner. However, before assembly into the safety vial system, a plastic cap (not shown) that normally covers the top surface of the stopper; i.e. the flip-off top, is removed. Removing this flip-off top is a standard, conventional process when accessing the stopper of a standalone drug vial. However, the flip-off top removal is normally done by the end user immediately before use and access of the drug vial contents in the patient healthcare environment. With or without the flip-off top, the container closure integrity of the vial 16 is still maintained using the interference fit between the stopper 19 and the glass vial 16 with the aluminum ferrule hold down ring 21 providing the crimp force to seal the stopper 19 to the vial 16.

In one embodiment, the drug vials 16 inserted into the safety vial system 10 will not have the standard, conventional printed label adhered to the side wall 25 of the vial 16. Instead, the drug vial 16 will have computer readable information regarding the vial contents or drug product 18 printed on the aluminum ferrule 21. The computer readable information can be in the form of a 2D or 3D bar code, QR code, or the like. A scanner on the vial conveyor system reads the information prior to insertion of the vial 16 into the safety vial system 10. The information is transferred by a computer connected to the scanner so that it can be printed on adhesive labels 63 that are placed on the exterior side surface 60 of the main body 52. This information can include but is not limited to lot number, production date, expiration date, drug brand name and/or generic name, dose, concentration, and manufacturer.

Vial Insertion

In one embodiment the following activities are undertaken at the fill and finish site.

In one embodiment, a filled vial 16 is placed on top of the bellows base 604 in the vial base subsystem 12 prior to final assembly. In another embodiment, a filled vial 16 is placed on a tripod centering and elevating support structure resting on top of the vial base subsystem 102, prior to final assembly. The vial base subsystem 12 includes a tripod vial holding and support member disposed in a top cavity formed in the bellows base 604. The tripod vial support member is interposed between the bellows base and the bottom wall 23 of the vial 16. The tripod vial support member is selected, sized and shaped to accommodate a plurality of different sizes of vials so that the top of the vial 16 is maintained at a consistent height with respect to the bellows base 604. In an alternative embodiment, a filled vial 16 is inserted upwardly into the main body assembly 20 from underneath until the underside of the aluminum crimp hold down ring 21 on the vial 16 is retentively engaged by the vial retention ring 78, 78A prior to final assembly.

Assembly of Vial Adapter Subsystem into Vial Base Subsystem

The vial adapter subsystem 14 is attached into the vial base subsystem 12 by moving the bottom cap 602 into engagement with the circumferential ring 704A on the main body 52. This is called position 1, which is the position necessary to proceed with gas or vapor sterilization, as described below. In one embodiment this forms a tortuous path $P_T$ between the bellows base 604 and the main body 52 when the tortuous path ribs 614 are utilized in the bellows base 604. In another embodiment the pathway Pa can be an open pathway between the bellows base 604 and the main body 52 when the bellows base 604 lacks or, in other words, does not include the ribs 614 that create a tortuous path.

With the vial adapter subsystem 14 attached to the vial base subsystem 12 in position 1, the entire device 10 can now be sterilized. In one embodiment, sterilizing gas or vapor, including but not limited to Nitrogen Dioxide ($NO_2$), vaporized hydrogen peroxide (VI-IP), and the like can be applied to the surfaces of all of the exposed parts, including the exterior or exposed surfaces of the vial stopper 19, the exterior surfaces on the outside of the vial 16 and any exposed surfaces inside the lower portion of the vial adapter subsystem 14 up to the barrier film 26 through the tortuous path $P_T$ or open path $P_O$ (non-tortuous path).

After sterilization, the device 10 is hermetically sealed by moving the vial base subsystem 12 from assembly position 1 into assembly position 2 with respect to the main body 52. In position 2, the snap ledges 694 on the bottom cap 602 engage with the circumferential ring 704B on the lower portion of the main body 52. This engages the hermetic seal (O-ring seal) 609 between the bellows base 604 and the lower portion of the main body 52.

In one embodiment, the bottom floor, platen, table or shelf and/or the upper platen, ceiling or shelf of the sterilization (i.e., Noxilizer) equipment can be used to move the vial base subsystem or subassembly 12 from the first position or "position 1" to the second position or "position 2" in a batched manner. At least one of the upper and bottom shelves is movable toward the other by a pressing mechanism powered by hand, foot, hydraulics, compressed gas, compressed air, or the like. The movable shelf or shelves are brought to bear on the bottom or top respectively of the safety vial assembly 10 to press, urge or move the vial base subsystem or subassembly 14 from the first position to the second position. It is believed that this kind of mechanical movement, manipulation, compressing, shifting, or transforming of a device from one position to another while captured inside an operating gas or vapor sterilization chamber is novel. In an alternative embodiment, whether a tortuous path or open path is utilized, a special fixture can be used to push on the top cap 36 or the ring 106 on the outer diameter 60 of the main body 52, outside of the sterilization chamber in a batched or individualized manner.

After the device 10 is hermetically sealed, a drug information label 63 can be applied. In one embodiment, the label 63 with a suitable adhesive is applied to the outside diameter 60 of the main body 52 as shown in FIG. 1. In one embodiment, the label 63 has a white back side adhered to the exterior surface 60 of the main body 52 and does not extend completely around the main body 52. This leaves a gap through which the vial 16 and its contents can be examined for discoloration, particulate, or other abnormalities. In one embodiment, the label 63 may redundantly or alternatively be applied to the drug vial side wall 25 and still be visible through the side wall of the lower portion 58A of the main body 52, which may be transparent.

The completed and sterilized assembly 10 is then placed in an appropriate single unit carton made of cardboard, plastic or other suitable material. In another embodiment a thermoformed plastic or foil bag or pouch can be used to hold one or more of the finished devices 10. In another embodiment a large cardboard box can be used to ship multiple quantities of the finished devices 10. A package insert with the appropriate information about the drug is normally included with the safety vial 10 in the packaging.

Manufacturing/Assembly Process Overview

Figure 25:
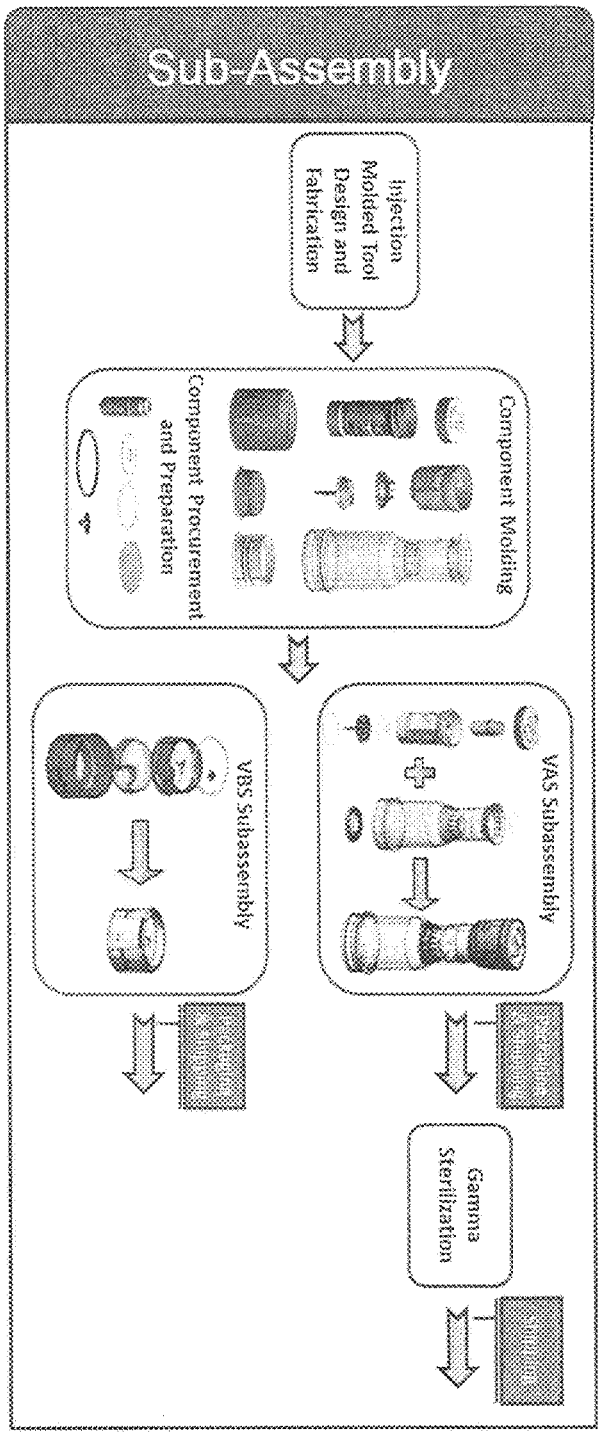
FIG. 25 is a schematic diagram illustrating the process of subassembly according to the invention.
Figure 25A:
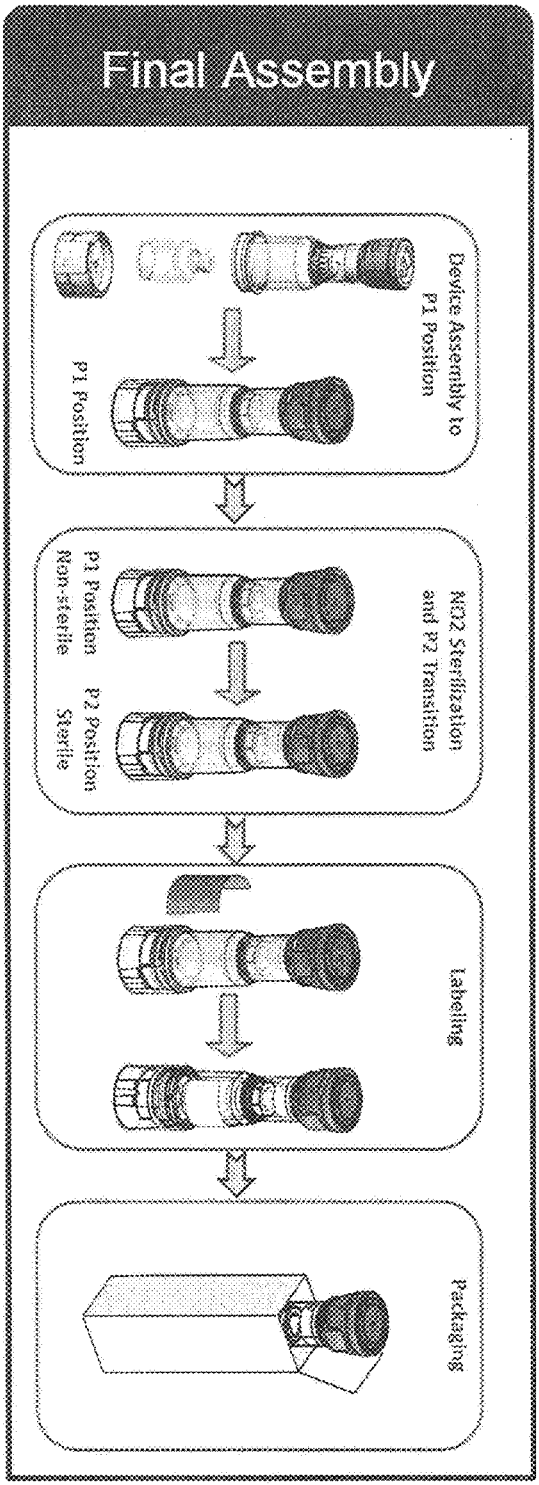
FIG. 25A is a schematic diagram illustrating the process of final assembly according to the invention.

An overview of one embodiment the safety vial system 10 manufacturing and assembly process is provided in FIGS. 25 and 25A. The vial adapter subsystem (VAS) 14 will be sterilized prior to assembly. The VAS 14, the drug product vial 16 (with the drug product 18 therein), and the vial base subsystem (VBS) 12 will be assembled together subsequently to become the complete safety vial system 10. Refer to FIGS. 4, 4A, 4B for a diagram of the VAS 14 and VBS 12. The assembled safety vial system 10 will be sterilized using a Nitrogen Dioxide ($NO_2$) gas sterilization method. Specifically, the outside of the vial 16 and interior surfaces of the safety vial system 10 will be exposed to $NO_2$, so that the top exterior surface 302 of stopper 19 is sterile when punctured. The safety vial system 10 will then be hermetically sealed. This will result in a pre-assembled ready-to-use system.

Nitrogen Dioxide Sterilization

In one embodiment, the gas vapor batch sterilization technology utilizes $NO_2$ gas as the chemical sterilant and is carried out at near room temperature, preferably in the range of 10 degrees C. to 30 degrees C.

A vacuum will be used to initially remove air from within the safety vial system 10 in position 1 to facilitate the entry of the $NO_2$ into the device. Vacuum and compressed air pulses will be utilized during the aeration phase to expedite $NO_2$ removal from the device 10. Initial feasibility testing demonstrates that the gas vapor sterilization process does not affect the device functionality and $NO_2$ does not enter the drug vial. After $NO_2$ sterilization, the safety vial system 10 is then moved to position 2 and thus hermetically sealed. FIGS. 11 and 12 illustrate the safety vial system 10 in positions 1 and 2 respectively.

Using the Safety Vial

Figure 24:
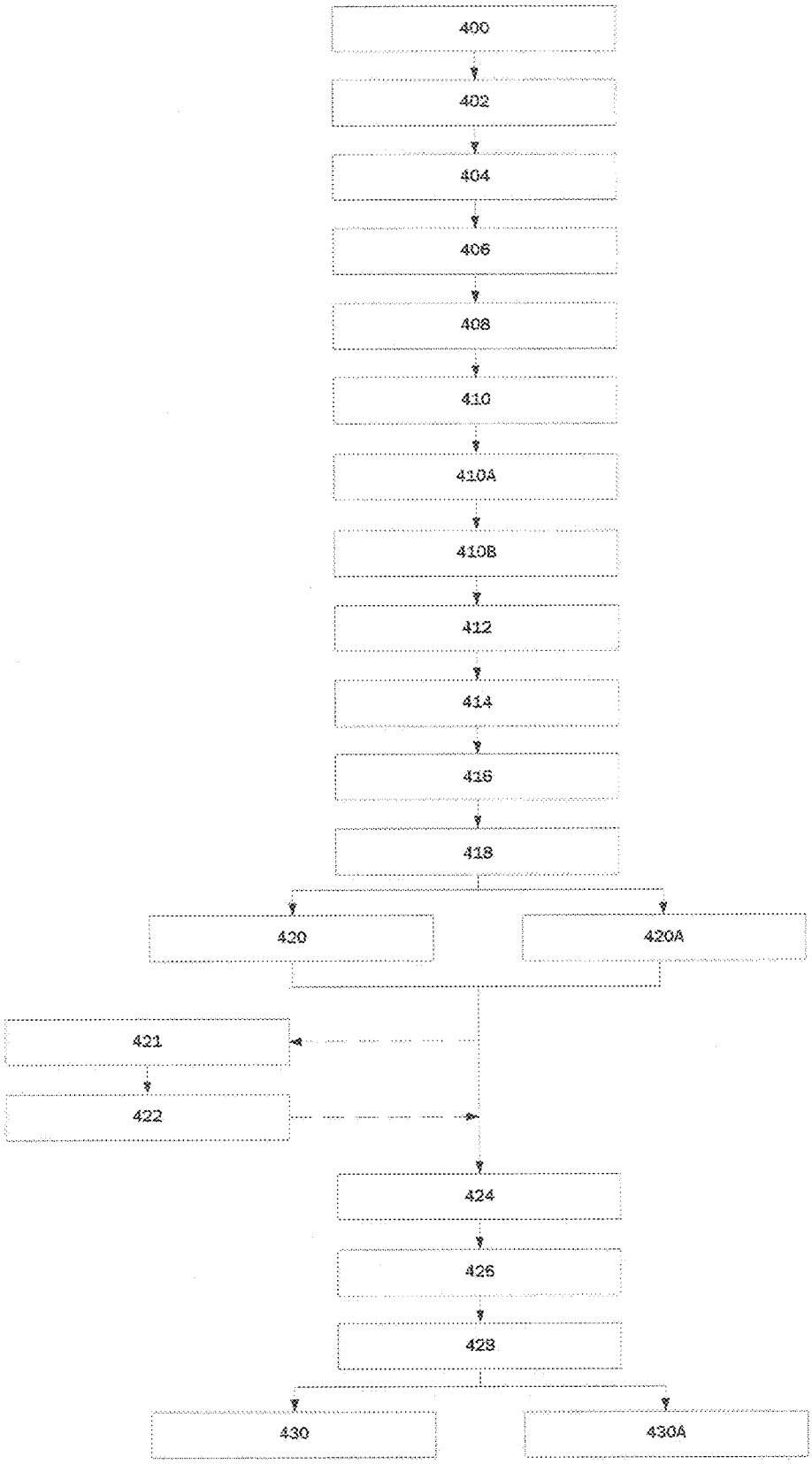
FIG. 24 is a flow diagram showing the steps of using the safety vial system and kit components of the invention.

An overview of the expected use steps for the safety vial system 10 is provided in FIG. 24. In use, the user removes the safety vial device 10 from any shipping packaging in step 400 and does the following steps to utilize the device. Step 402 includes providing the safety vial device or system 10 with the product integrity ring 31 intact or in its initially locked position. Step 404 includes providing a syringe 304. Step 406 includes providing a syringe adapter 306. Step 408 includes removing or pulling the product integrity ring 31 or seal from the vial system 10 by lifting the ring 31 up and pulling upwardly, rearwardly across the top of the device or top cap 36, and down backside of the device or top cap 36 to tear the frangible portion(s) loose in the embodiment of FIG. 7A. Then the ring 31 can be squeezed at the pinch points and released. In the alternative embodiment of FIGS. 7 and 18, the ring 31 is simply released by squeezing at the pinch points. In step 410 the device 10 is activated so that the vial access member 42 is in fluid communication with the interior space 7 of the vial 16. In one embodiment, the activation step 410 includes the step 410A of placing hand(s) on top center of the activation housing assembly 28 at the top cap, and the step 4106 of manually pressing downward. Only upon complete activation, as indicated by auditory/visual/tactile (AVT) generated or received signal in step 412, such as in one embodiment a click/visible arrow molded into the activation housing/snapped fingers engagement, can the user complete the step 414 of removing the top cap by unscrewing it or flipping it off. Step 416 includes setting aside the top cap 36.

Step 418 includes attaching a syringe adapter 306 to a syringe 304 by screwing the respective mating threads or attachment features of these components together. In one embodiment, a male luer adapter 306 is attached to the syringe 304 and then in a step 420 attached to the threads on a Borla B-Site® valve 34. In an alternative embodiment step 420A, the distal end of the syringe adapter 306 is snapped or pressed into a socket 308 formed in the proximal end 310 of the normally closed needleless valve 34, which could be an ICU ChemoLock® valve. In the case where a lyophilized drug 18 is in the vial 16, a further step 421 includes adding a diluent from the prefilled syringe 304. This will cause the bellows chamber 608 to expand due to the volume change, yet a neutral pressure environment will be maintained. It is important to note that, unlike conventional CSTDs, the user does not have to add air to the syringe 304 or to the system 10 for proper operation. A further step 422 that includes swirling and/or shaking of the safety vial is done until the lyophilized drug or other liquid drug is mixed/dissolved/reconstituted satisfactorily. A further step 424 includes inverting or turning the system 10 upside down and in step 426 withdrawing the fluid, wherein the neutral pressure environment in the system is maintained using the functional bellows or bellows chamber 608, with or without the optional check valve 638. During steps 421 and 426, the user does not have to fight or struggle to overcome pressure from within the system. The fluid addition and withdrawal processes are relatively smooth, accurate and almost effortless. The user can pause or rest at any point as needed or to evaluate the volume in the syringe 304 because the syringe plunger 305 is not urged in either direction by pressure or vacuum forces from within the system 10. A further step 428 includes disconnecting the filled syringe 304 from the safety vial 10 by unscrewing it from the needleless valve 34 in one embodiment. In an alternative embodiment, the user pinches the opposing fingers 307 on the syringe adapter 306 to disconnect the filled syringe 304 from the safety vial 10.

Figure 26:
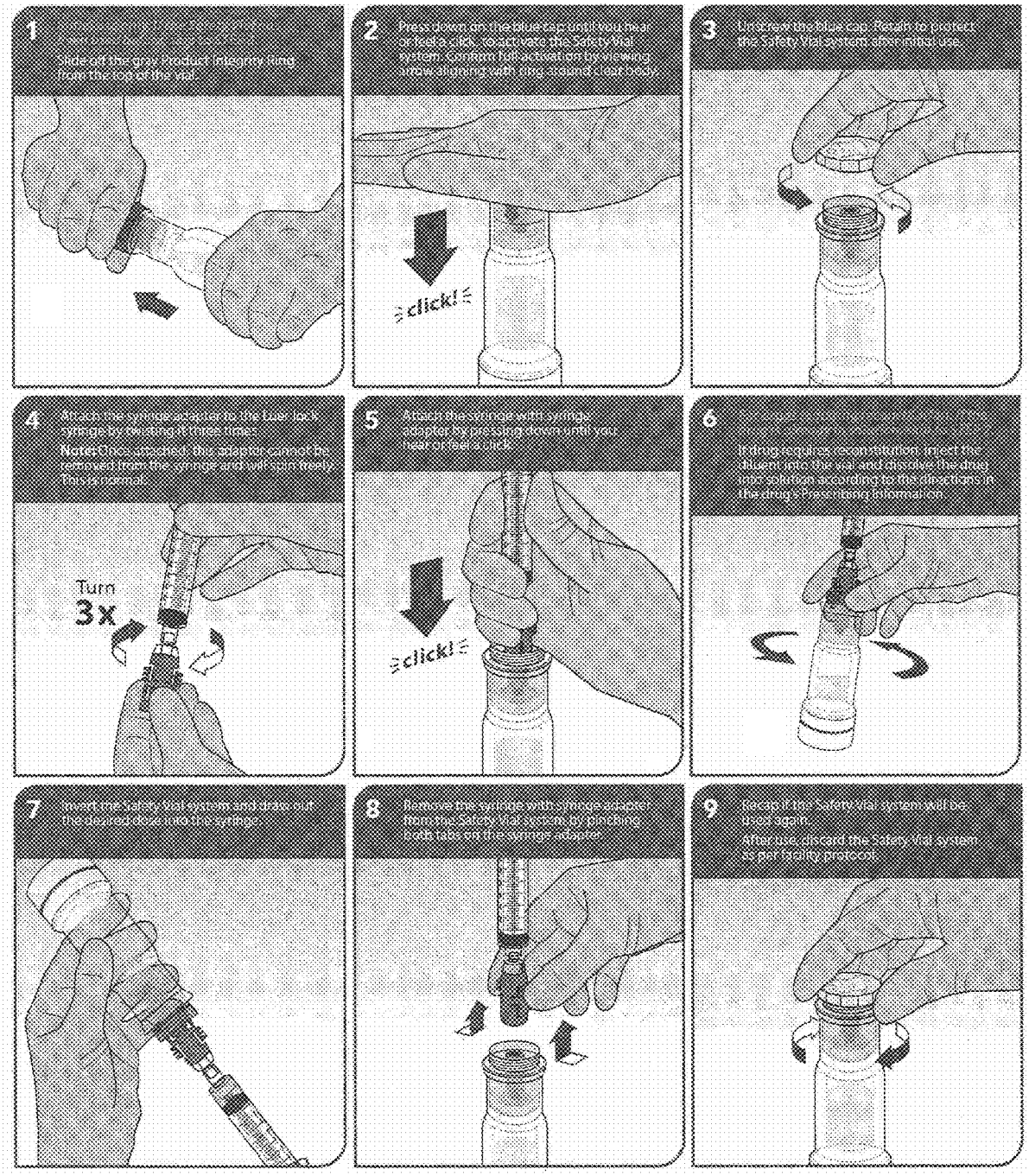
FIG. 26 is a schematic diagram illustrating steps for using the safety vial system and syringe (or collectively, the kit) according to the invention.

If the system 10 is being used as a single use system, the system 10 can be disposed in an appropriate manner as prescribed for medical waste in a further step 430, but any remaining liquid contents are securely enclosed within the system 10. Otherwise, if the system 10 is being used for multiple drug withdrawals or uses (multi-use), an alternative further step 430A would include setting the system 10 aside in an appropriate storage location and under appropriate storage conditions for future use, as permitted according to shelf life recommendations from the manufacturer, regulatory authorities, or clinical/medical institution practices. FIG. 26 illustrates a method of using the safety vial system and kit according to one embodiment of the invention and provides instructions for use to a user.

Utility, Advantages and Accomplishment of Objectives

In one embodiment, the safety vial system 10 is a single entity combination product as defined in 21 CFR 3.2(e)(1). It includes a vial adapter subsystem 14 and a vial base subsystem 12, which are assembled to enclose a drug vial 16. Preferably, the drug vial 16 is prefilled with a drug product 18, which can be liquid, dry or lyophilized, at the drug manufacturer's site. However, one skilled in the art will appreciate that filling of the drug vial can be done offline, concurrently or even after safety vial system 10 is initially built. An empty system 10 can be provided to an end user, pharmacy or compounder to open, fill with drug product 18, or mix at their site.

Figure 2:
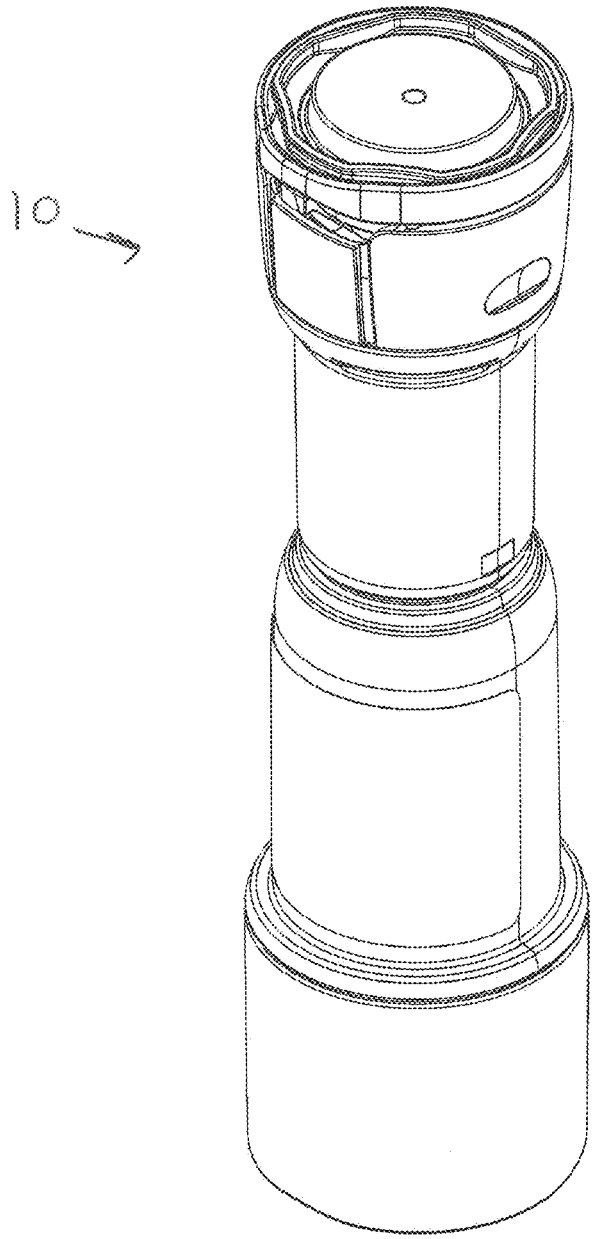
FIG. 2 is a perspective, assembled view of a safety vial system with vapor containment according another embodiment of the present invention.
Figure 2A:
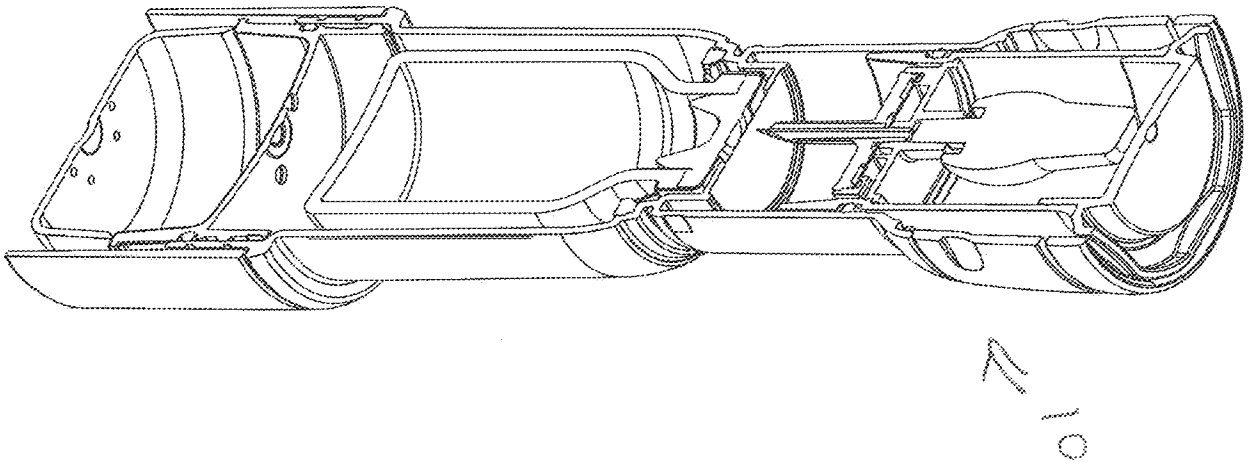
FIG. 2A is a cross-sectioned perspective view of a safety vial system according to the embodiment of FIG. 2.
Figure 2B:
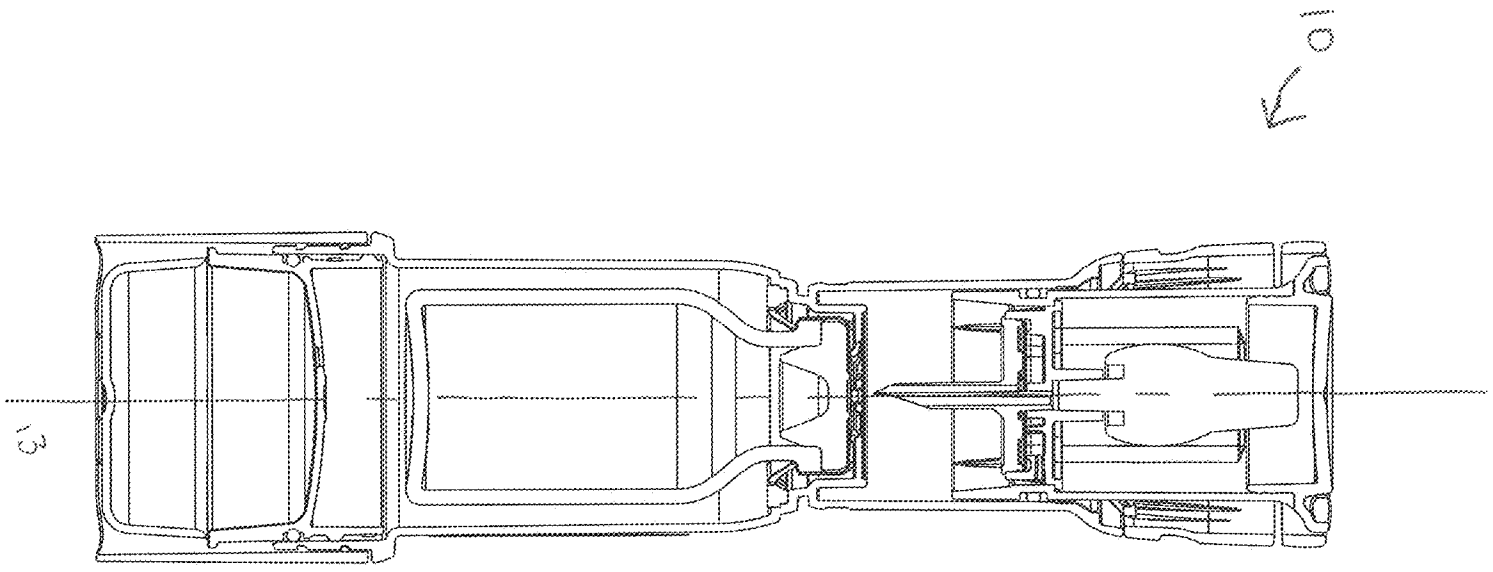
FIG. 2B is a cross-sectional view of a safety vial system according to the embodiment of FIG. 2 in a pre-activation state.
Figure 3:
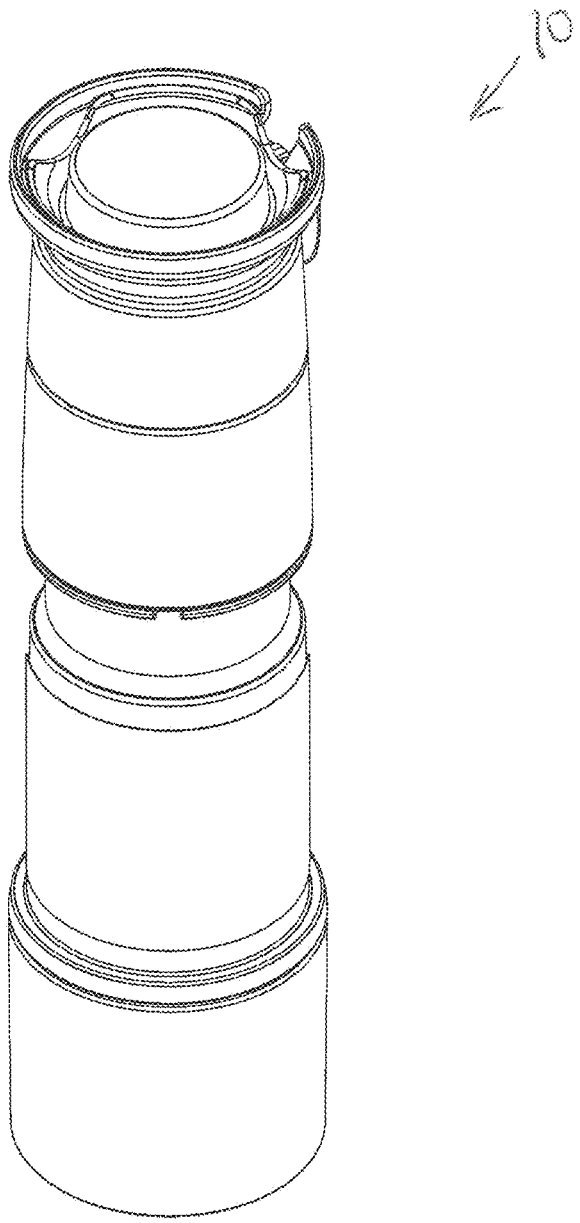
FIG. 3 is a perspective view of the safety vial system according to another embodiment of the invention.
Figure 3A:
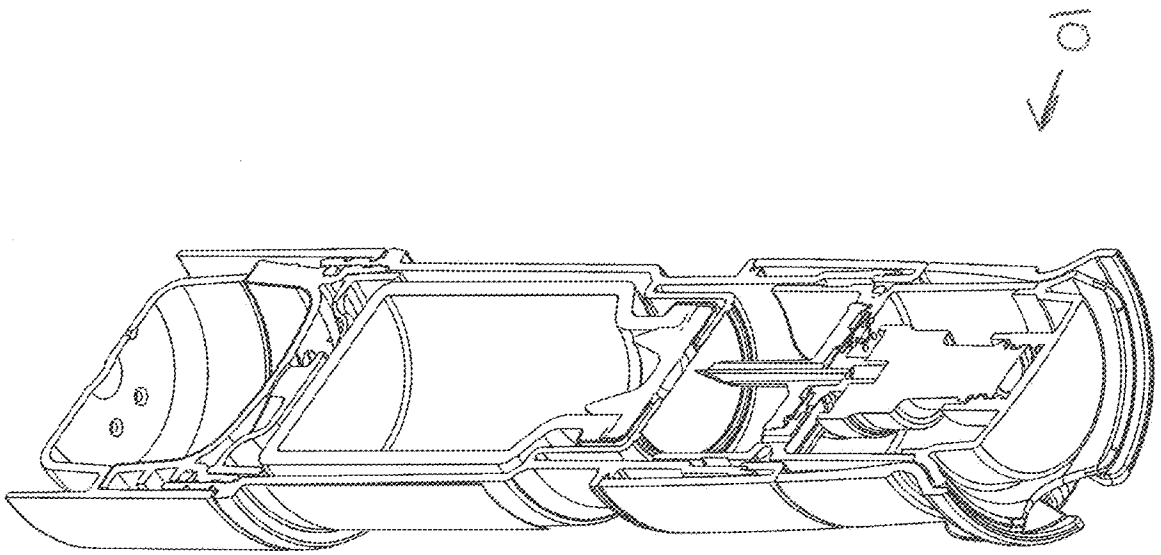
FIG. 3A is a cross-sectioned perspective view of a safety vial system according to the embodiment of FIG. 3.
Figure 3B:
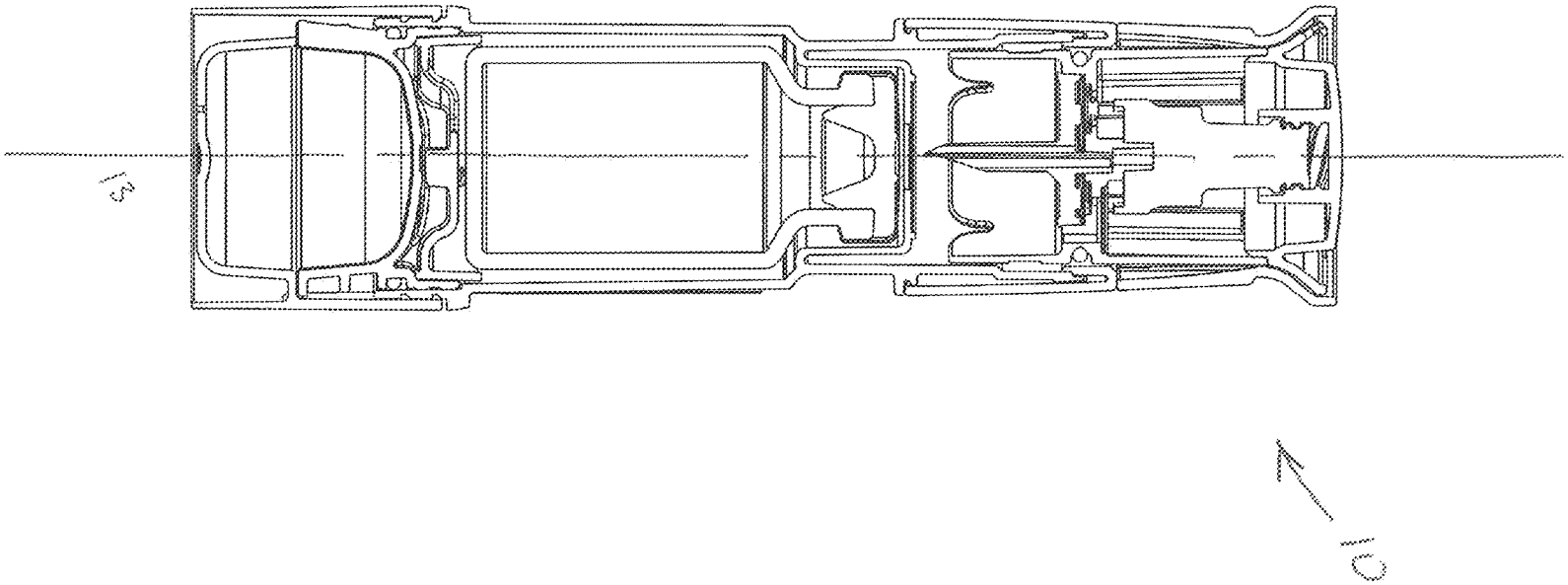
FIG. 3B is a cross-sectional view of a safety vial system according to the embodiment of FIG. 3 in a pre-activation state.

The system includes a drug vial 16 housed within a device assembly 12, 14 that results in a pre-assembled, ready-to-use safety vial system 10. The safety vial system 10 is comprised of a vial adapter subsystem 14 and a vial base subsystem 12 which are assembled to enclose a drug vial 16. The vial adapter and vial base subsystems 14, 12 are shown disassembled from the drug vial in FIG. 2 and FIG. 1 shows the fully assembled safety vial system 10.

The safety vial system 10 provides features to ensure:

- Containment of hazardous drug 18 (liquid or powder vial contents) inside the safety vial system 10 by providing an additional layer of protection.
- Prevention of inadvertent contact with hazardous liquids from the vial 16 during transfer of the vial contents.
- Containment of potentially hazardous vapors, which might otherwise be released during reconstitution or withdrawal of the vial contents.
- Access to the vial contents without the use of a needle, thus preventing needle-sticks.
- Prevention of misuse. In its primary embodiment, the device 10 is a preassembled, single-entity combination product. As such, it reduces the user interaction during the assembly process that is needed with the currently marketed oncolytic containment devices.

Figure 1E:
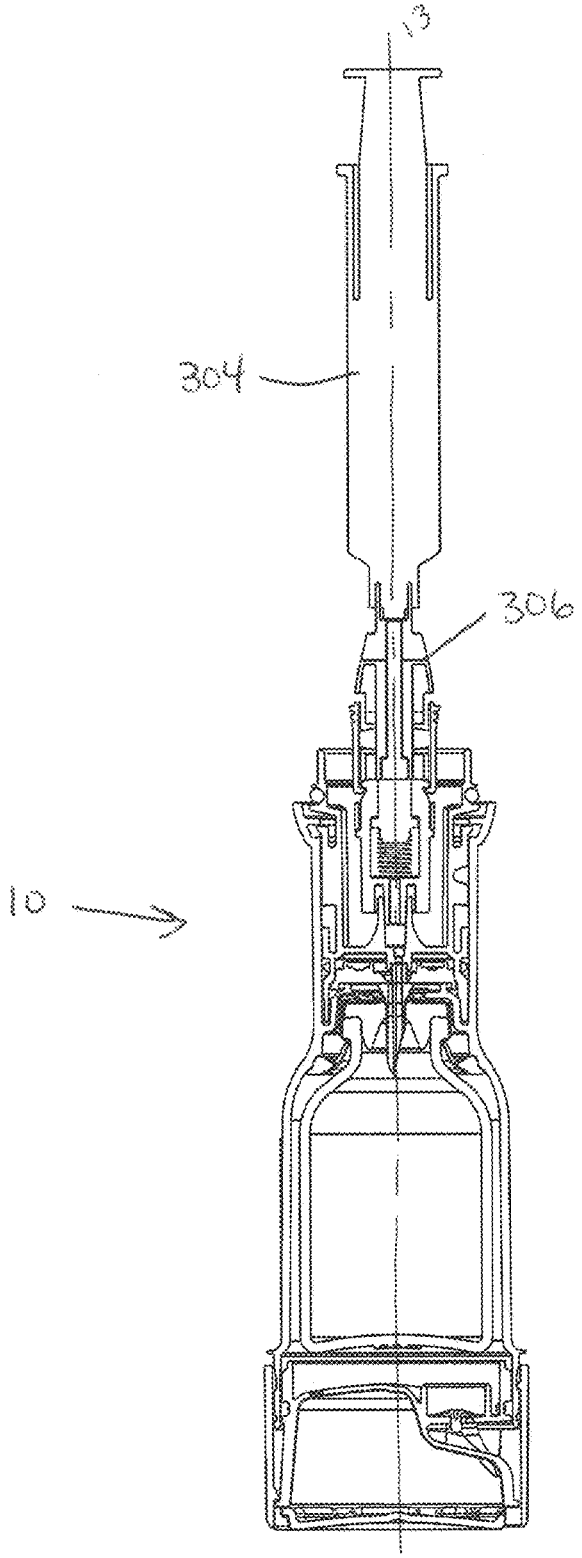
FIG. 1E is a cross-sectional view of a safety vial system with a syringe attached after activation according to one embodiment of the invention.
Figure 1F:
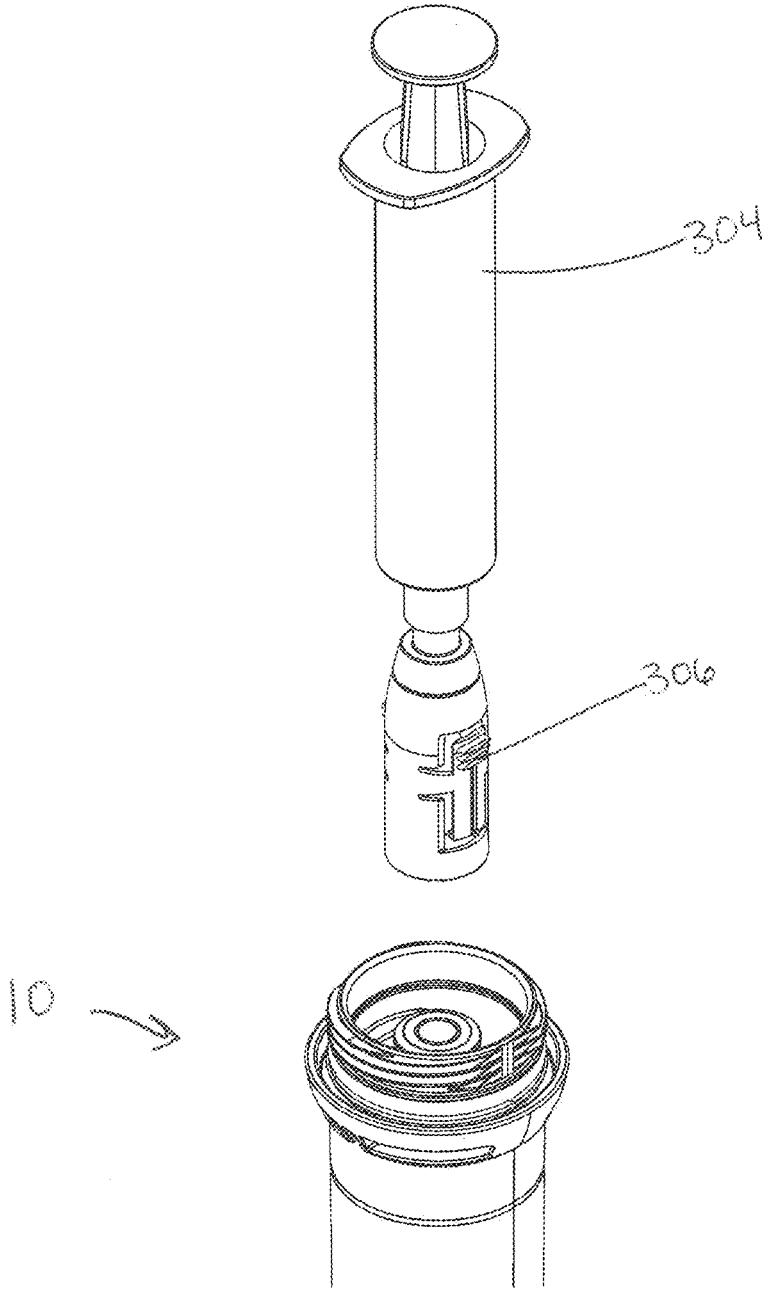
FIG. 1F is an enlarged partial perspective view of a safety vial system with a syringe having an adapter attached according to one embodiment of the invention.

The safety vial system 10 can be coupled with a compatible syringe 304 and, if necessary, a syringe adapter 306 to allow fluid flow. The syringe adapter 306 is an off the shelf component available from manufacturers such as Borla and ICU Medical. FIGS. 1E and 1F show the syringe 304 and syringe adapter 306. Thus, the safety vial system 10 can supplied to the user as a kit comprising an adapter 306 configured to couple with the syringe 304 and the needleless valve 34 to sealingly connect the safety vial system 10 to the needleless syringe 304 and open the needleless valve 34 to allow fluid communication between the safety vial system 10 and the syringe 304.

The safety vial system 10 captures droplet and vapor emissions to prevent the hazardous medication from escaping into the immediate environment. It also prevents ingress of environmental contaminants during the drug transfer. The safety vial system 10 is disposable and has several safety features that prevent component separation and misuse. These features prevent the substitution of drug vials 16 within the safety vial system. Once the safety vial system 10 has been activated, it provides a closed pathway for contained transfer of the medication from the vial 16 into a syringe 304.

Functional prototypes were exposed to a dual sterilization process where the vial adapter sub-systems were gamma sterilized, and then the assembled prototypes of complete safety vial system 10 were exposed to $NO_2$ gas vapor sterilization.

Multiple sizes are established to accommodate different vial sizes.

The safety vial system 10 will not come into direct contact with the drug product formulation. The system is activated by pushing down on the top cap 36 until the user hears or feels a "click." After activation, the user attaches the compatible syringe 304, coupled with a syringe adapter 306, which produces an open fluid path for medication transfer via a normally closed needleless valve 34. Only the internal components of the safety vial device 10 and the normally closed needleless valve 34 will be in direct contact with the medication during the drug transfer procedure. The needleless valve 34 facilitates the transfer of fluid without the use of a syringe needle, thereby preventing needle sticks.

The solution contacting components are isolated from exposure to $NO_2$ during sterilization by the barrier film 26 and screw cap 36. The internal features of the system, such as its seals 44, 101, main body 52, filters 40, 640, bellows base 604, and bottom cap 602 provide supplementary containment of the drug product 18 and may come into contact with residual amounts of drug product post activation; however, this drug product 18 will not come into direct contact with the sterilant and is not available for patient administration. Residual amounts of the drug product 18 cannot escape the system 10.

The carton and container labeling of the safety vial drug product will contain the same content and format as the existing approved drug product carton labeling and container labels. The label 63 when applied or adhered to the outside of the safety vial system can be larger than the current conventional labels, which are normally adhered to the drug vial 16 itself, because of the increase in diameter of the safety vial relative to the approved drug vial contained therein. This size increase should allow for larger font size for easier legibility. The label colors on the existing drug product will be used for the safety vial label 63 as the concentration and strength of the standalone drug vial and the safety vial will be identical. Changing the location of the label 63 will not affect the functionality, safety, or effectiveness of the safety vial system 10 or drug product 18, because it will minimize visual obstruction to the drug vial contents by the sub-assemblies.

The safety vial system design includes product integrity ring 31 features which prevent the user from being able to access the internal components of the device. Therefore, once the complete combination product is assembled during manufacture, the user will be restricted from accessing the internal drug vial directly or from modifying the drug vial of the safety vial system without leaving evidence of tampering or use. Multi-dose, single dose, liquid, and lyophilized drug presentations, whether at room temperature or refrigerated, are believed to be suitable for use and benefit from this safety vial system 10 and its associated methods.

Non-Limiting Nature of Disclosure

Although embodiments of the present invention have been discussed primarily with respect to specific embodiments thereof, other variations are possible. Various configurations of the described system may be used in place of, or in addition to, the configurations presented herein. For example, additional components may be included where appropriate. As another example, configurations were described with general reference to certain types and combinations of system components, but other types and/or combinations of components could be used in addition to or in the place of those described.

Those skilled in the art will appreciate that the foregoing description is by way of example only and is not intended to limit the present invention. Nothing in the disclosure should indicate that the present invention is limited to systems that have the specific type of devices shown and described. Nothing in the disclosure should indicate that the present invention is limited to systems that require a particular form of hardware components, except where specified. In general, any diagrams presented are only intended to indicate one possible configuration, and many variations are possible. Those skilled in the art will also appreciate that methods and systems consistent with the present invention are suitable for use in a wide range of applications.

While the specification has been described in detail with respect to specific embodiments of the present invention, it will be appreciated that those skilled in the art, upon attaining an understanding of the foregoing, may readily conceive of alterations to, variations of, and equivalents to these embodiments. These and other modifications and variations to the present invention may be practiced by those skilled in the art, without departing from the scope of the present invention, which is more particularly set forth in the appended claims.

What is claimed is:

1. A safety vial system for enclosing a drug vial filled with a hazardous drug comprising:

a vial adapter subsystem comprising a main body assembly, an activation housing assembly irreversibly coupled and hermetically sealed to the main body assembly and yet movable telescopically and axially in a distal direction with respect to the main body assembly between a first proximally raised position and a second distally extended lowered position, and a product integrity ring releasably coupling the vial adapter subsystem with the main body assembly to retain the activation housing assembly in the first proximally raised position until forcibly released;

a vial base subsystem including a bellows base assembly comprising a bellows base and an expandable bellows comprising a flexible bellows film having an upper surface and a lower surface and being sealingly attached to the bellows base to define an expandable bellows chamber between the upper surface of the bellows film and the bellows base; and a vial having a central longitudinal axis, a bottom wall, a side wall joined with the bottom wall and extending around the central longitudinal axis to form an upper portion that has a top opening sealed with a stopper to define a internal reservoir for containing a medicament, the vial having an external surface and being disposed between the vial adapter subsystem and the vial base subsystem with the bottom wall directed toward the vial base subsystem;

wherein the vial adapter subsystem and the vial base subsystem are generally tubular and arranged along a common central longitudinal axis with the central longitudinal axis of the vial and the vial is supported by at least one of the vial adapter subsystem and the vial base subsystem;

wherein the vial adapter subsystem and the vial base subsystem are movably telescopically connected to each other in a first position wherein an open pathway is provided for a sterilization gas to sterilize the external surface of the vial while the vial is supported between the vial adapter subsystem and the vial base subsystem; and wherein the vial base subsystem and the vial adapter subsystem are telescopically movable toward each other and into a second position wherein the pathway is hermetically sealed closed after the external surface of the vial is sterilized with the sterilization gas.

2. The safety vial system of claim 1, wherein the vial is prefilled with a medicament that is a hazardous drug selected from a group consisting of Carboplatin, Docetaxel, Paclitaxel, Irinotecan, Gemcitabine, Oxaliplatin, Methotrexate, Bortezomib, Cyclophosphamide, and Pemetrexed.

3. The safety vial system of claim 1, wherein the activation housing assembly comprises a tubular activation housing having a top opening, a bottom opening, an interior surface and an exterior surface, the activation housing assembly further comprising a dual lumen vial access member mounted in the activation housing with a first lumen for medicament and a second lumen for air, a normally closed needleless valve connected to the vial access member and fluidly connected to the first lumen to define a medicament fluid passage, and a cap detachably mounted in sealing relation to one of the top opening of the activation housing and the needleless valve for maintaining sterility of an outlet port of the needleless valve until the cap is removed.

4. The safety vial system of claim 3, wherein the activation housing assembly comprises a bulkhead member mounted inside the activation housing for supporting the vial access member and the needleless valve.

5. The safety vial system of claim 4, comprising a filter operatively mounted in covering relation to a passage through the bulkhead member fluidly connected to the air lumen of the dual lumen vial access member and the bellows chamber.

6. The safety vial system of claim 5, wherein the filter comprises a first filter element that is hydrophobic and oleophobic and a second filter element that is hydrophilic, the first filter element being mounted so as to be directed toward the air lumen for retaining fluids in the vial and the second filter element being directed to toward the bellows chamber for allowing displaced air volume from the vial to reach the expandable bellows chamber.

7. The safety vial system of claim 4, wherein the bulkhead member is a separate component from the activation housing, the vial access member and the needleless valve, and wherein the bulkhead supports a filter operatively covering a passage fluidly connected to the air lumen of the vial access member, and wherein a check valve is mounted in the bulkhead member for adding ambient air through the filter from outside the safety vial system as necessary to maintain a neutral pressure environment in the safety vial system.

8. The safety vial system of claim 3, wherein the exterior surface of the activation housing includes at least one one-way activation snap located axially spaced distally below the plurality of manufacturing snaps.

9. The safety vial system of claim 1, wherein the main body assembly comprises a tubular main body having a top opening, a bottom opening, an interior surface and an exterior surface, and a vial retention ring mounted within the interior surface of the main body for capturing an upper portion of the vial.

10. The safety vial system of claim 9, wherein the main body has a shoulder extending radially inward from the interior surface, the shoulder being spaced axially and proximally above the vial retention ring and adapted to limit the upward proximal axial insertion of the upper portion of the vial into the main body and accurately position the vial axially within the safety vial system.

11. The safety vial system of claim 9, wherein the vial retention ring comprises annular rim and a plurality of circumferentially spaced J-shaped clips extending radially inwardly and upwardly from the annular rim, the J-shaped clips being deflectable about a pivot axis that is on an outer elbow side of the J-shaped clips that is adjacent to the vial such that the clips pivot outwardly and upwardly to receive the upper portion of the vial when the vial is insert upwardly into the main body through the bottom opening of the main body, and the clips spring back downwardly and radially inward to supportingly rest against one of an underside of a hold down ring securing the stopper in the top opening of the vial and the exterior surface of the outer wall of the vial at a narrowed neck of the vial located below the hold down ring.

12. The safety vial system of claim 1, wherein the main body comprises a lower portion, an upper portion, and an intermediate portion disposed between the upper portion and the lower portion, and a barrier film is sealingly attached in covering relation across a top opening of the intermediate section to separate the safety vial system such that the vial adapter subsystem can be dual sterilized by irradiating the vial adapter subsystem, inserting a vial pre-filled with a medicament into the vial adapter subsystem, mounting the vial base subsystem to the vial adapter subsystem in the first position, placing the assembled safety vial system in its first position in a chamber for gas sterilization, closing the chamber for gas sterilization, gas sterilizing external surfaces of the safety vial system including external surfaces of the vial and stopper and within the interior surface of the main body below the barrier film, moving the vial adapter subsystem and vial base subsystem from the first position to the second, sealed position while the safety vial system is in the gas sterilization chamber by applying an axial force with one of a moving floor and collapsing shelf within the gas sterilization chamber.

13. The safety vial system of claim 12, wherein the upper portion of the main body includes at least one one-way manufacturing snap detent for engaging at least one of a plurality of mating manufacturing snaps formed on opposing sides of the activation housing on the exterior surface thereof.

14. The safety vial system of claim 1, comprising a bottom cap mounted to one of the bellows base and the main body and extending therebelow to cover the bellows film.

15. The safety vial system of claim 14, wherein the bottom cap has an interior cup portion defining a cavity for receiving the flexible bellows film as it expands downwardly and a tubular outer sleeve portion attached to the interior cup portion, the tubular outer sleeve portion having a lower end and an upper end with a top opening therein; the bellows base being carried by the bottom cap in the cavity; the tubular outer sleeve portion of the bottom cap having at least one snap detent formed on an interior surface of the sleeve portion adjacent the top opening of the sleeve portion for engaging one of at least a pair of axially spaced mating snap detents adjacent the lower end of the main body; the bottom cap being movably axially in a proximal direction from the first position, which is associated with a lower of the at least a pair of axially spaced mating snap detents on the main body, to the second position, which is associated with an upper of the at least a pair of axially spaced mating snap detents.

16. The safety vial system of claim 15, wherein the at least one snap detent on the interior surface of the tubular outer sleeve portion of the cap is one of an unbroken annular rib and a circumferentially broken annular rib, and the at least a pair of axially spaced mating snap detents on the main body are annular ring grooves for receiving the rib of the bottom cap.

17. The safety vial system of claim 15, wherein the lower end of the tubular outer sleeve portion of the bottom cap has a raised archway defining a passageway for air to enter under the bottom cap.

18. The safety vial system of claim 14, wherein the safety vial system comprises a check valve in one of the vial adapter subsystem and the vial base subsystem for adding ambient air from outside the safety vial system as necessary to maintain a neutral pressure environment in the safety vial system.

19. The safety vial system of claim 18, wherein the check valve for adding ambient air to the safety vial system is in the vial base subsystem and comprises an umbrella valve mounted in the bellows base for selectively opening and sealing an ambient air passage that extends through the bellows base.

20. The safety vial system of claim 19, wherein the ambient air passage extends through one of at least one hole in the bellows base and at least one hole in the bottom cap to reach an environment external to the safety vial system.

21. The safety vial system of claim 18, wherein the bottom cap has an outer sleeve portion and the ambient air passage extends through a hole in a side wall of the outer sleeve portion of the bottom cap.

22. The safety vial system of claim 1, comprising a seal operatively interposed between an outer surface of the bellows base and an inner surface of the main body.

23. The safety vial system of claim 22, wherein the seal operatively interposed between the outer surface of the bellows base and the inner surface of the main body comprises an O-ring disposed in a groove formed in the outer surface of the bellows base.

24. The safety vial system of claim 1, wherein the vial activation housing, product integrity ring, main body, and vial base subsystem all share a common central longitudinal axis with the vial and together define for a generally cylindrical outer profile after manufacturing and during use.

25. The safety vial system of claim 1, wherein the vial activation housing, product integrity ring, main body, and vial base subsystem all share a common central longitudinal axis with the vial and together define for the safety vial system a generally cylindrical outer profile with respective outer diameters related to each other as follows: the vial base subsystem has an outer diameter that is larger to approximately the same size as the main body; the main body has an outer diameter that is larger to approximately the same size as the activation housing; and the product integrity ring has an outer diameter that is less than the outer diameters of the main body and the vial base subsystem.

26. The safety vial system of claim 1, wherein the vial activation housing, product integrity ring, main body, and vial base subsystem all share a common central longitudinal axis with the vial and together define for the safety vial system a cylindrical outer profile and are sized and shaped such that the safety vial system has a center of gravity located within the safety vial system, within the profile of the safety vial system, and in the lower ½ of the safety vial system whereby the safety vial system is resistant to tipping over during conveyor transport, sterilization, and in use when the vial base subsystem is placed on a flat, level surface.

27. The safety vial system of claim 1, wherein the main body has an opening in an upper portion thereof that is hermetically sealed by a barrier film extending across the opening, the barrier film separating the vial adapter subsystem into an upper sealed portion that is sterilized by irradiation and a lower unsealed portion that is sterilized by exposure to a gas sterilant.

28. The safety vial system of claim 27, wherein the gas sterilant is selected from a group of gas sterilants composed of $NO_2$, Vaporized Hydrogen Peroxide (VHP), Ethylene Oxide (ETO), Ozone, and Plasma.

29. The safety vial system of claim 1, wherein the pathway is a substantially open pathway.

30. The safety vial system of claim 1, wherein the pathway is a tortuous pathway defined by multiple turns along the bellows base due to a series of annular grooves and annular ribs formed between the annular grooves, the annular ribs being broken at opposing sides.

31. A method of making a safety vial system, comprising the steps of:

providing a vial filled with a drug and having a central longitudinal axis;

providing a vial adapter subsystem;

providing a vial base subsystem;

irreversibly inserting the vial into a vial retention ring in the vial adapter;

aligning the vial adapter subsystem holding the vial with the vial base subsystem so the vial base subsystem and vial adapter subsystem share a common central longitudinal axis with the vial;

coupling the vial adapter subsystem and the vial base subsystem together in a first position relative to each other wherein a pathway is defined between the subsystems for a gas sterilant to reach external surfaces of the vial;

placing the safety vial system in a gas sterilization chamber;

sterilizing the safety vial system using a gas sterilant in a sealed gas sterilization chamber and, while the safety vial system is still in the sealed gas sterilization chamber and using a moving member in the gas sterilization chamber, telescopically moving the subsystems of the safety vial system from the first position to a second position where the pathway is sealed closed;

opening the sealed gas sterilization chamber; and moving the sterilized unit out of the sealed gas sterilization chamber.

32. A kit for storage and fluid transfer of a hazardous drug comprising:

a safety vial system fully enclosing an elongated sealed container having a central longitudinal axis, an upper portion, a bottom wall and a side wall together defining an interior space containing a drug to be transferred, the safety vial system comprising:

a vial adapter subsystem covering the upper portion of the container and comprising:

a main body assembly irremovably mounted to and surrounding at least part of the upper portion of the container, the main body assembly including a tubular main body having a wall defining an interior space radially surrounding at least a part of the upper portion of the container;

an activation housing assembly irreversibly coupled and hermetically sealed to the main body assembly and yet axially telescopically movable in a distal direction with respect to the main body assembly between a first proximally raised position and a second fully distally extended lowered position, the activation housing assembly comprising:

a tubular activation housing;

a hollow vial access member mounted in the activation housing and having a pointed distal end for accessing the interior space of the sealed container to establish fluid communication therewith, a proximal end, and fluid passage extending from the pointed distal end to the proximal end;

a normally closed needleless valve mounted in the activation housing connected to the vial access member and in fluid communication with the fluid passage of the vial access member, a barrier film mounted in sealing covering relation across an upper opening of the tubular main body to isolate the interior space of the tubular main body below the barrier film from the activation housing assembly in the first position and being punctured by the vial access member as the activation housing assembly is moved to its second position, and a product integrity ring releasably coupling the activation housing with the main body assembly to retain the activation housing assembly in the first proximal raised position until the product integrity ring is forcibly released; and a sealing member operatively interposed between the tubular activation housing and the main body assembly for maintaining a hermetic movable radial seal therebetween to provide smooth relative telescopic movement;

a vial base subsystem extending distally from the bottom wall of the container, the vial base subsystem being joined to and selectively movable axially with respect to the vial adapter subsystem from a first position wherein a pathway for a sterilant is defined between the vial adapter subsystem and the vial base subsystem to a second position wherein the pathway is sealed closed, the vial base subsystem supporting and enclosing an expandable bellows chamber located at least partially below the bottom wall of the container; and a needleless syringe for fluid tightly coupling with the needleless valve and withdrawing the drug from the container within the safety vial system;

wherein the safety vial system is configured to expand and contract the expandable bellows chamber as needed to maintain a neutral pressure environment in the safety vial system and surrounding the container such that leaks of the drug in any form, including liquid, gas and mixtures thereof, are captured during withdrawal from the container and transfer to the needleless syringe.

33. The kit of claim 32, wherein the vial base subsystem comprises a bellows base, a bellows film having a freely movable central flexible portion and an outer brim portion with a periphery that is sealingly connected to a lower end of the bellows base to define the expandable bellows chamber between the bellows base and the bellows film, and a rigid bottom cap mounted to one of the main body and bellows base for protectively encasing the bellows base and the bellows film and limiting the movement of the bellows film; wherein the bellows base is movably coupled to the main body or the vial adapter subsystem and an annular seal is operatively interposed between the bellows base and main body of the vial access subsystem.

* * * * *